US009333538B1

(12) United States Patent
Bogner et al.

(10) Patent No.: US 9,333,538 B1
(45) Date of Patent: May 10, 2016

(54) TECHNOLOGIES FOR MATERIAL SEPARATION

(71) Applicant: American Biocarbon, LLC, Albany, NY (US)

(72) Inventors: Erwin Bogner, Westhampton Beach, NY (US); Richard J. Gobel, Mill Creek, WA (US)

(73) Assignee: American Biocarbon, LLC, White Castle, LA (US)

( * ) Notice: Subject to any disclaimer, the term of this patent is extended or adjusted under 35 U.S.C. 154(b) by 0 days.

(21) Appl. No.: 14/633,082

(22) Filed: Feb. 26, 2015

(51) Int. Cl.

| | |
|---|---|
| ***B07B 1/22*** | (2006.01) |
| ***B07B 7/08*** | (2006.01) |
| ***B07B 15/00*** | (2006.01) |
| ***B07B 9/02*** | (2006.01) |

(52) U.S. Cl.
CPC ... *B07B 7/08* (2013.01); *B07B 9/02* (2013.01); *B07B 15/00* (2013.01)

(58) Field of Classification Search
CPC ..... B07B 7/08; B07B 9/02; B07B 15/00
USPC ..... 209/10, 12, 44.2, 133, 139.1, 147
See application file for complete search history.

(56) References Cited

U.S. PATENT DOCUMENTS

| | | | | |
|---|---|---|---|---|
| 3,095,680 | A | | 7/1963 | Thornton et al. |
| 3,833,117 | A | | 9/1974 | Mackenzie et al. |
| 3,976,499 | A | | 8/1976 | Tilby |
| 3,992,754 | A | | 11/1976 | McCloskey et al. |
| 4,386,492 | A | | 6/1983 | Tilby |
| 4,572,741 | A | | 2/1986 | Mason |
| 4,743,307 | A | | 5/1988 | Mason |
| 5,021,150 | A | * | 6/1991 | Burklin ..... B07B 1/22 209/245 |
| 5,025,929 | A | * | 6/1991 | Carrera ..... B03B 9/06 209/152 |
| 5,234,543 | A | | 8/1993 | Markham et al. |
| 5,308,368 | A | * | 5/1994 | Duijn ..... B03B 9/06 239/455 |
| 5,361,909 | A | * | 11/1994 | Gemmer ..... B07B 1/005 209/12.1 |
| 5,538,594 | A | | 7/1996 | Hank et al. |
| 5,587,048 | A | | 12/1996 | Streisel et al. |
| 5,597,447 | A | | 1/1997 | Hank et al. |
| 5,733,412 | A | | 3/1998 | Markham et al. |
| 5,797,549 | A | | 8/1998 | Williams |
| 5,800,578 | A | | 9/1998 | Johnson |

(Continued)

FOREIGN PATENT DOCUMENTS

| | | | |
|---|---|---|---|
| CN | 2440309 | Y | 8/2001 |
| CN | 202652873 | U | 1/2013 |

(Continued)

OTHER PUBLICATIONS

CN202652873 published Jan. 9, 2013, abstract only in English (1 page).

(Continued)

*Primary Examiner* — Terrell Matthews
(74) *Attorney, Agent, or Firm* — Dentons US LLP

(57) ABSTRACT

A technology for material separation is provided. The technology enables an output of a first material from a rotary lifter. The technology enables a direction of a fluid stream onto the first material in flight based on the output of the first material such that the first material is separated into at least a second material and a third material. The technology enables a conveyance of the second material away from the rotary lifter. The technology enables a removal of the third material via a vacuum port.

30 Claims, 30 Drawing Sheets

(56) References Cited

U.S. PATENT DOCUMENTS

| | | | | |
|---|---|---|---|---|
| 5,865,947 | A | 2/1999 | Markham et al. | |
| 5,868,256 | A * | 2/1999 | Teppo | B03B 5/42 209/173 |
| 5,902,976 | A | 5/1999 | Beasley | |
| 6,010,012 | A | 1/2000 | Gero | |
| 6,053,439 | A | 4/2000 | Locke et al. | |
| 6,303,177 | B1 | 10/2001 | Ning et al. | |
| 6,355,295 | B1 | 3/2002 | Altemueller et al. | |
| 6,355,296 | B1 | 3/2002 | Altemueller et al. | |
| 6,395,131 | B1 | 5/2002 | Doelle et al. | |
| 6,423,364 | B1 | 7/2002 | Altemueller et al. | |
| 6,451,165 | B1 | 9/2002 | Doelle et al. | |
| 6,465,037 | B1 | 10/2002 | Altemueller et al. | |
| 6,544,385 | B2 | 4/2003 | Doelle et al. | |
| 6,582,746 | B2 | 6/2003 | Altemueller et al. | |
| 7,028,844 | B2 * | 4/2006 | Nelson | A23N 15/00 209/135 |
| 7,063,770 | B2 | 6/2006 | de Jong et al. | |
| 7,294,226 | B2 | 11/2007 | de Jong et al. | |
| 7,584,856 | B2 | 9/2009 | Miller et al. | |
| 7,810,646 | B2 | 10/2010 | Miller et al. | |
| 7,942,273 | B2 | 5/2011 | Campbell et al. | |
| 8,118,175 | B2 | 2/2012 | Davis et al. | |
| 8,246,788 | B2 | 8/2012 | Teal et al. | |
| 8,252,966 | B2 | 8/2012 | Teal et al. | |
| 8,618,432 | B2 | 12/2013 | Miller et al. | |
| 8,627,960 | B2 | 1/2014 | Valerio et al. | |
| 8,720,696 | B2 | 5/2014 | Washburn | |
| 8,801,929 | B2 | 8/2014 | Davis et al. | |
| 8,808,542 | B2 | 8/2014 | Davis et al. | |
| 2002/0129909 | A1 | 9/2002 | de Jong et al. | |
| 2002/0160097 | A1 | 10/2002 | Altemueller et al. | |
| 2003/0015303 | A1 | 1/2003 | Doelle et al. | |
| 2006/0124256 | A1 | 6/2006 | de Jong et al. | |
| 2007/0092633 | A1 | 4/2007 | Singh | |
| 2008/0035584 | A1 | 2/2008 | Petit et al. | |
| 2009/0020483 | A1 | 1/2009 | Davis et al. | |
| 2009/0020484 | A1 | 1/2009 | Davis et al. | |
| 2010/0012556 | A1 | 1/2010 | Pohle | |
| 2012/0298573 | A1 | 11/2012 | Davis et al. | |
| 2013/0175372 | A1 * | 7/2013 | Mosman | B02C 18/16 241/25 |
| 2014/0110310 | A1 | 4/2014 | Valerio et al. | |
| 2014/0315258 | A1 | 10/2014 | Nguyen | |
| 2014/0360950 | A1 | 12/2014 | Davis et al. | |
| 2015/0008194 | A1 | 1/2015 | Davis et al. | |

FOREIGN PATENT DOCUMENTS

| | | | |
|---|---|---|---|
| CN | 202750473 | U | 2/2013 |
| EP | 0817685 | A1 | 1/1998 |
| EP | 2424684 | A1 | 3/2012 |
| WO | WO9629157 | | 9/1996 |
| WO | WO2009079022 | | 6/2009 |
| WO | WO2010127036 | | 11/2010 |

OTHER PUBLICATIONS

CN202750473 published Feb. 27, 2013, abstract only in English (1 page).

CN2440309 published Aug. 1, 2001, abstract only in English (1 page).

* cited by examiner

TECHNOLOGIES FOR MATERIAL SEPARATION

TECHNICAL FIELD

Generally, the present disclosure relates to material separation.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure is concerned with. Further, nothing is disclaimed.

Sugarcane plants comprise stems, leaves extending from the stems, and top portions extending from the stems, usually above the leaves. The sugarcane plants are typically processed for sugar production in various stages, such as a harvesting stage and a milling stage. However, at least during such stages various inefficiencies exist.

During the harvesting stage, sugarcane harvesting machines harvest the sugarcane plants such that the stems are cut into billets, such as about six inches long, and the leaves and the top portions are separated from the stems, such as via cutting. Such type of processing is usually energy inefficient. Further, when the leaves and the top portions are separated from the stems, the leaves and the stems form an undesired biomass called field trash, which is naturally blown back into the fields from which the plants were originally harvested. Such blowback process also blows some of the billets back into the fields, which creates a sugar loss of as much as 8% per acre of sugarcane plant harvested. Although some of that blown back biomass is eventually extracted from the fields, such extraction process is usually inefficient, in some cases with about 20% of the field trash being left in the fields with the blown back billets. In addition, the field trash is frequently burned in the fields, which creates an environmental hazard or a safety hazard. Also, as the field trash becomes mixed with the billets in the fields, sugarcane trash is formed. Therefore, when the harvesting machines harvest the sugarcane plants, the harvesting machines end up picking up dirt, which is called ash, that gets mixed in with the sugarcane trash. Such processing is inefficient.

During the milling stage, the sugarcane plants are processed at a sugarcane mill such that sugar is extracted from the stems, i.e. the billets. However, the leaves and the top portions remain unprocessed due to their lack of any substantially extractable sugar, which is inefficient. Also, raw processing material delivered to the mill often contains about 80% sugarcane billets, about 18% sugarcane trash, and about 2% ash on a weight basis, when extracted under optimal weather conditions. However, when such material is extracted under suboptimal weather conditions, the ash can be about 10% of the raw material by weight, which is inefficient. Furthermore, the sugarcane trash and the ash can impede sugar production for various reasons. First, the sugarcane trash can reduce the mill's crushing capacity by about 20%, which can increase the mill's grinding season by about 20%. Second, the sugarcane trash can contain a substantial amount of starches, which, if not properly extracted, can degrade sugar output at the mill. Third, the ash, which is often substantially silica or field dirt, can create a lot of wear and tear to the mill's machinery. Resultantly, the ash needs to be filtered out during the sugar making process and such filtration process creates a loss of about 3% in the mill's sugar yield.

Accordingly, there is a need to address at least one of such inefficiencies.

BRIEF SUMMARY

The present disclosure at least partially addresses at least one of the above. However, the present disclosure can prove useful to other technical areas. Therefore, the claims should not be construed as necessarily limited to addressing any of the above.

According to an example embodiment of the present disclosure, a system for material separation is provided. The system comprises a rotary lifter which includes a rotary lifter frame and a rotary lifter drum coupled to the rotary lifter frame. The rotary lifter drum includes an inner compartment. The rotary lifter drum is configured to rotate in relation to the rotary lifter frame such that the inner compartment moves from an input position to an output position. The inner compartment is configured to receive a first material when the inner compartment is positioned in the input position. The inner compartment is configured to output the first material when the inner compartment is positioned in the output position. The system comprises a fluid output device configured to output a fluid in a first direction such that the first material is separated into at least a second material and a third material when moving away from the output position. The system comprises a conveyor configured to receive the second material upon separation from the first material via the fluid. The conveyor is configured to convey the second material in a second direction. The system comprises a suction duct configured to receive the third material upon separation from the first material via the fluid.

According to an example embodiment of the present disclosure, a method for material separation is provided. The method comprises outputting a first material from a first rotary lifter; directing a first fluid stream onto the first material as the first material moves away from the first rotary lifter such that the first material is separated into at least a second material and a third material; conveying the second material to a second rotary lifter; directing the third material to a first vacuum port via the first fluid stream; removing the third material via the first vacuum port; outputting the second material from the second rotary lifter; directing a second fluid stream onto the second material as the second material moves away from the second rotary lifter such that the second material is separated into a fourth material and a fifth material; directing the fifth material to a second vacuum port via the second fluid stream; removing the fifth material via the second vacuum port; and outputting the fourth material.

According to an example embodiment of the present disclosure, a system for material separation is provided. The system comprises a fluid flow source configured to source a flow of a fluid via a cyclonic separation process. The system comprises a material separation assembly configured to receive a first material. The material separation assembly is configured to receive the flow of the fluid from the fluid flow source such that the material separation assembly is able to separate the first material into at least a second material and a third material via the flow of the fluid when the first material is moved from a first position to a second position. The system comprises a suction source configured to provide a suction via a reverse cyclonic separation process. The suction source is configured to receive the third material from the material separation assembly via the suction. The fluid flow source is in fluid communication with the suction source via the material separation assembly.

According to an example embodiment of the present disclosure, a system for material separation is provided. The system comprises a dryer input assembly which includes a dryer input assembly frame, a closure, a conveyor, and an airlock body. The closure includes a first side and a second side. The airlock body includes an outlet. The closure is coupled to the dryer input assembly frame. The airlock body extends away from the second side. The system comprises a dryer drum which includes an input open end and an interior in fluid communication with the input open end. The closure is positioned at the input open end such that the closure substantially aligns with and substantially blocks the input open end, and the second side faces the interior of the dryer drum such that the airlock body extends inside the dryer drum. The dryer drum rotates with respect to the airlock body. The conveyor is configured to convey a first material from the first side toward the second side such that the first material is transferred past the closure to the airlock body. The outlet outputs the first material into the dryer drum.

The present disclosure may be embodied in the form illustrated in the accompanying drawings. However, attention is called to the fact that the drawings are illustrative. Variations are contemplated as being part of the disclosure, limited only by the scope of the claims.

BRIEF DESCRIPTION OF THE DRAWINGS

The accompanying drawings illustrate example embodiments of the present disclosure. Such drawings are not to be construed as necessarily limiting the disclosure. Like numbers and/or similar numbering scheme can refer to like and/or similar elements throughout.

DETAILED DESCRIPTION

Figure 1A:
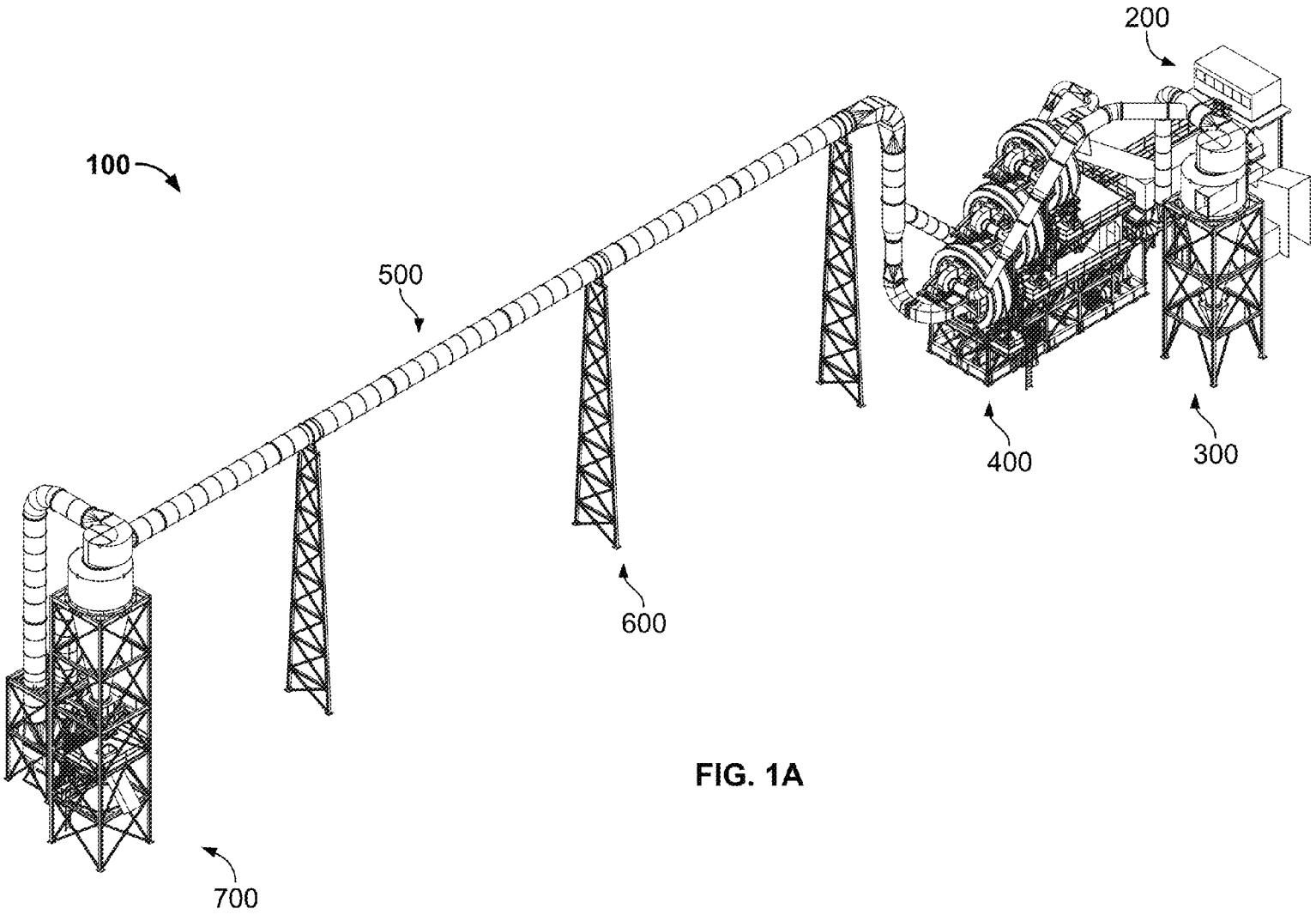
FIG. 1A shows a perspective view of an example embodiment of a detrashing system according to the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments disclosed herein. Rather, these example embodiments are provided so that the present disclosure is thorough and complete, and fully conveys the concepts of the present disclosure to those skilled in the relevant art.

Features described with respect to certain example embodiments may be combined and sub-combined in and/or with various other example embodiments. Also, different aspects and/or elements of example embodiments, as disclosed herein, may be combined and sub-combined in a similar manner as well. Further, some example embodiments, whether individually and/or collectively, may be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity in any manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from the teachings of the present disclosure.

The terminology used herein is for describing particular example embodiments and is not intended to be necessarily limiting of the present disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence and/or addition of one or more other features, integers, steps, operations, elements, components, and/or groups thereof.

As used herein, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (30) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" can be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

As used herein, the term "about" and/or "substantially" refers to a +/−10% variation from the nominal value/term. Such variation is always included in any given value/term provided herein, whether or not such variation is specifically referred thereto.

If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

Figure 1B:
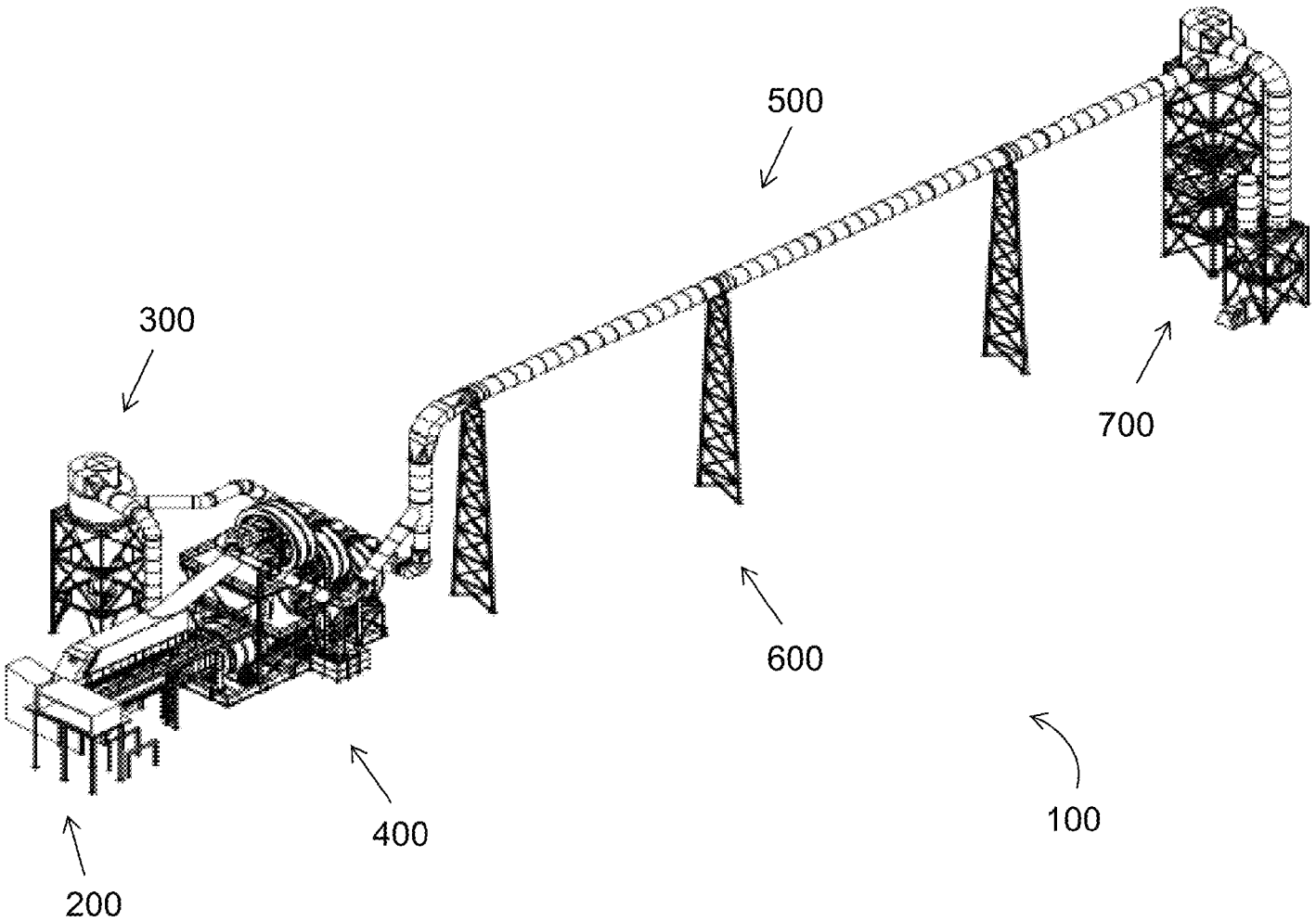
FIG. 1B shows a perspective view of an example embodiment of a detrashing system section according to the present disclosure.
Figure 2:
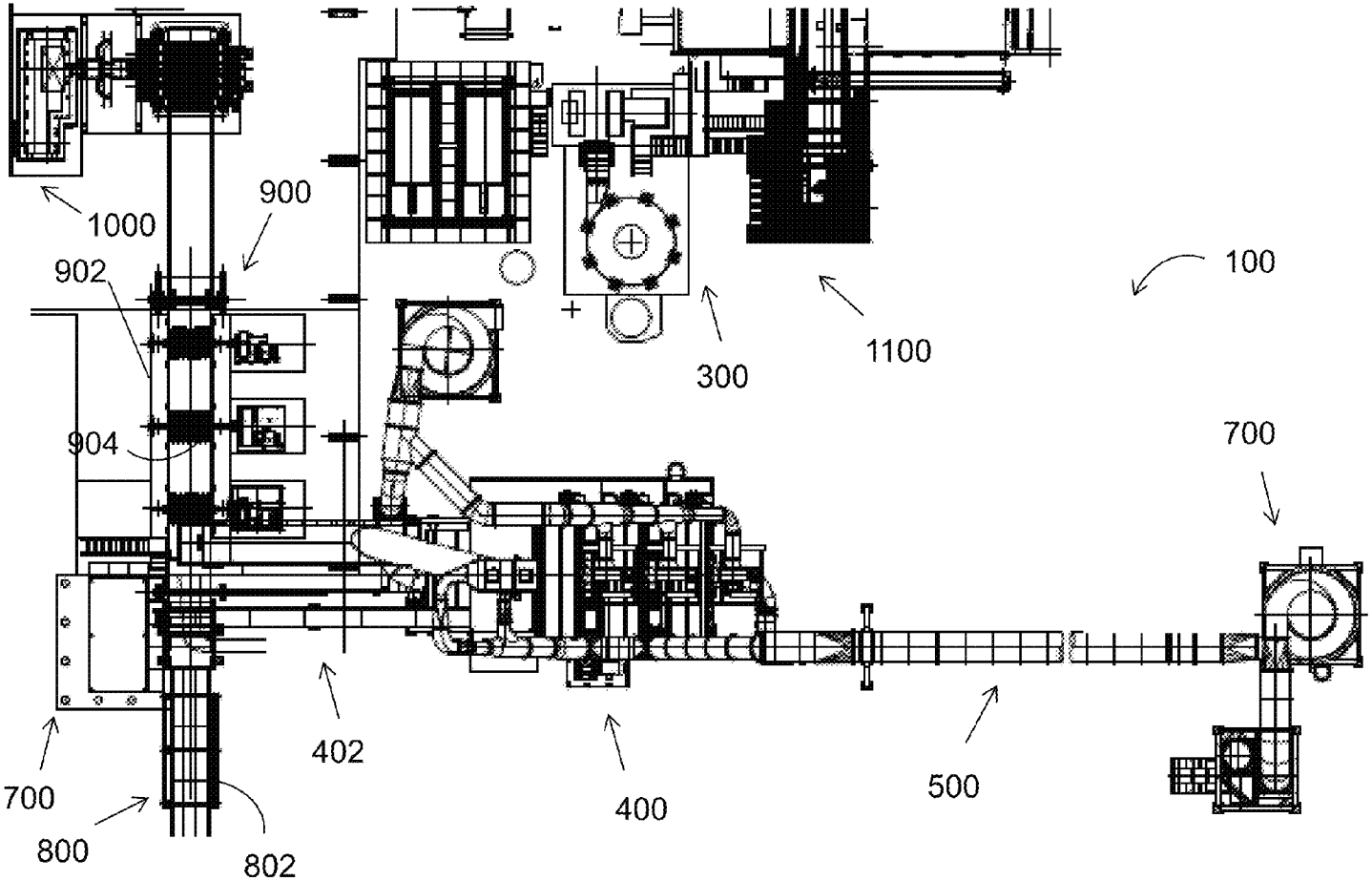
FIG. 2 shows a top view of an example embodiment of a detrashing system section according to the present disclosure.

FIG. 1A shows a perspective view of an example embodiment of a detrashing system according to the present disclosure. FIG. 1B shows a perspective view of an example embodiment of a detrashing system section according to the present disclosure. FIG. 2 shows a top view of an example embodiment of a detrashing system section according to the present disclosure.

A system 100, which is useful for detrashing, comprises a control area 200, an air source assembly 300, a material separation assembly 400, a ductwork assembly 500, a tower assembly 600, and a material processing assembly 700. The system 100 or at least one of the control area 200, the air source assembly 300, the separation assembly 400, the ductwork assembly 500, the tower assembly 600, and the material processing assembly 700 is positioned at least partially outdoors, such as on a ground surface, whether having a flat terrain or a rugged terrain, whether urban or countryside, such as in a field. However, in other embodiments, the system 100 or at least one of the control area 200, the air source assembly 300, the separation assembly 400, the ductwork assembly 500, the tower assembly 600, and the material processing assembly 700 is positioned at least partially indoors, such as in a warehouse or a tent, including underneath a dome. Further, in yet other embodiments, the system 100 or at least one of the control area 200, the air source assembly 300, the separation assembly 400, the ductwork assembly 500, the tower assembly 600, and the material processing assembly 700 is positioned at least partially underground, such as in a bunker, a basement, or a garage.

The system 100 or at least two of the control area 200, the air source assembly 300, the separation assembly 400, the ductwork assembly 500, the tower assembly 600, and the material processing assembly 700 are positioned in one locale. However, in other embodiments, none of the control area 200, the air source assembly 300, the separation assembly 400, the ductwork assembly 500, the tower assembly 600, and the material processing assembly 700 are positioned in one locale.

The system 100 or at least one of the control area 200, the air source assembly 300, the separation assembly 400, the ductwork assembly 500, the tower assembly 600, and the material processing assembly 700 is stationary, such as installed onto a ground surface, whether having a flat terrain or a rugged terrain, whether urban or countryside, such as in a field. However, in other embodiments, the system 100 or at least one of the control area 200, the air source assembly 300, the separation assembly 400, the ductwork assembly 500, the tower assembly 600, and the material processing assembly 700 is mobile, such as based on a vehicle, whether land, aerial, or marine.

The control area 200, the air source assembly 300, and the separation assembly 400 are in relative proximal positioning to each other, i.e., positioned in a cluster, with respect to the separation assembly 400 being in relative distal positioning to the material processing assembly 700, as spanned by the ductwork assembly 500 supported via the tower assembly 600. However, in other embodiments, such positioning can vary in any manner, such as the material processing assembly 700 being proximally positioned within a cluster comprising the control area 200, the air source assembly 300, and the separation assembly 400. In such configuration, the ductwork assembly 500 can be shaped accordingly, such as in a U-shape.

The system 100 or at least two of the control area 200, the air source assembly 300, the separation assembly 400, the ductwork assembly 500, the tower assembly 600, and the material processing assembly 700 are positioned along one plane, such as a horizontal plane. However, in other embodiments, none of the control area 200, the air source assembly 300, the separation assembly 400, the ductwork assembly 500, the tower assembly 600, and material processing assembly 700 are positioned along one plane, such as the control area 200, the air source assembly 300, the separation assembly 400, the ductwork assembly 500, the tower assembly 600, and the material processing assembly 700 being positioned on different horizontal planes, such as one being elevated higher than another or inclined.

The separation assembly 400 comprises an input conveyor section 402. The system 100 is operably coupled to an input material section 800, which comprises a motorized conveyor 802 conveying material, such as sugarcane trash, in a direction perpendicular to the input conveyor section 402, although other conveyance directions are possible, such as diagonal. The conveyor 802 can transfer such material onto the input conveyor section 402. For example, the conveyor 802 can be selectively adjustable to convey such material onto the input conveyor section 402. Whether additionally or alternatively, the input conveyor section 402 can also be selectively adjustable to receive such material from the conveyor 802. Such types of selective adjustment can be based at least in part on a manual input, such as via a lever, a button, a keyboard, or some other input device. Whether additionally or alternatively, the selective adjustment can also be based at least in part on an automatic input, such as via a computer program based at least in part on a sensor input, such as via heuristics. For example, such sensor input can be based at least in part on a detection of foreign matter in the material being conveyed on the conveyor 802. Some characteristics of such adjustment comprise at least one of a positional adjustment, a directional adjustment, and a speed adjustment.

The input material section 800 is positioned at least partially outdoors, such as on a ground surface, whether having a flat terrain or a rugged terrain, whether urban or countryside, such as in a field. However, in other embodiments, the input material section 800 is positioned at least partially indoors, such as in a warehouse or a tent, including underneath a dome. Further, in yet other embodiments, the input material section 800 is positioned at least partially underground, such as in a bunker, a basement, or a garage. The input material section

800 is one locale with the system 100 or at least one of the control area 200, the air source assembly 300, the separation assembly 400, the ductwork assembly 500, the tower assembly 600, and the material processing assembly 700. The input material section 800 is stationary, such as installed onto a ground surface, whether having a flat terrain or a rugged terrain, whether urban or countryside, such as a field. However, in other embodiments, the input material section 800 is mobile, such as based on a vehicle, whether land, aerial, or marine.

The system 100 is operably coupled to an output material section 900, which comprises a conveyor 902 conveying material, such as sugarcane billets, as separated via the separation assembly 400. The conveyor 902 comprises a plurality of motorized rotary shredders 904 serially positioned along the conveyor 902, above the conveyor 902. For example, at least one of the motorized rotary shredders 904 can comprise a knife mounted on a shaft extending along a horizontal plane perpendicular to a conveying direction of the conveyor 902, where the knife rotates about the shaft to shred the material as the material passes. In other embodiments, the motorized rotary shredders 904 are positioned in parallel along the conveyor 902. The knife comprises a blade, whether with a uniform edge, such as rectilinear edge, an arcuate edge, or a circular edge, or a varying edge, such as a serrated edge. In other embodiments, at least one of the motorized rotary shredders 904 comprises an auger with a helical blade, whether rotating about an axis perpendicular to the conveyor 902, an axis diagonal to the conveyor 902, or an axis parallel to the conveyor 902. The output material section 900 can comprise a washing station for washing the material, whether before, during, or after the shredding.

The output material section 900 is positioned at least partially outdoors, such as on a ground surface, whether having a flat terrain or a rugged terrain, whether urban or countryside, such as in a field. However, in other embodiments, the output material section 900 is positioned at least partially indoors, such as in a warehouse or a tent, including underneath a dome. Further, in yet other embodiments, the output material section 900 is positioned at least partially underground, such as in a bunker, a basement, or a garage. The output material section 900 is one locale with the system 100 or at least one of the control area 200, the air source assembly 300, the separation assembly 400, the ductwork assembly 500, the tower assembly 600, the material processing assembly 700, and the input material section 800. The output material section 900 is stationary, such as installed onto a ground surface, whether having a flat terrain or a rugged terrain, whether urban or countryside, such as in a field. However, in other embodiments, the output material section 900 is mobile, such as based on a vehicle, whether land, aerial, or marine.

The output material section 900 conveys shredded material to a shredded material processing section 1000, which comprises a water mixing station and a crushing station downstream from the water mixing station. The shredded material is repeatedly mixed with the water via the water mixing station, such as via a set of sprinklers sprinkling the shredded material with water in a periodic manner or a continuous manner. The crushing station comprises a set of rollers configured to crush the washed shredded material. For example, at least one of the rollers can comprise a circular disc mounted on a shaft extending along a horizontal plane perpendicular to a conveying direction of the shredded material, where the disc rotates about the shaft to crush the shredded material as the material passes underneath, such as via rolling over the material. The rollers can be serially positioned or positioned in parallel. Such crushing results in a juice, such as sucrose juice when the material comprises sugarcane billets. The juice is collected for further processing, dependent on the material.

The shredded material processing section 1000 is positioned at least partially outdoors, such as on a ground surface, whether having a flat terrain or a rugged terrain, whether urban or countryside, such as in a field. However, in other embodiments, the shredded material processing section 1000 is positioned at least partially indoors, such as in a warehouse or a tent, including underneath a dome. Further, in yet other embodiments, the shredded material processing section 1000 is positioned at least partially underground, such as in a bunker, a basement, or a garage. The shredded material processing section 1000 is one locale with the system 100 or at least one of the control area 200, the air source assembly 300, the separation assembly 400, the ductwork assembly 500, the tower assembly 600, the material processing assembly 700, the input material section 800, and the output material section 900. The shredded material processing section 1000 is stationary, such as installed onto a ground surface, whether having a flat terrain or a rugged terrain, whether urban or countryside, such as a field. However, in other embodiments, the shredded material processing section 1000 is mobile, such as based on a vehicle, whether land, aerial, or marine.

A mill 1100 is positioned in one locale with the system 100 or at least one of the control area 200, the air source assembly 300, the separation assembly 400, the ductwork assembly 500, the tower assembly 600, the material processing assembly 700, the input material section 800, the output material section 900, and the material processing section 1000. However, in other embodiments, such positioning can vary in any combinatory manner, such as the system 100 and the mill 1100 being positioned in different locales. Note that the system 100 and the mill 1100 can be operably coupled to each other, whether directly or indirectly. Also, note that at leas one of the input material section 800, the output material section 900, and the material processing section 1000 can be operably coupled to the mill 1100. The mill 1100 is positioned at least partially outdoors, such as on a ground surface, whether having a flat terrain or a rugged terrain, whether urban or countryside, such as in a field. However, in other embodiments, the mill 1100 is positioned at least partially indoors, such as in a warehouse or a tent, including underneath a dome. Further, in yet other embodiments, the mill 1100 is positioned at least partially underground, such as in a bunker, a basement, or a garage.

The system 100 or at least one of the control area 200, the air source assembly 300, the separation assembly 400, the ductwork assembly 500, the tower assembly 600, the material processing assembly 700, the input material section 800, the output material section 900, the material processing section 1000, and the mill 1100 can be powered via a turbine, which is driven via steam obtained via burning bagasse as fuel in a steam boiler. The turbine can be local to or remote from the system 100 or at least one of the control area 200, the air source assembly 300, the separation assembly 400, the ductwork assembly 500, the tower assembly 600, the material processing assembly 700, the input material section 800, the output material section 900, the material processing section 1000, and the mill 1100. The steam boiler can be local to or remote from the system 100 or at least one of the control area 200, the air source assembly 300, the separation assembly 400, the ductwork assembly 500, the tower assembly 600, the material processing assembly 700, the input material section 800, the output material section 900, the material processing section 1000, and the mill 1100. Whether alternatively or additionally, in part or in whole, the turbine can also be powered via a renewable energy source, such as an array of photovoltaic cells, a water turbine, a geothermal turbine, or a wind turbine. The renewable energy source can be local to or remote from the system 100 or at least one of the control area 200, the air source assembly 300, the separation assembly 400, the ductwork assembly 500, the tower assembly 600, the material processing assembly 700, the input material section 800, the output material section 900, the material processing section 1000, and the mill 1100. In yet other embodiments, the system 100 or at least one of the control area 200, the air source assembly 300, the separation assembly 400, the ductwork assembly 500, the tower assembly 600, the material processing assembly 700, the input material section 800, the output material section 900, the material processing section 1000, and the mill 1100 is powered via a nuclear reactor or a fossil fuel plant, such as a coal plant or a petrochemical compound plant, whether positioned local to or remote from the system 100 or at least one of the control area 200, the air source assembly 300, the separation assembly 400, the ductwork assembly 500, the tower assembly 600, the material processing assembly 700, the input material section 800, the output material section 900, the material processing section 1000, and the mill 1100.

The system 100 or at least one of the control area 200, the air source assembly 300, the separation assembly 400, the ductwork assembly 500, the tower assembly 600, the material processing assembly 700, the input material section 800, the output material section 900, the material processing section 1000, and the mill 1100 can be configured for resisting/withstanding force due to wind, rain, snow, or ice, such as when positioned at least partially outdoors. For example, for structural or operational stability during wind conditions, at least one of the control area 200, the air source assembly 300, the separation assembly 400, the ductwork assembly 500, the tower assembly 600, the material processing assembly 700, the input material section 800, the output material section 900, the material processing section 1000, and the mill 1100 can be aerodynamically configured to minimize wind impact thereon. Similarly, for structural or operational stability during rain, snow, or ice conditions, at least one of the control area 200, the air source assembly 300, the separation assembly 400, the ductwork assembly 500, the tower assembly 600, the material processing assembly 700, the input material section 800, the output material section 900, the material processing section 1000, and the mill 1100 can be configured with rainwater drainage channels/gutters or heated elements to reduce or avoid snow accumulation or ice formation. Likewise, at least one of the control area 200, the air source assembly 300, the separation assembly 400, the ductwork assembly 500, the tower assembly 600, the material processing assembly 700, the input material section 800, the output material section 900, the material processing section 1000, and the mill 1100 can be configured to operate in hot/dry climates, such as southern or southwestern United States. For example, at least one of the control area 200, the air source assembly 300, the separation assembly 400, the ductwork assembly 500, the tower assembly 600, the material processing assembly 700, the input material section 800, the output material section 900, the material processing section 1000, and the mill 1100 can comprise reflective material, such as aluminum.

The system 100 is described in a context of sugarcane plant processing. However, note that the system 100 can be used, configured for, or reconfigured for use with any type of non-agricultural blend/mixture or agricultural blend/mixture processing. For example, the system 100 can be used with, configured for, or reconfigured for any type of material separation based on weight, such as any type of stem and leaves mixture, de-leafing, pulp fibers, recycling, or other separation processes, as understood to one of ordinary skill in the art.

Figure 3:
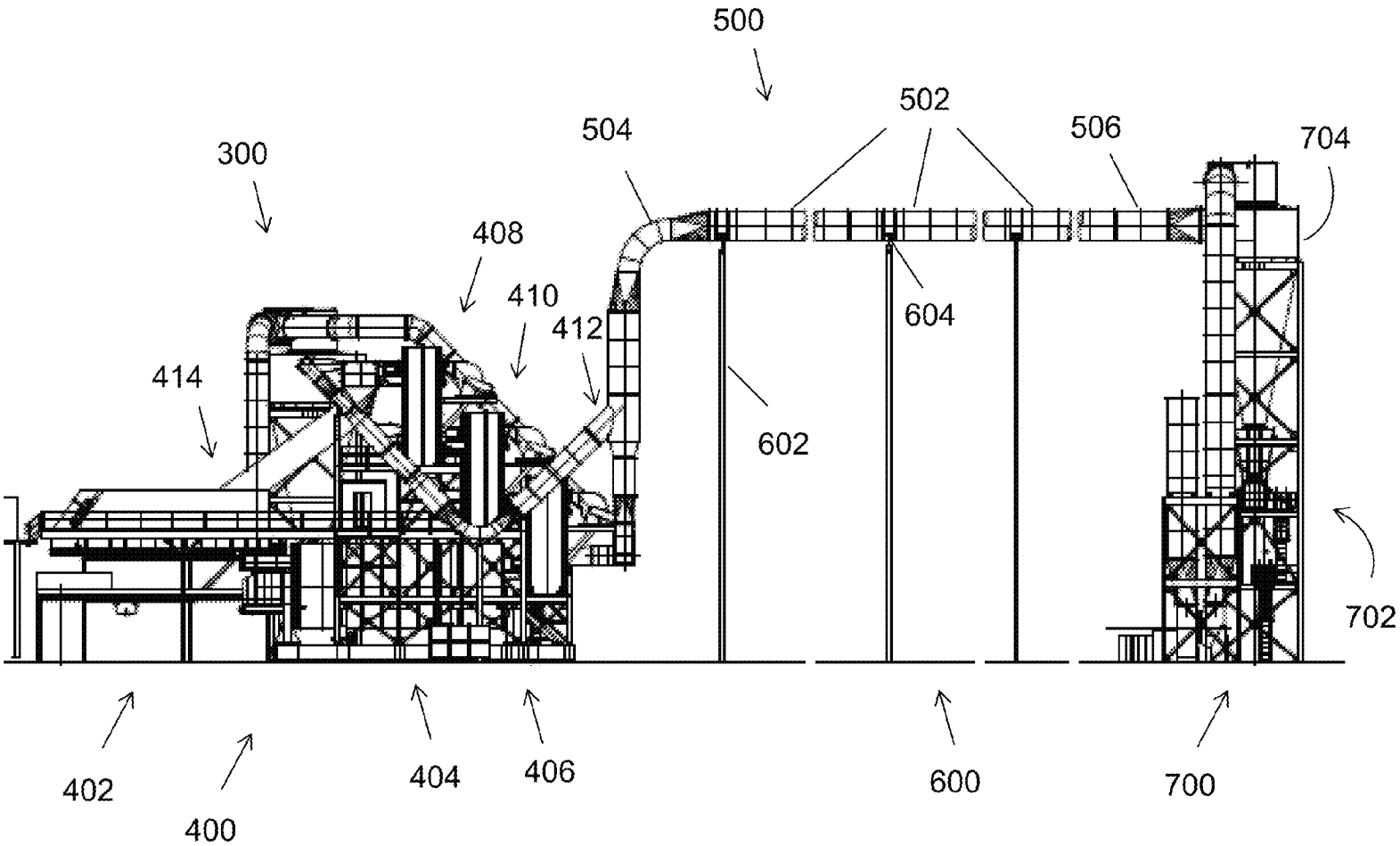
FIG. 3 shows a longitudinal profile view of an example embodiment of a detrashing system section according to the present disclosure.

FIG. 3 shows a longitudinal profile view of an example embodiment of a detrashing system section according to the present disclosure. Some elements of this figure are described above. Thus, same reference characters identify identical and/or like components described above and any repetitive detailed description thereof will hereinafter be omitted or simplified in order to avoid complication.

The separation assembly 400 comprises the input conveyor section 402, a base frame section 404, a dryer section 406, an air supply section 408, a separation section 410, a material output section 412, and a return conveyor section 414. The input conveyor section 402 inputs material for processing to the dryer section 406, which is secured to the base frame section 404 resting on a ground surface. The dryer section 406 processes the material received from the input conveyor section 402 and provides the material to the separation section 410. The air supply section 408 provides forced air, such as pressurized air, to the separation section 410 such that the separation section 410 separates the material received from the drier section 406 into a plurality of constituents, such as a first constituent and a second constituent. The separation section 410 provides some of the constituents to the return conveyor section 414 and provides some of the constituents to the material output section 412. Note that the air supply section 408 or the material output section 412 can comprise one or more ducts in fluid communication with each other, whether directly or indirectly, such as via an interconnect duct.

The material processing assembly 700 comprises a base frame section 702 and material processing section 704 supported via the base frame section 702. The base frame section 702 is resting on a ground surface at a distance from the separation assembly. Such distance is spanned by the ductwork assembly 500, as supported by the tower assembly 600. The material processing section 704 provides suction to suction the material from the material output section 412. The material processing section 704 receives the material from the material output section 412 based on such suction and processes the material.

The ductwork assembly 500 comprises a ductwork defined via a plurality of ducts 502, an elbow duct 504, and an end duct 506, where the ducts 502 are positioned between the duct 504 and the duct 506. The ducts 502, 504, 506 are in fluid communication with each other. Any number of ducts 502, 504, 506 can be used, such as at least one. The ducts 502, 504, 506 can be flexible or rigid. The ducts 502, 504, 506 can extend longitudinally in any length, such as twenty feet, or can have any longitudinal shape, such as rectilinear, arcuate, sinusoidal, or any other shapes. The ducts 502, 504, 506 can have any cross-sectional shape, such as circular, oval, triangular or any other polygonal shape, such as a square, a rectangle, a pentagon, a hexagon, an octagon, and so forth. At least one of the ducts 502, 504, 506 can be thermally insulated, such as via a thermally insulating jacket mounted thereon, for instance a polyurethane jacket. Note that the ducts 502, 504, 506 can be identical to or different from each other in at least one of a structure, a function, a shape, a material, a fluid conductivity level, or any other measurable duct characteristic.

The ducts 502, 504, 506 couple to each other directly, such as via fastening, mating, interlocking, adhering, clamping, nesting, telescoping, or other coupling methods. However, in other embodiments, the ductwork assembly 500 comprises a plurality of duct interconnects are used to couple the ducts 502, 504, 506 to each other. For example, a duct interconnect is positioned between the duct 504 and the duct 502 such that the duct 504 and the duct 502 are in fluid communication with each other. The duct interconnects can couple to the ducts 502, 504, 506 via fastening, mating, interlocking, adhering, clamping, nesting, telescoping or other coupling methods. The duct interconnects can extend longitudinally in any length, such as twenty feet, or can have any longitudinal shape, such as rectilinear, arcuate, sinusoidal, or any other shapes. The duct interconnects can have any cross-sectional shape, such as circular, oval, triangular or any other polygonal shape, such as a square, a rectangle, a pentagon, a hexagon, an octagon, and so forth. At least one of the duct interconnects can be thermally insulated, such as via a thermally insulating jacket mounted thereon, for instance a polyurethane jacket.

The tower assembly 600 comprises a plurality of towers 602 positioned along the ductwork assembly 500. The towers 602 rest on a ground surface. Each of the towers 602 comprises a duct securing element 604 distal to the ground surface. For example, the element 604 is at least one of a ring, a belt, a hook, and a strap. At least one of the elements 604 can be fixedly coupled to the tower 604 or be pivotally coupled to the tower 602, such as via a hinge. Note that at least one of the elements 604 can be unitary to or assembled with the tower 602, such as via fastening, mating, interlocking, adhering, clamping, nesting, telescoping or other coupling methods. In some embodiments, at least one of the towers 602 comprises at least two elements 604. In some embodiments, at least one of the elements 604 is selectively adjustable, whether manually or automatically, to accommodate ducts of various configurations, such as ducts having different cross-sections. Whether additionally or alternatively, at least one of the elements 604 can be magnetic or comprise an adhesive or a hook-and-loop fastener. Whether additionally or alternatively, at least one of the towers 602 can secure at least a portion of the ductwork assembly 500 via magnetism, such as via a portion of such tower 602 being magnetic or vice versa, or via an adhesive, such as via a portion of such tower 602 being coated with the adhesive or vice versa, or via a hook-and-loop fastener.

The towers 602 span between the ductwork assembly 500 and the ground surface such that the towers 602 support the ductwork assembly 500 above the ground surface. Any number of towers 602 can be used, such as at least one, but none are possible as well. The towers 602 taper from the ground surface toward the ductwork assembly 500. However, in other embodiments, at least one of the towers 602 is non-tapered. Each of the towers 602 comprises a lattice for stability, which can be defined via interconnecting bars or tubular elements. In other embodiments, at least one of the towers 602 is non-lattice based. The towers 602 can be shaped in any manner, such as a cone, a pyramid, a hyperboloid, a T-shape, a Y-shape, or an H-shape, whether in original shape or inverted. In other embodiments, at least one of the towers 602 can be height adjustable, whether manually or automatically, such as via telescoping along a vertical plane. Note that the towers 602 can be identical to or different from each other in at least one of a structure, a function, a shape, a material, a fluid conductivity level, or any other measurable duct characteristic. Note that the elements 604 can be identical to or different from each other in at least one of a structure, a function, a shape, a material, a fluid conductivity level, or any other measurable duct characteristic.

Figure 5:
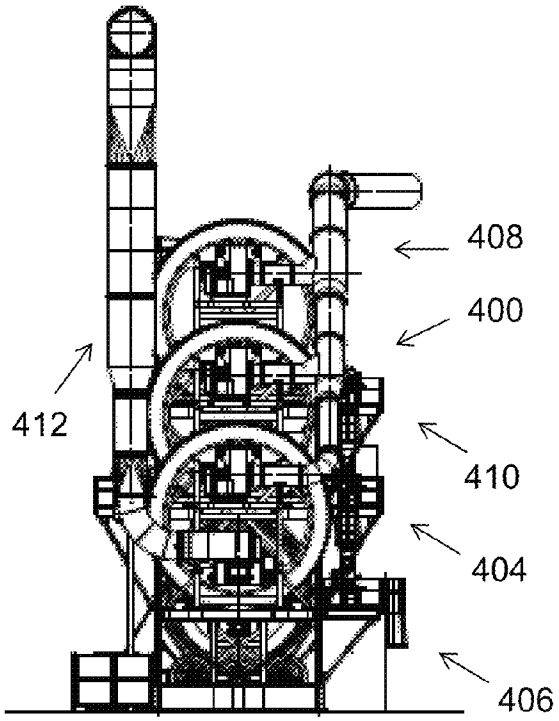
FIG. 5 shows a lateral profile view of an example embodiment of a detrashing system according to the present disclosure.
Figure 4:
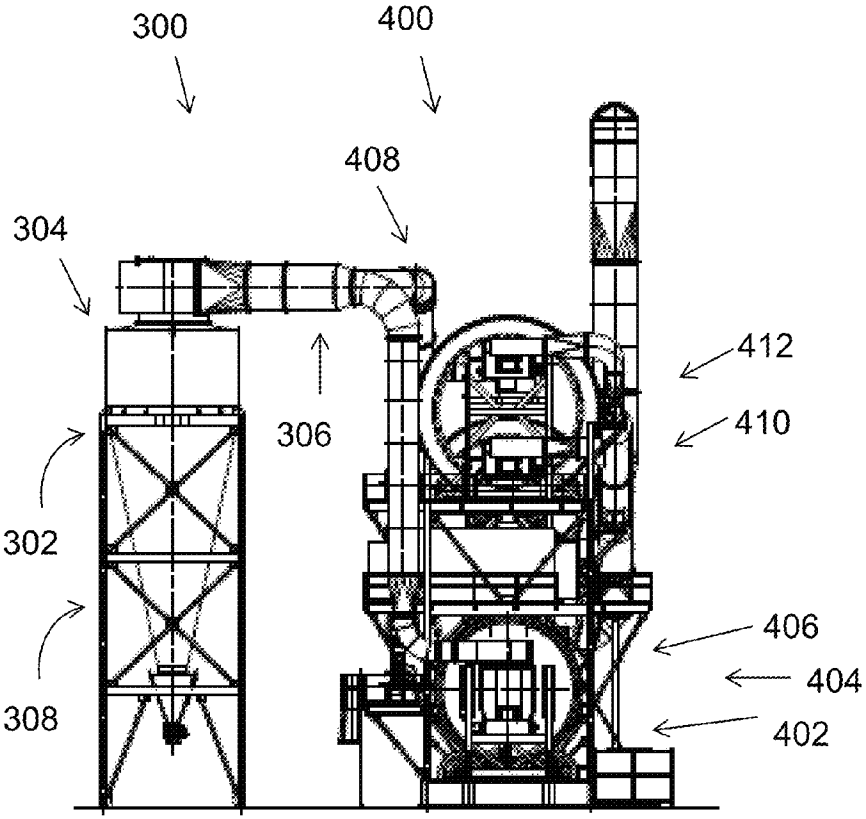
FIG. 4 shows a lateral profile view of an example embodiment of a detrashing system section according to the present disclosure.
Figure 6:
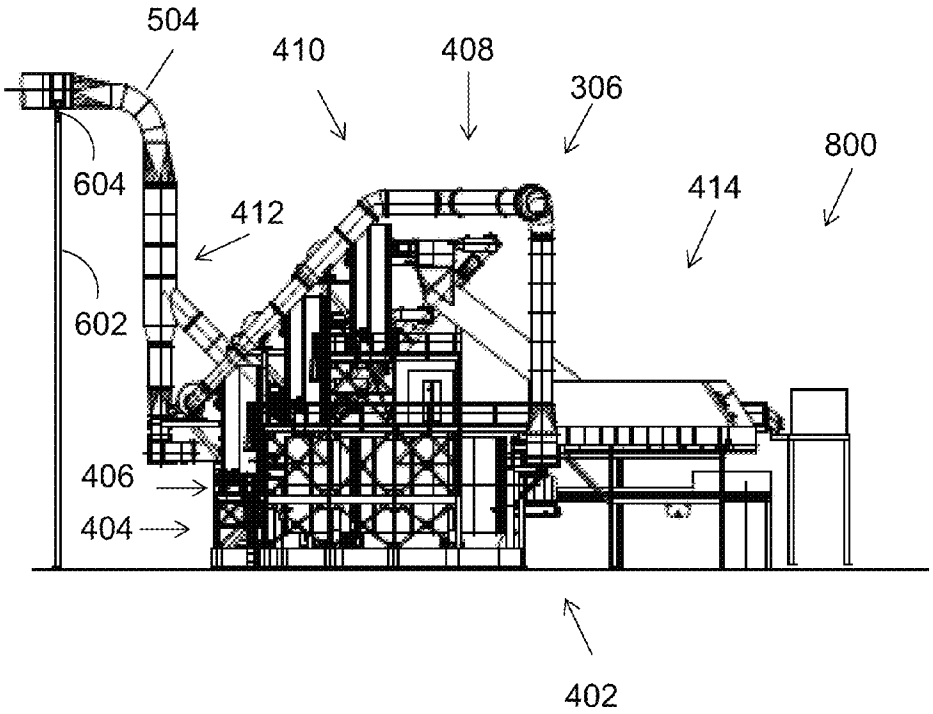
FIG. 6 shows a longitudinal profile view of an example embodiment of a separation assembly according to the present disclosure.

FIG. 4 shows a lateral profile view of an example embodiment of a detrashing system section according to the present disclosure. FIG. 5 shows a lateral profile view of an example embodiment of a detrashing system according to the present disclosure. FIG. 6 shows a longitudinal profile view of an example embodiment of a separation assembly according to the present disclosure. Some elements of these figures are described above. Thus, same reference characters identify identical and/or like components described above and any repetitive detailed description thereof will hereinafter be omitted or simplified in order to avoid complication.

The air source assembly 300 comprises a tower frame 302 and a cyclone separator 304 coupled thereto, such as via fastening, mating, interlocking, adhering, clamping, nesting, adhering, magnetizing, or other coupling methods. The frame 302 comprises a lattice, but can be configured without the lattice as well. The frame 302 is shaped in a tubular rectangular manner, but in other embodiments, the frame 302 can be shaped in other manners, such as a cone, a pyramid, a hyperboloid, a T-shape, a Y-shape, or an H-shape, whether in original shape or inverted.

The frame 302 hosts the separator 304, which is configured to perform cyclonic separation via removing a plurality of particulates from at least one of air and gas through vortex separation, such as via rotational effects or gravity. The cyclonic separation can be with a filter or without a filter. The separator 304 receives dirty forced air from a boiler, which can be stationed on a sugarcane mill. For example, such dirt comprises ash. The dirty forced air can be between about 34 degrees and about 212 degrees on a Fahrenheit scale. For example, the dirty forced air can be waste heat from the sugar mill. Note that in some embodiments, the forced air is not dirty or is not within such temperature range. For example, such air can be provided via an air compressor or from a compressed air source.

The separator 304 comprises an inlet duct, a cyclone cylindrical body in fluid communication with the inlet duct, and a conical section 308 in fluid communication with the cyclone body at a first end of the cyclone body. Note that such configuration can be unitary or an assembly, such as via fastening, mating, interlocking, adhering, clamping, nesting, adhering, magnetizing, or other coupling methods. The inlet duct extends along a horizontal plane in an arcuate manner. The cylindrical body comprises a sidewall through which the inlet duct is in fluid communication with the cylindrical body, above the conical section 308. The separator 304 comprises a rectilinear tubular outlet duct in fluid communication with the cyclone body at a second end of the cylindrical body opposing the first end. The conical section 308 comprises an open end opposite from the second end along a vertical axis on which the first end and the second end are positioned. Note that the separator 304 can comprise one or more ducts in fluid communication with each other, whether directly or indirectly, such as via an interconnect duct.

The assembly 300 further comprises a forced air exit duct 306 in fluid communication with the separator 304 via the rectilinear outlet duct. The duct 306 is also in fluid communication with the air supply section 408. The duct 306 can be flexible or rigid. The duct 306 can extend longitudinally in any length, such as twenty feet, or can have any longitudinal shape, such as rectilinear, arcuate, sinusoidal, or any other shapes. The duct 306 can have any cross-sectional shape, such as circular, oval, triangular or any other polygonal shape, such as a square, a rectangle, a pentagon, a hexagon, an octagon, and so forth. The duct 306 can be thermally insulated, such as via a thermally insulating jacket mounted thereon, for instance a polyurethane jacket.

As the dirty hot air is input via the inlet duct into the cylindrical body, such as in a laterally originating path, the dirty hot air begins to flow within the cylindrical body in a downward helical pattern from a top portion of the cylindrical body, i.e. from the outlet duct, toward the open end of the conical section 308 before exiting the cylindrical body in a straight upward stream path through a center of the helical pattern via the rectilinear outlet duct along the vertical axis along which the first end and the second end are positioned. However, when the dirty hot air enters the conical section 308, the dirt in the hot forced air has excessive inertia to follow a tight curve flow of the hot air upward toward the rectilinear outlet duct, such as due to size or density. Resultantly, the dirt strikes an inner surface of the conical section 308. Since a rotational path is reduced in the conical section 308, due to a tapering volume of the conical section 308, such striking action causes the dirt to separate into a set of small particles, which are output through the open end of the conical section 308 based at least in part on natural gravity. Accordingly, the dirt exits the conical section 308 and can fall onto a conveyor, a cart or a vehicle, which can be prepositioned in advance, or onto a ground surface, such as to form a pile of dirt on the ground surface. The air, which is effectively substantially free from the dirt, exits the separator 304 via the rectilinear outlet duct and enters the forced air exit duct 306, which conducts such air to the air supply section 408 for use by the dryer section 406 and the separation section 410.

Figure 7:
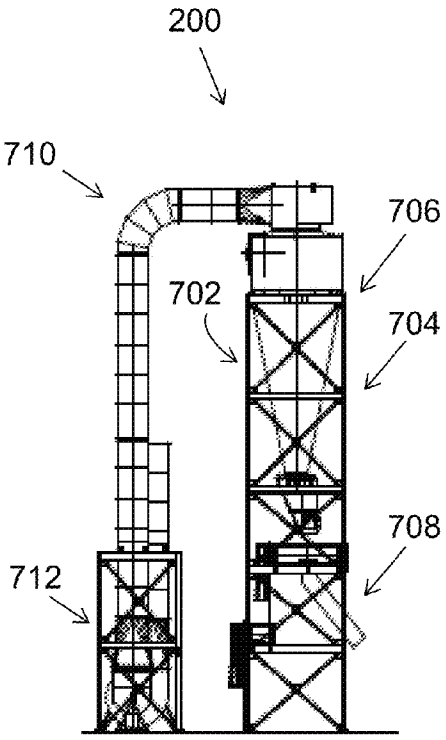
FIG. 7 shows a lateral profile view of an example embodiment of a material processing assembly according to the present disclosure.
Figure 8:
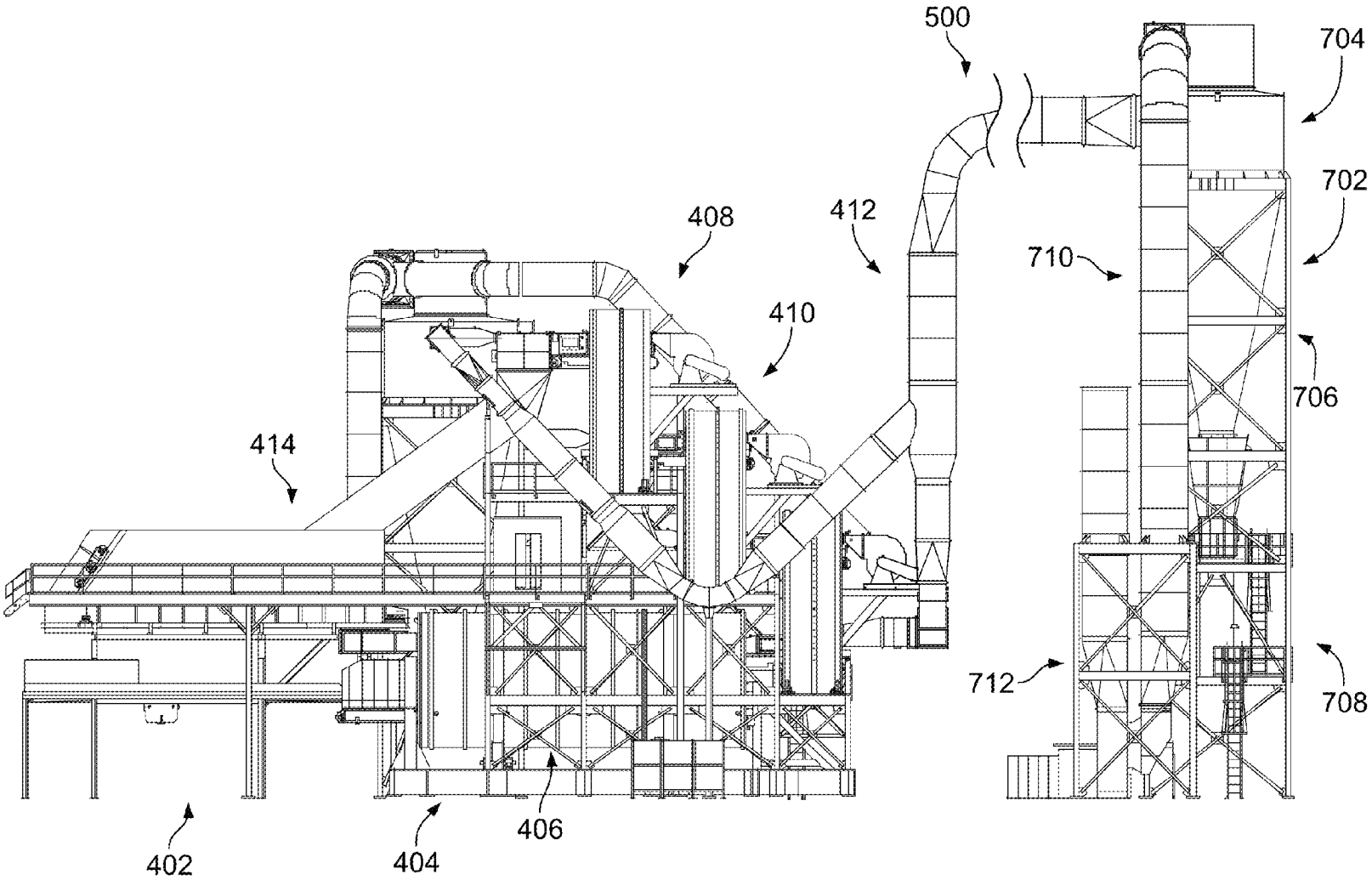
FIG. 8 shows a longitudinal profile view of an example embodiment of a separation assembly and a material processing assembly operably coupled to each other according to the present disclosure.

FIG. 7 shows a lateral profile view of an example embodiment of a material processing assembly according to the present disclosure. FIG. 8 shows a longitudinal profile view of an example embodiment of a separation assembly and a material processing assembly operably coupled to each other according to the present disclosure. Some elements of these figures are described above. Thus, same reference characters identify identical and/or like components described above and any repetitive detailed description thereof will hereinafter be omitted or simplified in order to avoid complication.

The material processing assembly 700 comprises a tower frame 702 resting on a ground surface, a cyclone separator 704 hosted via the frame 702, and a chute 708 hosted via the frame 702. Such types of hosting can be via fastening, mating, interlocking, adhering, clamping, nesting, adhering, magnetizing, or other coupling methods.

The frame 702 comprises a lattice, but can be configured without the lattice as well. The frame 702 is shaped in a tubular rectangular manner, but in other embodiments, the frame 702 can be shaped in other manners, such as a cone, a pyramid, a hyperboloid, a T-shape, a Y-shape, or an H-shape, whether in original shape or inverted.

The separator 704 is configured to perform cyclonic separation via removing a plurality of particulates from at least one of air and gas through vortex separation, such as via rotational effects or gravity. The cyclonic separation can be with a filter or without a filter. The separator 704 receives dirty air from the ductwork assembly 500, which conducts the material from the separation assembly 400. For example, such dirt comprises the leaves or the top portions separated from the sugarcane stems, i.e. billets, via the separation assembly 400. The dirty air can be between about 34 degrees and about 212 degrees on a Fahrenheit scale. Note that in some embodiments, the air is not dirty or is not within such temperature range. Note that the separator 704 operates in reverse of separator 304, such as the separator 704 operates in a reverse cyclonic separation process and the separator 304 operates in a cyclonic separation process.

The separator 704 comprises an inlet duct, a cyclone cylindrical body in fluid communication with the inlet duct, and a conical section 706 in fluid communication with the cyclone body at a first end of the cyclone body. Note that such configuration can be unitary or an assembly, such as via fastening, mating, interlocking, adhering, clamping, nesting, adhering, magnetizing, or other coupling methods. The inlet duct is in fluid communication with the ductwork assembly 500, such as via the duct 506, whether directly or via indirectly, such as via an interconnect duct. The cylindrical body comprises a sidewall through which the inlet duct is in fluid communication with the cylindrical body, above the conical section 706. The separator 704 further comprises a rectilinear tubular outlet duct in fluid communication with the cyclone body at a second end of the cylindrical body opposing the first end. The conical section 706 comprises an open end opposite from the second end along a vertical axis on which the first end and the second end are positioned. The rectilinear tubular outlet duct is in fluid communication with the ductwork 710.

The chute 708 comprises a U-shape cross-section, while extending longitudinally along a diagonal plane. However, note that the chute 708 can also comprise an O-shape cross-section, such as a tubular duct, which can be polygonal. The chute 708 is configured to receive material from the open end of the conical section 706. The chute 708 is positionally fixed. However, in other embodiments, the chute 708 is positionally adjustable, whether along a horizontal plane or a vertical plane. In yet other embodiments, the chute 708 is longitudinally extendible, whether manually or automatically, such as via telescoping.

The material processing assembly 700 further comprises a suction source 712 resting on the ground surface and a ductwork 710 in fluid communication with the suction source 712 and the cyclone separator 704. The suction source 712 provides negative air or gas pressure to suction the material from the ductwork assembly 500, as received from the separation assembly 400. For example, the suction source 712 is a motorized suction pump configured to create a pressure difference to provide continuous suctioning action. In other embodiments, the frame 702 hosts the suction source 712, such as via fastening, mating, interlocking, adhering, clamping, nesting, adhering, magnetizing, or other methods.

As the dirty air is input via the inlet duct into the cylindrical body, such as in a laterally originating path from the duct 506, the dirty air begins to flow within the cylindrical body in a downward helical pattern from a top portion of the cylindrical body, i.e. from the outlet duct, toward the open end of the conical section 706 before exiting the cylindrical body in a straight upward stream path through a center of the helical pattern via the rectilinear outlet duct along the vertical axis along which the first end and the second end are positioned. Such upstream airflow is directed to the ductwork 710 through which the suction 712 provides suctioning action, whether on a continuous or a periodic basis. However, when the dirty air enters the conical section 706, the dirt in the air has excessive inertia to follow a tight curve flow of the hot air upward toward the rectilinear outlet duct, such as due to size or density. Resultantly, the dirt strikes an inner surface of the conical section 706. Since a rotational path is reduced in the conical section 706, due to a tapering volume of the conical section 706, such striking action causes the dirt to separate into a set of small particles, which are output through the open end of the conical section 706 based at least in part on natural gravity. Accordingly, the dirt exits the conical section 706 and falls onto the chute 708. The air, which is effectively substantially free from the dirt, exits the separator 704, via the rectilinear outlet duct toward the ductwork 710 as suctioned via the suction source 712.

Figure 9:
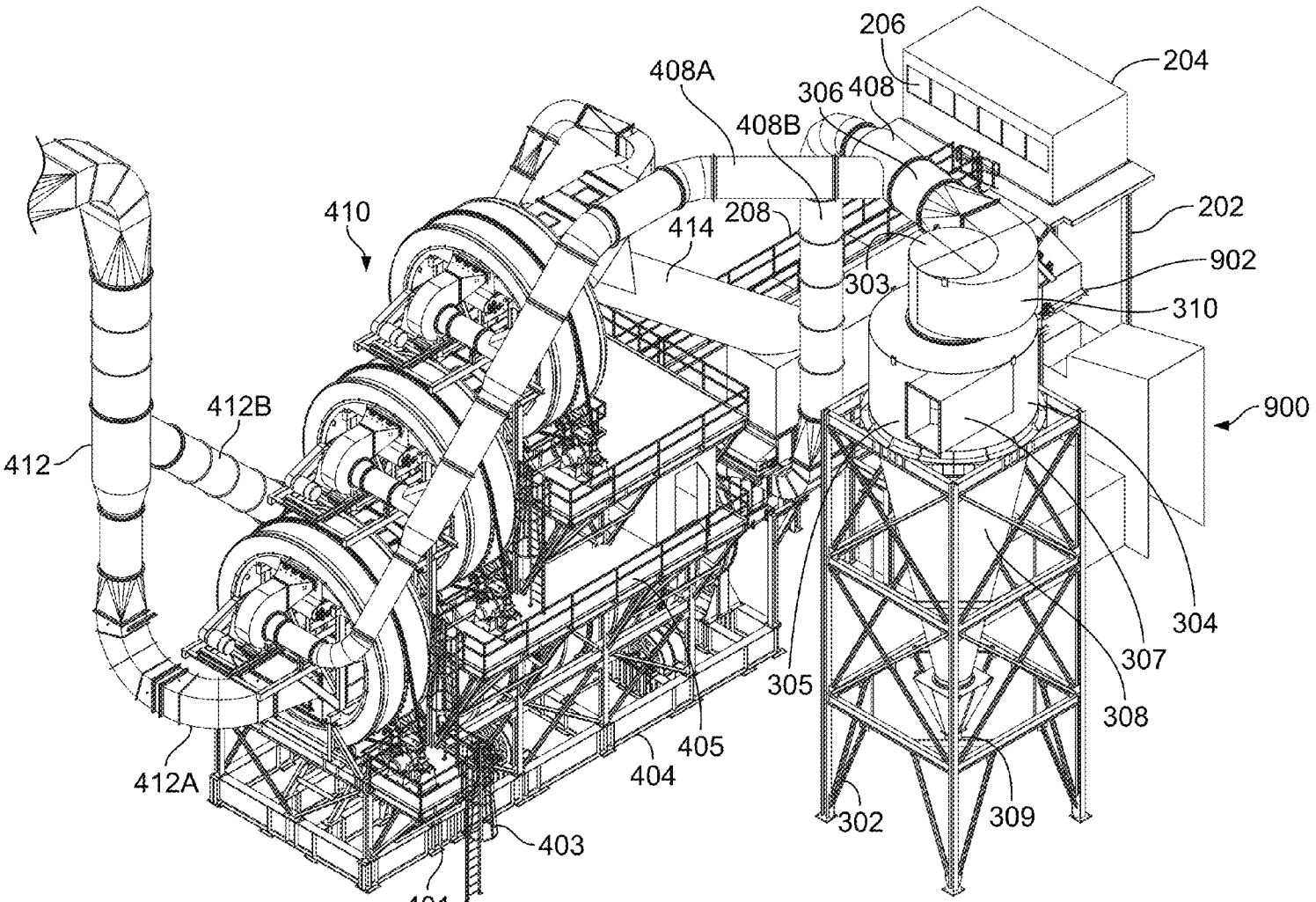
FIG. 9 shows a perspective view of an example embodiment of a separation assembly, an air source assembly, and a control area operably coupled to each other according to the present disclosure.
Figure 10:
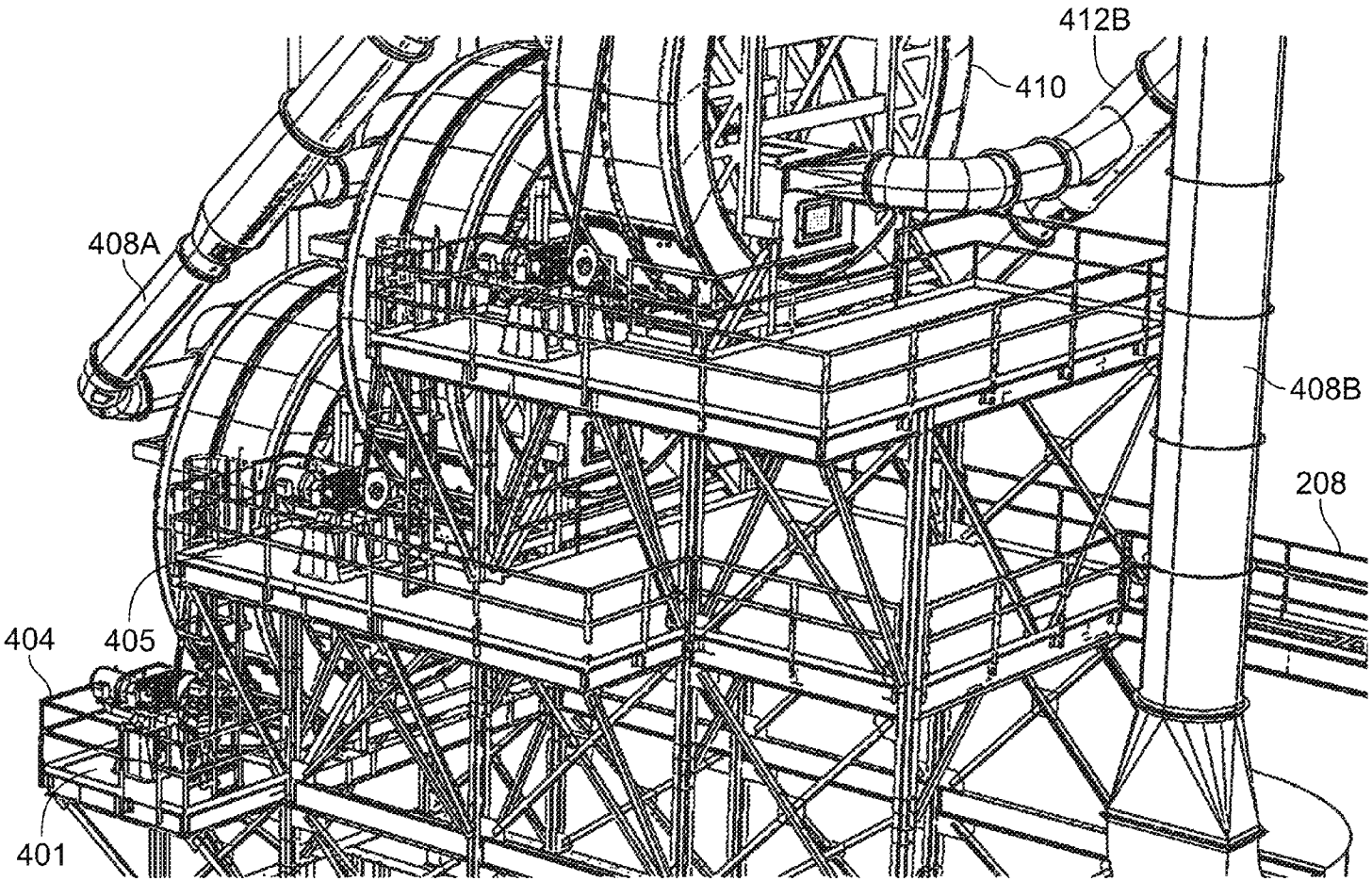
FIG. 10 shows a perspective view of an example embodiment of a separation assembly according to the present disclosure.

FIG. 9 shows a perspective view of an example embodiment of a separation assembly, an air source assembly, and a control area operably coupled to each other according to the present disclosure. FIG. 10 shows a perspective view of an example embodiment of a separation assembly according to the present disclosure. Some elements of these figures are described above. Thus, same reference characters identify identical and/or like components described above and any repetitive detailed description thereof will hereinafter be omitted or simplified in order to avoid complication.

The control area 200 comprises a support structure 202 and a control room 204 positioned atop of the support structure 202. The room 204 comprises a window 206 configured to provide a view onto at least one of the air source assembly 300 and the separation assembly 400. A bridge 208 spans between the support structure 202 and the frame 404.

The structure 202 can be of any type, such as a tower, whether with a lattice or without a lattice, which can comprise a ladder, an elevator, or an escalator, which can be motorized. In other embodiments, the room 204 is not positioned atop of the support structure, such as where the support structure 202 extends past the room 204. The room 204 can be of any type, shape, or volume, whether permanent or temporary. The window 206 can be of any type or shape. The window 206 can be permanently open or opened, whether manually or automatically, whether in a pivotal or a sliding manner. The window 206 can be closed, whether manually or automatically, whether in a pivotal or a sliding manner. The bridge 208 can be of any type, whether fixed or movable, whether single-deck or multiple-deck, whether a beam type, a truss type, a cantilever type, an arch type, a tied arch type, a suspension type, or a cable-stayed type. For example, a user can leave the control room 204 and walk across the bride 208 onto the frame 404 for an operational inspection.

The room 202 contains a computer/control panel for control of the system 100 or at least one of the air source assembly 300, the separation assembly 400, the ductwork assembly 500, the tower assembly 600, the material processing assembly 700, the input material section 800, the output material section 900, the material processing section 1000, and the mill 1100, whether in a wired or a wireless manner, whether directly or indirectly, whether in whole or in part. For example, such control can occur via a programmable logic controller (PLC) coupled to at least one of the air source assembly 300, the separation assembly 400, the ductwork assembly 500, the tower assembly 600, the material processing assembly 700, the input material section 800, the output material section 900, the material processing section 1000, and the mill 1100. The computer/control panel comprises a user interface configured to receive a user input, such as via an input device, such as a keyboard, a mouse, a joystick, a gamepad, or a touchscreen. The computer/control panel comprises an output device, such as a display, a speaker, a vibrator, or a printer. The computer/control panel can be powered as described herein. The computer/control panel can be coupled to a network, whether in a wired manner or a wireless manner, whether directly or indirectly.

The air source assembly 300 comprises the frame 302 hosting the separator 304, which comprises an inlet duct 307, a cyclone cylindrical body 305 in fluid communication with the inlet duct 307, and the conical section 308 in fluid communication with the cyclone body 305 at a first end of the cyclone body 305. The cylindrical body 305 comprises a sidewall through which the inlet duct 307 is in fluid communication therewith, above the conical section 308. The separator 304 further comprises a rectilinear tubular outlet duct 303 in fluid communication with the cyclone body 305 at a second end of the cyclone body 305 opposing the first end. Note that a top end of the rectilinear outlet duct 303 is closed. The separator 304 also comprises an arcuate duct 310 in fluid communication with the rectilinear tubular outlet duct 303 via a sidewall thereof. The arcuate duct 310 is in fluid communication with the duct 306. The duct 306 is in fluid communication with the air supply section 408. The conical section 308 comprises an open end 309 opposite from the second end along a vertical axis on which the first end and the second end are positioned.

As the dirty hot air is input via the inlet duct 307 into the cyclone body 305, the dirty hot air begins to flow within the cyclone body 305 in a downward helical pattern from a top portion of the cyclone body 305, i.e. from the outlet duct 303, toward the open end 309 of the conical section 308 before exiting the cyclone body 305 in a straight upward stream path through a center of the helical pattern via the rectilinear outlet duct 303 along the vertical axis along which the first end and the second end are positioned, where the duct 303 conducts such air to the duct 310. However, when the dirty hot air enters the conical section 308, the dirt in the hot forced air has excessive inertia to follow a tight curve flow of the hot air upward toward the rectilinear outlet duct 303, such as due to size or density. Resultantly, the dirt strikes the inner surface of the conical section 308. Since the rotational path is reduced in the conical section 308, due to the tapering volume of the conical section 308, such striking action causes the dirt to separate into a set of small particles, which are output through the open end 309 of the conical section 308 based at least in part on natural gravity. Accordingly, the dirt exits the conical section 308 and falls onto the ground surface, such as to form a pile of dirt on the ground surface. The air, which is effectively substantially free from the dirt, exits the separator 304 via the rectilinear outlet duct 303, which conducts such air to the duct 310. The duct 310 conducts the air to the duct 306, which conducts such air to the air supply section 408 for use by the dryer section 406 and the separation section 410.

The air supply section 408 provides forced air to the separation section 410 such that the separation section 410 separates the material received from the drier section 406 into the plurality of constituents, such as a first constituent and a second constituent. The air supply section 408 comprises a ductwork defined via a first duct segment 408A and a second duct segment 408B branching off from a common duct of the air supply section 408. The segment 408A and the segment 408B are in conductively parallel relationship with each other. The segment 408A conducts the air from the duct 306 to the separation section 410, such as to an air knife positioned within the separation section 410. The segment 408B conducts the air from the duct 306 to the dryer section 406, such as into a dryer drum positioned within the dryer section 406. Note that the segment 408A tapers away from the common duct of the air supply section 408 from which the segment 408A and the segment 408B branch off. Such tapering enables relatively uniform air or gas flow pressure maintenance as the segment 408A provides air or gas to a set of serially positioned separation stations within the separation section 410. However, in other embodiments, the segment 408A remains uniformly shaped or widens in shape as the segment 408A extends away from the common duct of the air supply section 408, whether the segment 408A provides air or gas to a set of separation stations serially or in parallel.

At least one of the segment 408A and the segment 408B can be flexible or rigid. At least one of the segment 408A and the segment 408B can extend longitudinally in any length, such as twenty feet, or can have any longitudinal shape, such as rectilinear, arcuate, sinusoidal, or any other shapes. At least one of the segment 408A and the segment 408B can have any cross-sectional shape, such as circular, oval, triangular or any other polygonal shape, such as a square, a rectangle, a pentagon, a hexagon, an octagon, and so forth. At least one of the segment 408A and the segment 408B can be thermally insulated, such as via a thermally insulating jacket mounted thereon, for instance a polyurethane jacket.

The frame section 404 comprises a set of walking platforms 405 positioned on a second level and a third level of the frame section 404. The frame section 404 further comprises a mini-platform 401 and a ladder 403 configured to provide access to the mini-platform 401. The ladder 403 spans between the mini-platform 401 and the ground surface. Note that other ladders, which can be similar to the ladder 403, provide access between the mini-platform 401 and one of the platforms 405 or between the platforms 405. Note that the mini-platform 401 and the platforms 405 are enclosed via a railing for safety purposes, whether unitary to or assembled with the frame 404. The railing can have a handrail, whether unitary to or assembled with the railing. The second level of the frame section 404 can comprise a booth, which can be positioned underneath the third level, whether for access to a portion of the separation assembly 400 or operational inspection/monitoring.

Based on separation, the separation section 410 provides some of the constituents to the return conveyor section 414 and provides some of the constituents to the material output section 412, which is defined via a first duct segment 412A and a second duct segment 412B meeting at a common duct. The segment 412A receives the material output from the dryer section 406. The segment 412B receives the material output from the separation section 410.

At least one of the segment 412A and the segment 412B can be flexible or rigid. At least one of the segment 412A and the segment 412B can extend longitudinally in any length, such as twenty feet, or can have any longitudinal shape, such as rectilinear, arcuate, sinusoidal, or any other shapes. At least one of the segment 412A and the segment 412B can have any cross-sectional shape, such as circular, oval, triangular or any other polygonal shape, such as a square, a rectangle, a pentagon, a hexagon, an octagon, and so forth. At least one of the segment 412A and the segment 412B can be thermally insulated, such as via a thermally insulating jacket mounted thereon, for instance a polyurethane jacket.

Figure 12:
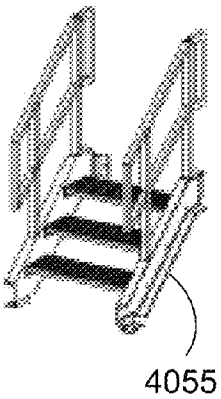
FIG. 12 shows a perspective view of an example embodiment of a set of stairs according to the present disclosure.
Figure 11:
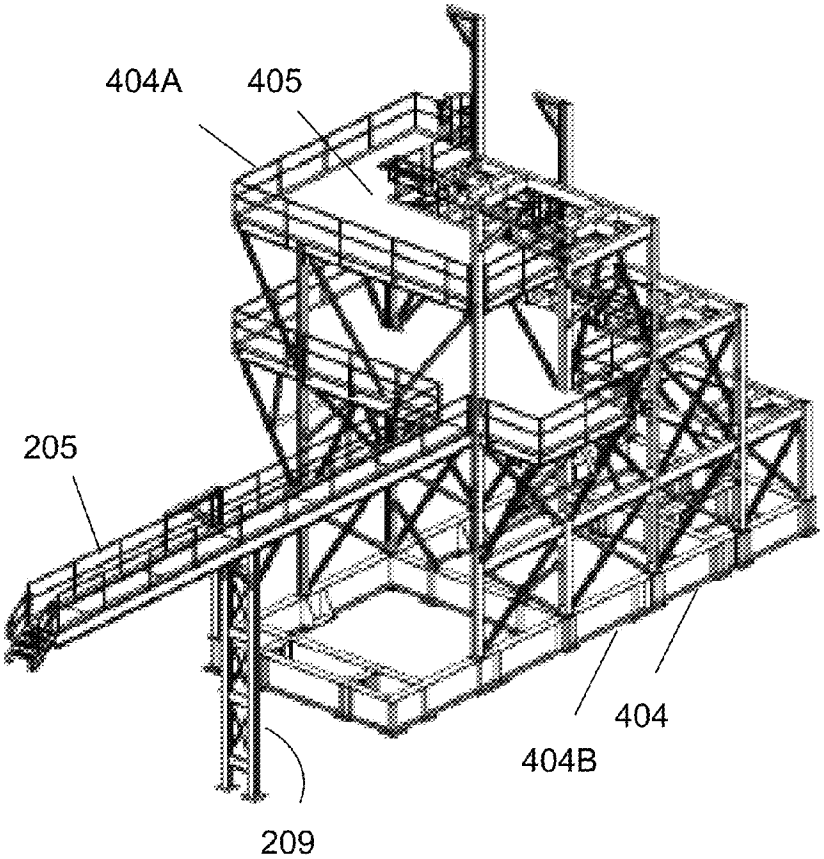
FIG. 11 shows a perspective view of an example embodiment of a separation assembly support frame according to the present disclosure.

FIG. 11 shows a perspective view of an example embodiment of a separation assembly support frame according to the present disclosure. FIG. 12 shows a perspective view of an example embodiment of a set of stairs according to the present disclosure. Some elements of these figures are described above. Thus, same reference characters identify identical and/or like components described above and any repetitive detailed description thereof will hereinafter be omitted or simplified in order to avoid complication.

The base frame section 404 comprises a lateral side 404A and a lateral side 404B. The side 404A is positioned along the segment 408A. The side 404B is positioned along the segment 408B. At least a portion of the base frame section 404 can comprise a beam, such as an H-beam, a bar, such as a hollow tube, or a rod, such as a solid cylinder. The base frame section 404 be assembled via employing at least one of fastening, mating, interlocking, adhering, clamping, nesting, telescoping, or other assembly methods. The base frame section 404 comprises four levels, i.e. a base level and three levels serially above the base level, such as the mini-platform 401 and the platforms 405. However, in other embodiments, the base frame section 404 comprises at least one level, such as one level or four levels, with the separation stations suitably positioned for operation.

The bridge 208 is supported by a column 209, which spans between a ground surface on which the base frame section 404 rests and the bridge 209 extending above the ground surface. The column 209 can be unitary to or assembled with the bridge 208, such as via fastening, mating, interlocking, adhering, clamping, nesting, telescoping, or other assembly methods. Whether additionally or alternatively, the column 209 can span between the frame 404 and the bridge 208, such as diagonally or in an arcuate manner.

The base frame section 404 further comprises a set of stairs 405, such as for user movement between the platforms 405. The stairs 405 can be unitary to or assembled with the base frame section 404, such as via fastening, mating, interlocking, adhering, clamping, nesting, telescoping, or other assembly methods. At least a portion of the stairs 405 can comprise a beam, such as an H-beam, a bar, such as a hollow tube, or a rod, such as a solid cylinder. The stairs 405 be assembled via employing at least one of fastening, mating, interlocking, adhering, clamping, nesting, telescoping, or other assembly methods. Note that the stairs 405 comprise a railing and a handrail. However, in other embodiments, the stairs 405 lack at least one of the railing and the handrail. Whether additionally or alternatively, the base frame section 404 can comprise a ladder, an elevator, or an escalator, which can be motorized.

Figure 13:
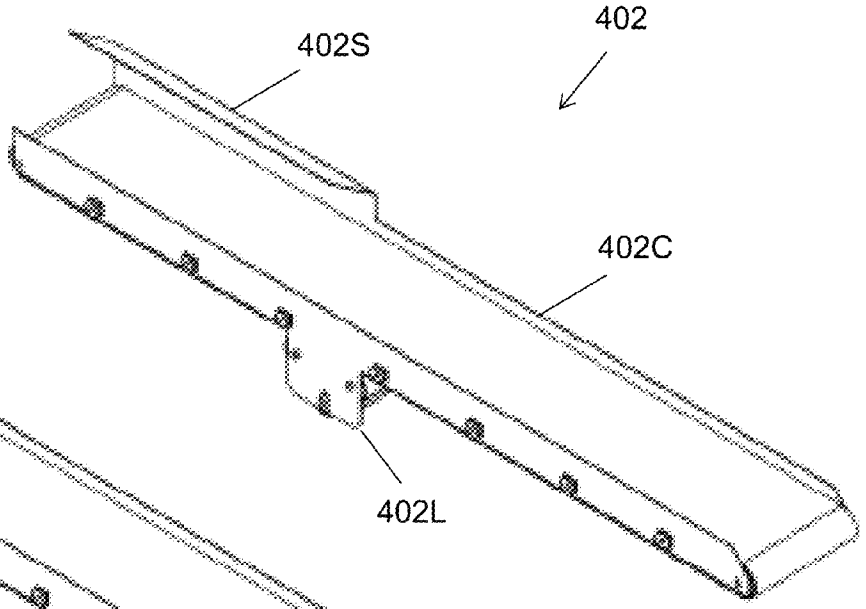
FIG. 13 shows a perspective view of an example embodiment of an input conveyor according to the present disclosure.
Figure 14:
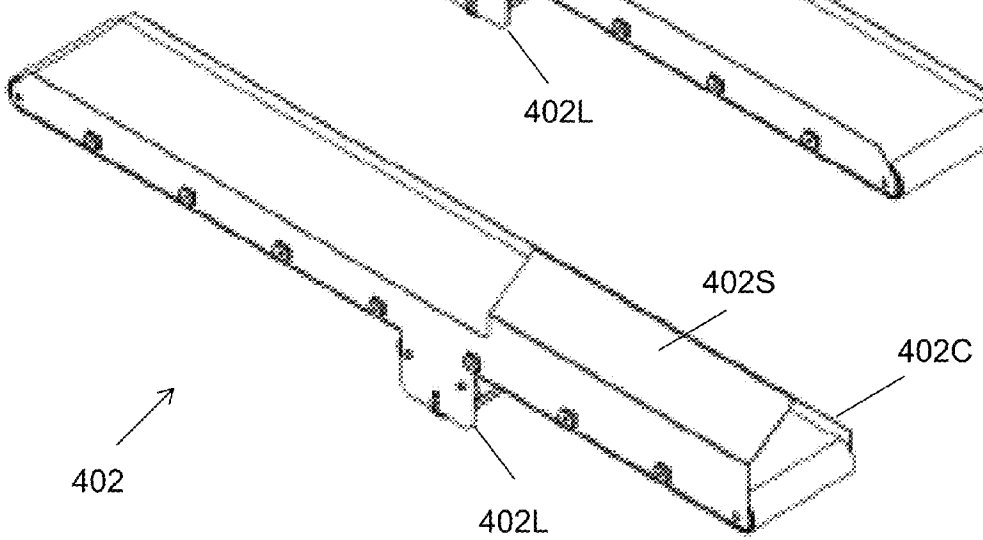
FIG. 14 shows a perspective view of an example embodiment of an input conveyor according to the present disclosure.
Figure 15A:
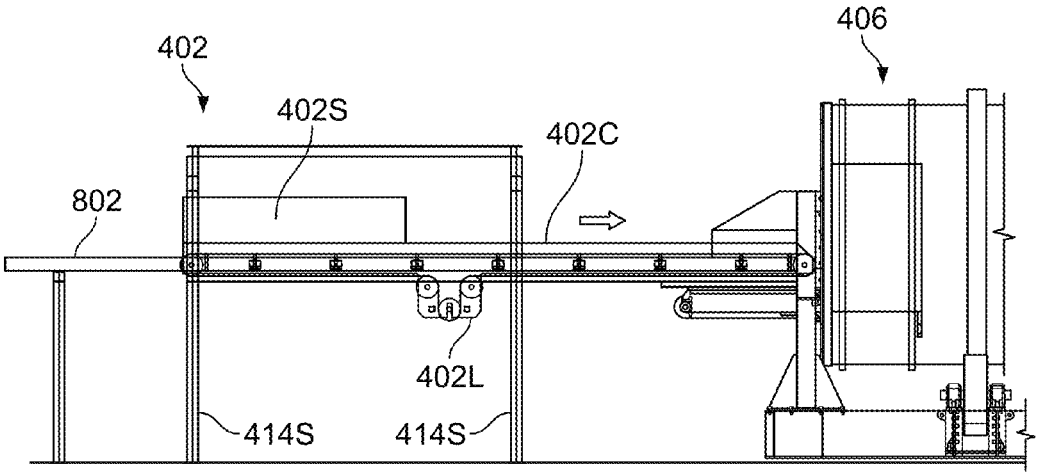
FIG. 15A shows a longitudinal profile view of an example embodiment of an input conveyor in a first mode according to the present disclosure.
Figure 15B:
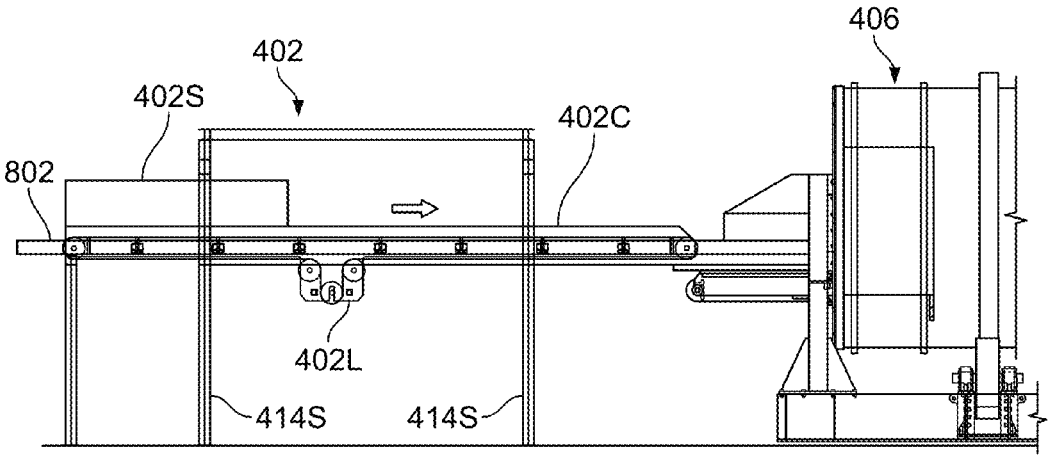
FIG. 15B shows a longitudinal profile view of an example embodiment of an input conveyor in a second mode according to the present disclosure.
Figure 15C:
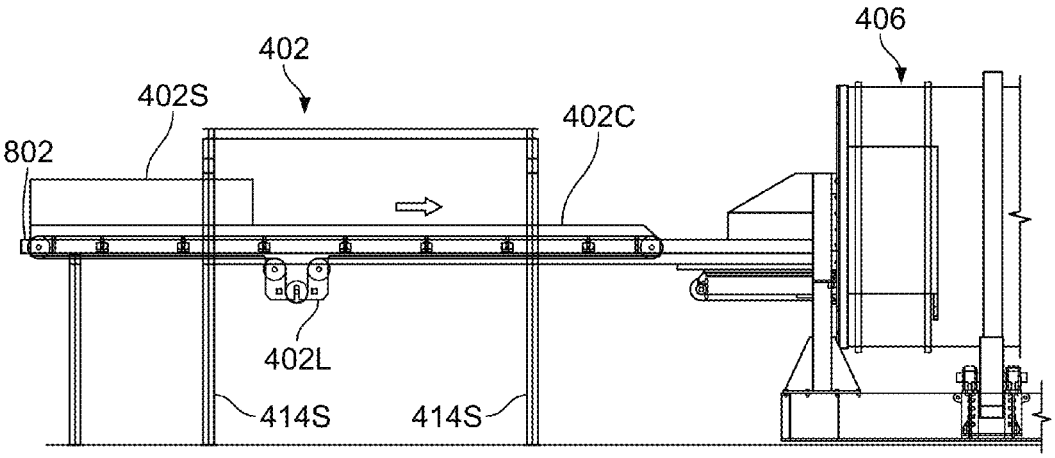
FIG. 15C shows a longitudinal profile view of an example embodiment of an input conveyor in a third mode according to the present disclosure.

FIG. 13 shows a perspective view of an example embodiment of an input conveyor according to the present disclosure. FIG. 14 shows a perspective view of an example embodiment of an input conveyor according to the present disclosure. FIG. 15A shows a longitudinal profile view of an example embodiment of an input conveyor in a first mode according to the present disclosure. FIG. 15B shows a longitudinal profile view of an example embodiment of an input conveyor in a second mode according to the present disclosure. FIG. 15C shows a longitudinal profile view of an example embodiment of an input conveyor in a third mode according to the present disclosure. Some elements of these figures are described above. Thus, same reference characters identify identical and/or like components described above and any repetitive detailed description thereof will hereinafter be omitted or simplified in order to avoid complication.

The input conveyor section 402 comprises a conveyor 402C and a leg 402L, which are positioned in a T-shaped relationship with each other. Note that other types of positioning relationships are possible, such as a U-shape or an L-shape. The conveyor 402C is driven via a motor coupled to the leg 402L, such as underneath the conveyor 402C. Such motor can be of any type, such as an electric servomotor operating a belt of the conveyor 402C. The conveyor 402C comprises a shield 402S extending therefrom. The shield 402S can be solid or perforated, whether transparent, opaque, or translucent, whether in whole or in part. The conveyor 402C receives the material from the conveyor 802, which is perpendicularly conveying to the conveyor 402. In other embodiments, such conveyance relationship is based on a different orientation, such as diagonal. The shield 402S effectively prevents the material, which is conveyed on the conveyor 802, from falling off during a conveyance from the conveyor 802 to the conveyor 402C.

The input conveyor section 402 is positioned underneath the return conveyor section 414, which comprises a pair of columns 414S providing support thereto. Such placement can be offset or directly underneath, whether in part or in whole. The input conveyor section 402 is also positioned upstream from the dryer section 406. The conveyor 402C or the leg 402L are operably coupled to the columns 414S for movement along a horizontal plane, with respect to the columns 414S, between a plurality of positions, which can correspond to a plurality of operational modes. For example, such coupling can be via the leg 402L, where the conveyor 402C travels between such positions based on the leg 402L being moved along the horizontal plane, such as via a set of rails coupled to the columns 414S. The movement is motorized, such as via a motor, such as an electric motor. Such movement can be based at least in part on a manual input, such as via the computer/control panel in the room 204. Whether additionally or alternatively, such movement can also be based at least in part on an automatic input, such as via a computer program running on the computer/control panel in the room 204 or via a processing circuit, such as a PLC, operably coupled to the system 100. Note that such movement can include tilting or lateraling as well.

In a first position, as shown in FIG. 15A, which is a detrashing bypass mode, which can be a rightmost position of the conveyor 402C, the conveyor 402C is retracted toward the dryer section 406 such that the conveyor 802 is unable to convey the material to the conveyor 402C. Accordingly, the conveyor 802 conveys the material to the conveyor 902, which is shredded via at least one of the rotary shredders 904.

In a second position, as shown in FIG. 15B, which is a detrashing operational mode, which can be an intermediate position of the conveyor 402C, the conveyor 402C is moved to receive the material from the conveyor 802, such as at or below the conveyor 802. For example, such material can comprise sugarcane billets and trash. Also, for example, the material can be conveyed perpendicularly from the conveyor 802 onto the conveyor 402C. Resultantly, the conveyor 402C conveys the material toward the dryer section 406.

In a third position, as shown in FIG. 15C, which is a foreign matter reject position, which can be a leftmost position of the conveyor 402C, the conveyor 402C is retracted such that a gap is created between the conveyor 402C and the dryer section 406. For example, the gap can be about four feet long along the horizontal plane. Therefore, the conveyor 402C is able to receive the material from the conveyor 802, yet unable to convey the material onto the dryer section 406. Resultantly, the conveyor 402C conveys the material such that the material falls into the gap and onto the ground surface before entering the dryer section 406. Otherwise, upon entry into the dryer section 406, such material can cause damage at least to the dryer section 406, such as scratching. Once the foreign matter is rejected or the sensor does not sense such matter, then the conveyor 402C automatically returns into the second position.

In other embodiments, the input conveyor section 402 can comprise a chute mounted below the conveyor 402C and configured to receive the material with the foreign matter. Such chute can comprise a U-shape cross-section, while extending longitudinally along a diagonal plane. However, note that such chute can also comprise an O-shape cross-section, such as a tubular duct, which can be polygonal. Such chute is positionally fixed. However, in other embodiments, such chute is positionally adjustable, whether along a horizontal plane or a vertical plane. In yet other embodiments, such chute is longitudinally extendible, whether manually or automatically, such as via telescoping.

The foreign matter can comprise a metal, a material comprising a metallic property, a metal compound, a metallic compound, or a metal alloy. For example, the foreign matter in the sugarcane trash can comprise iron, steel, aluminum, gold, silver, carbide, or others. In some embodiments, the foreign matter can also be non-metallic. The foreign matter is detected via a suitable sensor mounted over the conveyor 802 and in operable communication with the computer/control panel. Accordingly, upon a detection of the foreign matter via the sensor, the computer/control panel instructs the conveyor 402C to move away from the dryer section 406 such that the conveyor 402C is able to receive the material from the conveyor 802, yet unable to convey the material onto the dryer section 406, with the material with the foreign matter falling into the gap.

Whether additionally or alternatively, at least one of the conveyor 802 and the conveyor 402C comprises a magnet disposed thereabove. The magnet can attract at least one of a metal, a material comprising a metallic property, a metal compound, a metallic compound, or a metal alloy if mixed with the material being conveyed. Via such attraction, the magnet can pull out the foreign matter from the material during the conveyance via at least one of the conveyor 802 and the conveyor 402C, which would prevent such matter from entering at least the dryer section 406.

Figure 16:
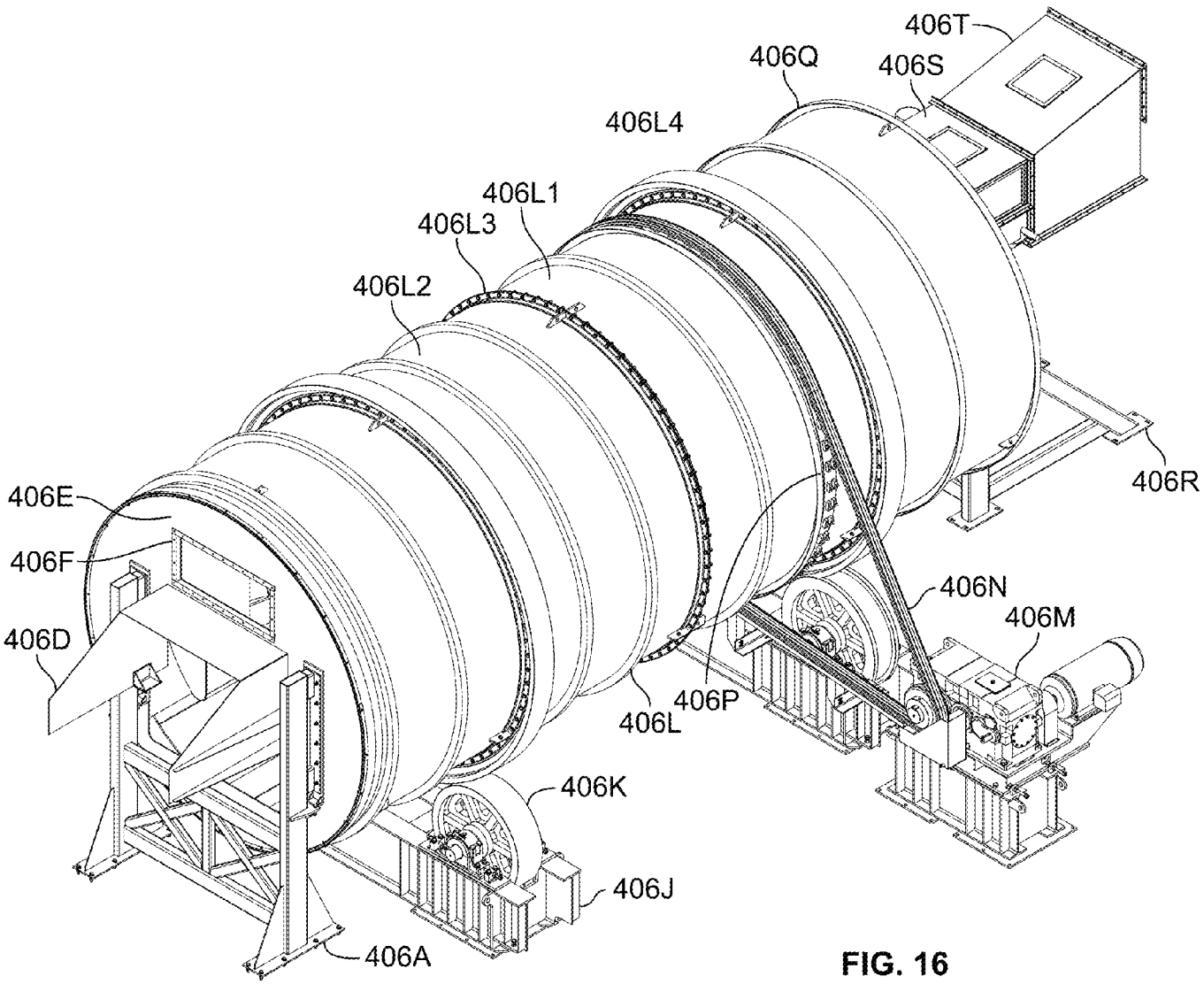
FIG. 16 shows a perspective view of an example embodiment of a dryer according to the present disclosure.
Figure 17:
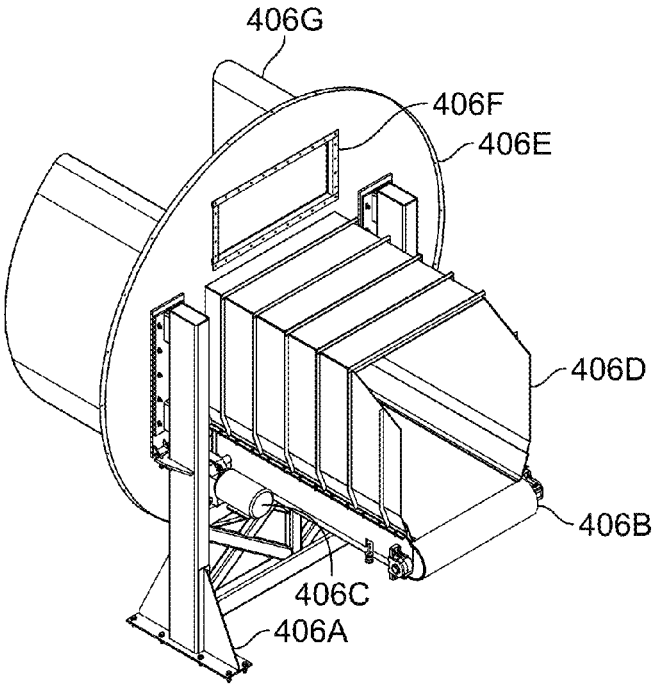
FIG. 17 shows a perspective view of an example embodiment of a dryer input assembly according to the present disclosure.
Figure 18:
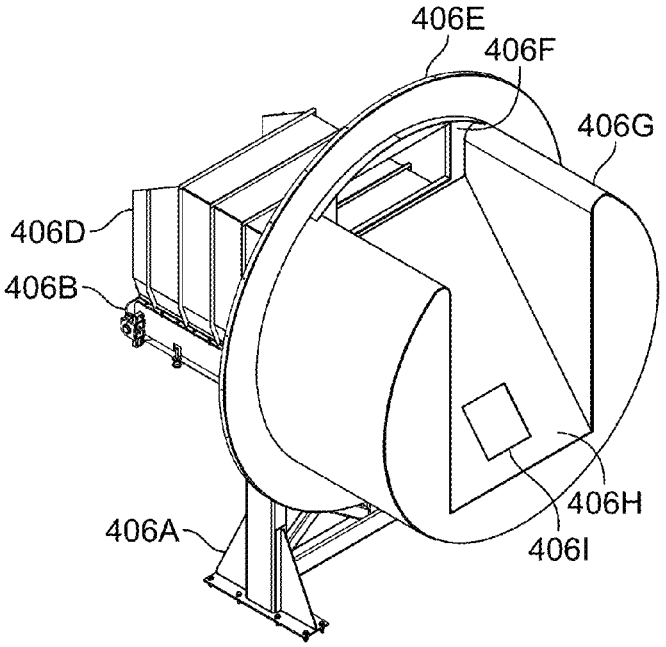
FIG. 18 shows a perspective view of an example embodiment of a dryer input assembly according to the present disclosure.
Figure 19:
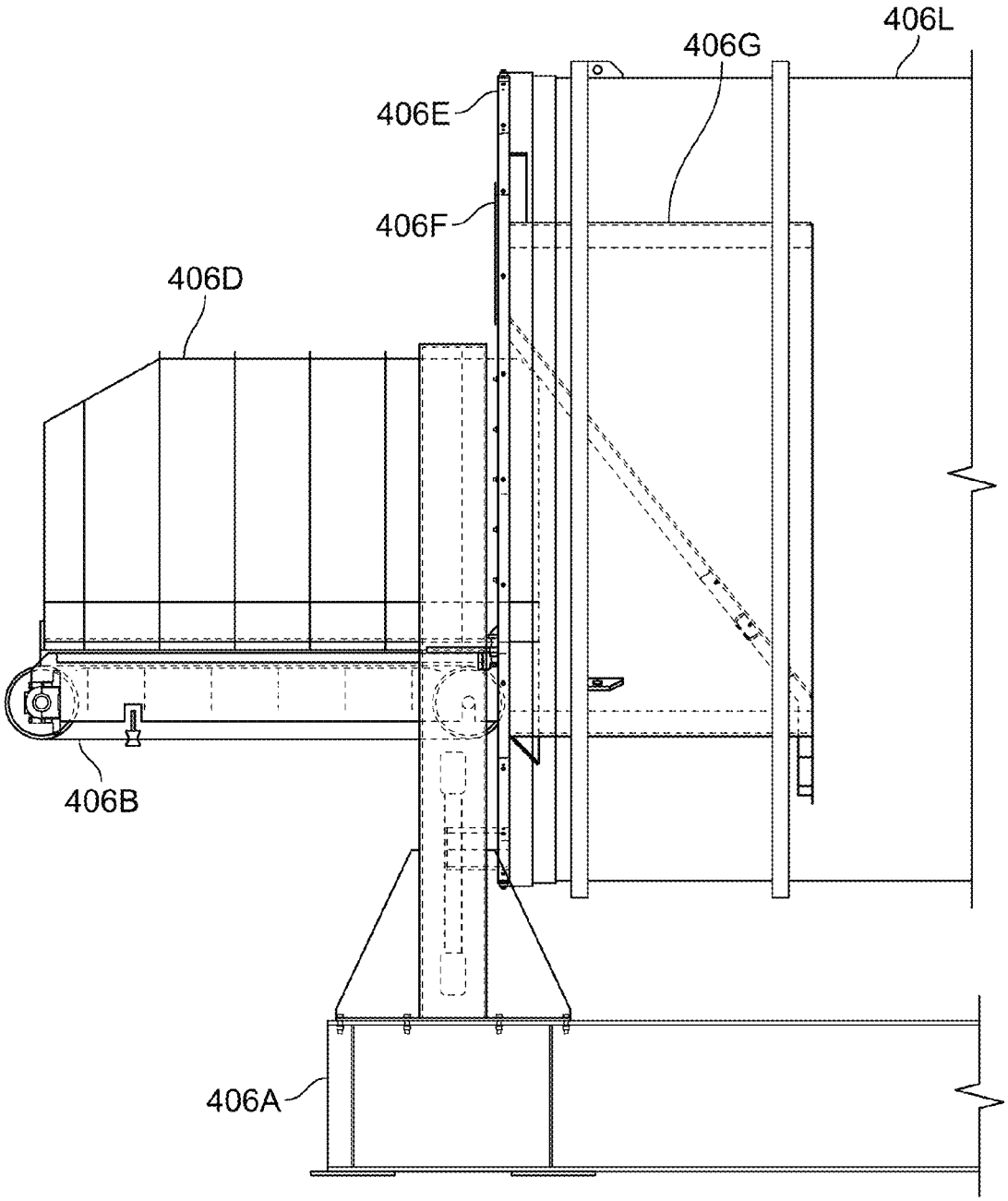
FIG. 19 shows a longitudinal cross-sectional view of an example embodiment of a dryer input assembly according to the present disclosure.
Figure 20:
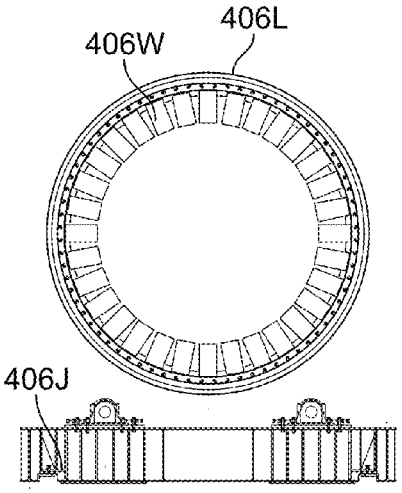
FIG. 20 shows a lateral cross-sectional view of an example embodiment of a dryer drum above a dryer base frame according to the present disclosure.
Figure 21:
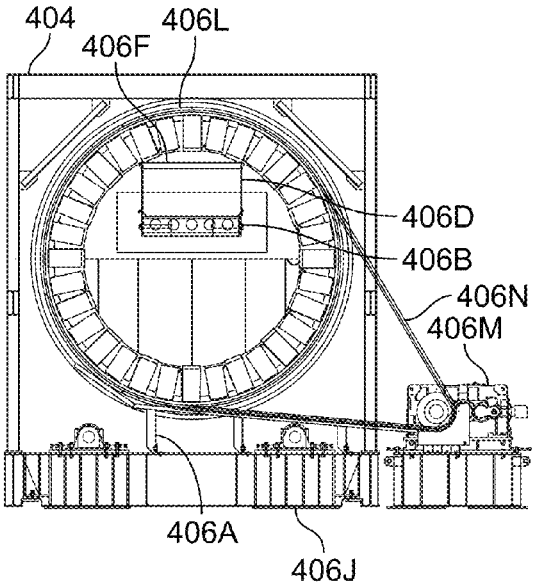
FIG. 21 shows a lateral view of an example embodiment of a dryer according to the present disclosure.
Figure 22:
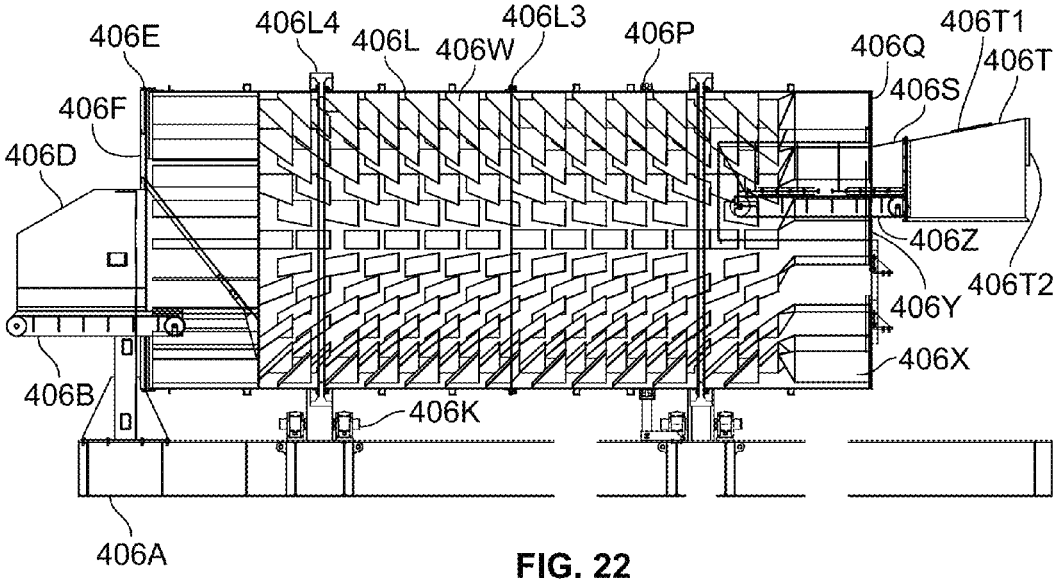
FIG. 22 shows a longitudinal cross-sectional view of an example embodiment of a dryer according to the present disclosure.
Figure 23:
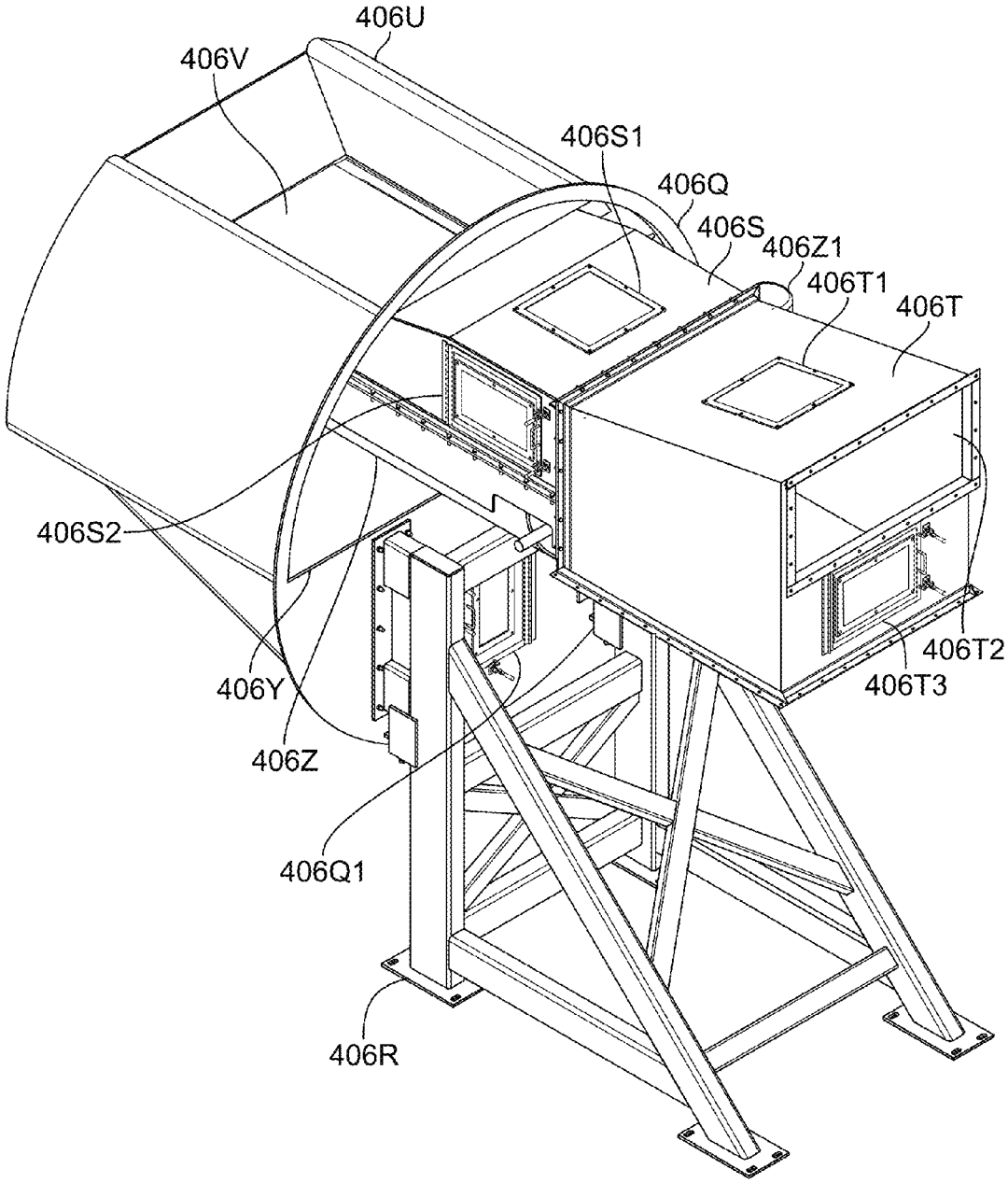
FIG. 23 shows a perspective view of an example embodiment of a dryer output assembly according to the present disclosure.
Figure 24:
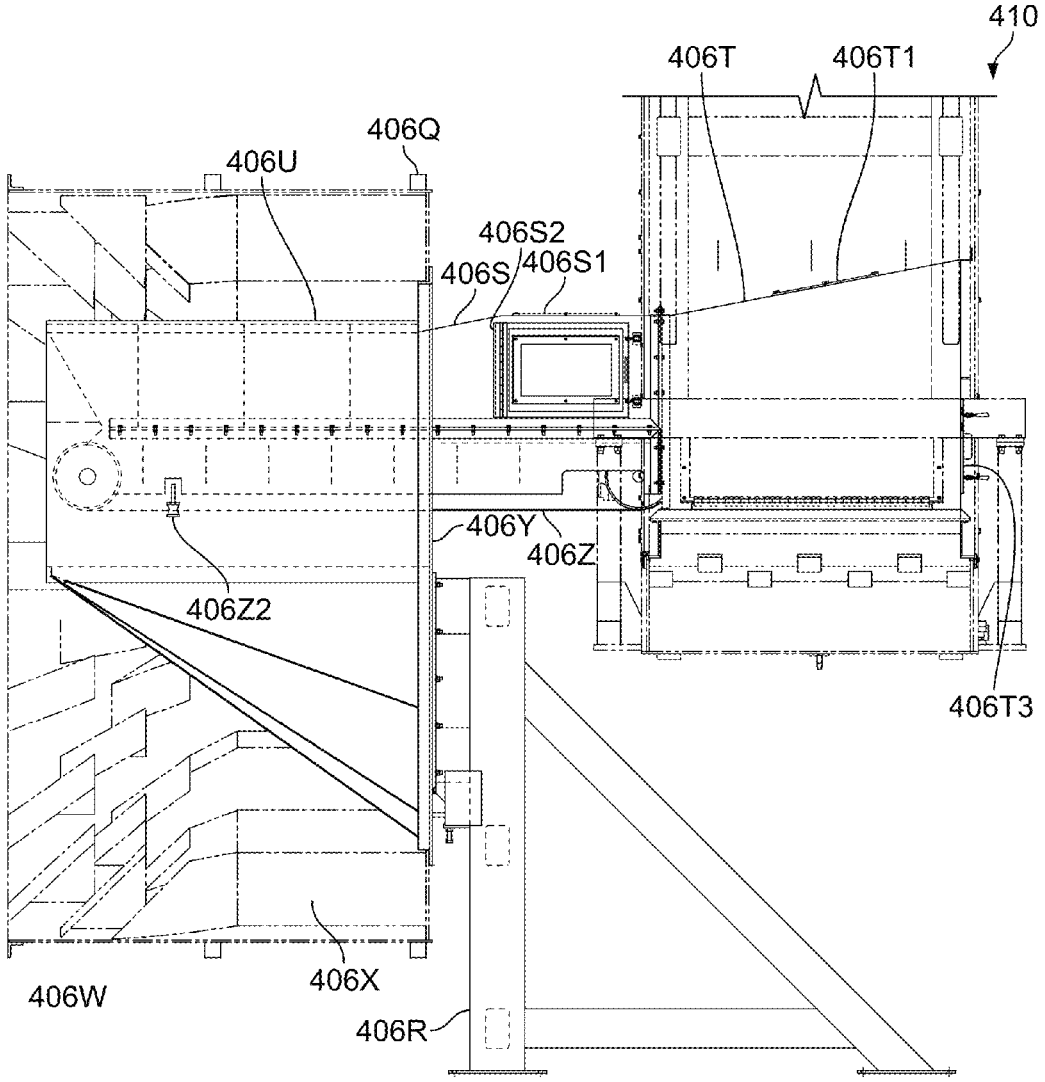
FIG. 24 shows a longitudinal cross-sectional view of an example embodiment of a dryer output assembly according to the present disclosure.
Figure 25:
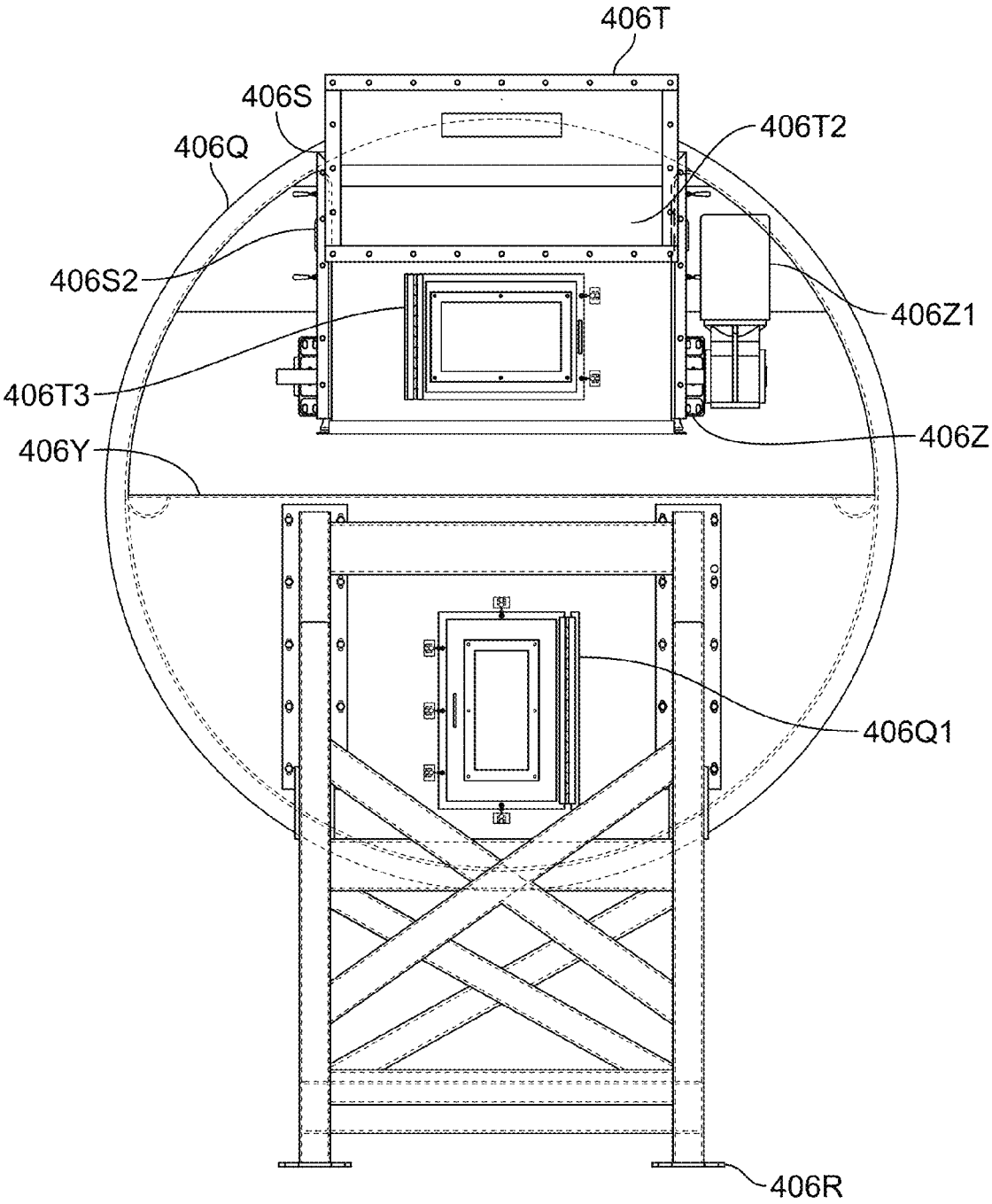
FIG. 25 shows a lateral cross-sectional view of an example embodiment of a dryer output assembly according to the present disclosure.

FIG. 16 shows a perspective view of an example embodiment of a dryer according to the present disclosure. FIG. 17 shows a perspective view of an example embodiment of a dryer input assembly according to the present disclosure. FIG. 18 shows a perspective view of an example embodiment of a dryer input assembly according to the present disclosure. FIG. 19 shows a longitudinal cross-sectional view of an example embodiment of a dryer input assembly according to the present disclosure. FIG. 20 shows a lateral cross-sectional view of an example embodiment of a dryer drum above a dryer base frame according to the present disclosure. FIG. 21 shows a lateral view of an example embodiment of a dryer according to the present disclosure. FIG. 22 shows a longitudinal cross-sectional view of an example embodiment of a dryer according to the present disclosure. FIG. 23 shows a perspective view of an example embodiment of a dryer output assembly according to the present disclosure. FIG. 24 shows a longitudinal cross-sectional view of an example embodiment of a dryer output assembly according to the present disclosure. FIG. 25 shows a lateral cross-sectional view of an example embodiment of a dryer output assembly according to the present disclosure. Some elements of these figures are described above. Thus, same reference characters identify identical and/or like components described above and any repetitive detailed description thereof will hereinafter be omitted or simplified in order to avoid complication.

The dryer section 406 comprises a dryer input assembly, a rotary dryer operably coupled to the dryer input assembly, and a dryer output assembly operably coupled to the rotary dryer. The rotary dryer is positioned between the dryer input assembly and the dryer output assembly. The rotary dryer rotates with respect to the dryer input assembly and the dryer output assembly. The material is conveyed from the dryer input assembly to the rotary dryer to the dryer output assembly.

The dryer input assembly comprises a frame 406A, a conveyor 406B coupled to the frame 406A, a motor 406C driving the conveyor 406B, a U-shaped tunnel 406D coupled to the conveyor 406B over the conveyor 406B, a dryer inlet ring 406E into which the conveyor 406B and the tunnel 406D extend, and an airlock body 406G coupled to the ring 406E. The ring 406E defines an opening 406F above the tunnel 406D and the body 406G.

The body 406G comprises an inclined wall 406H and an opening 406I defined within the wall 406H, such as an outlet, which can be of any shape, such as circle, an oval, a square, a triangle, a pentagon, an octagon, a hexagon, or some other shape. Note that the wall 406H can be a unitary structure or an assembly. The wall 406H can be solid or perforated. The wall 406H can be opened or closed, such as a door, such as a hinged door, a sliding door, or a trap-door. The wall 406H can be positionally non-adjustable, such as positionally fixed, or positionally adjustable, such as movable, such as via pivoting, sliding, dropping, or in another way, whether automatically or via the material itself. The opening 406I can be closed with a shutter or a door, whether actively or passively, whether directly or indirectly, such as via pivoting, sliding or other ways, such as described herein. In some embodiments, the body 406G appears T-shaped when viewed from a profile side view.

The frame 406A can be of any type, whether with a lattice or without a lattice. The frame 406A can be unitary or an assembly, such as via fastening, mating, interlocking, adhering, clamping, nesting, telescoping, or other assembly methods. The frame 406A can be solid or perforated, whether opaque, transparent, or translucent.

The conveyor 406B can be of any type. The motor 406C can be of any type, such as an electric servomotor operating a belt of the conveyor 406C.

The tunnel 406D can be of any type. The tunnel 406D can be solid or perforated, whether opaque, transparent, or translucent. Although the tunnel 406D is U-shaped, other shapes are possible as well, such as a V-shape, a W shape, a C-shape, or others. The tunnel 406D can be unitary or an assembly, such as via fastening, mating, interlocking, adhering, clamping, nesting, telescoping, or other assembly methods.

The ring 406E couples the conveyor 406B and the tunnel 406D to the body 406G. The ring 406E can be of any type. The ring 406E can be solid or perforated, whether opaque, transparent, or translucent. Although the ring 406E is circularly-shaped, other shapes are possible as well, such as an oval, an ellipse, a triangle, a square, a rectangle, a pentagon, a hexagon, an octagon, or others. The ring 406E can be unitary or an assembly, such as via fastening, mating, interlocking, adhering, clamping, nesting, telescoping, or other assembly methods. The ring 406E can function as a closure or a gasket to the rotary dryer, as described herein.

The opening 406F is rectangular, but can be of any shape, such as an oval, an ellipse, a triangle, a square, a pentagon, a hexagon, an octagon, or others. The opening 406F is in fluid communication with the segment 408B to receive the air or gas from the segment 408B, which can be heated, as described herein.

The body 406G can be of any type. The body 406G can be solid or perforated, whether opaque, transparent, or translucent. Although the body 406G is U-shaped, the body 406G can be shaped differently, such as a C-shape or a V-shape. The body 406G can be unitary or an assembly, such as via fastening, mating, interlocking, adhering, clamping, nesting, telescoping, or other assembly methods.

The wall 406H is solid, but can be perforated. The wall 406H can be transparent, translucent, or opaque. The wall 406H can be flat or non-flat, such as outwardly or inwardly bulging. The wall 406H can be unitary or an assembly, such as via fastening, mating, interlocking, adhering, clamping, nesting, telescoping, or other assembly methods. The opening 406I is rectangular, but can be of any shape, such as an oval, an ellipse, a triangle, a square, a pentagon, a hexagon, an octagon, or others. The opening 406I is used to output the material conveyed by the conveyor 406B.

In the second position, the conveyor 402C drops the material onto the conveyor 406B, which conveys the dropped material under the tunnel 406D through the ring 406E to the body 406G where the material is output via the opening 406I, with the wall 406H focusing such output. Note that such output can be based at least in part on the material sliding within the body 406G as the conveyor 406B drops the material into the body 406G, such as when the body 406G contains an internal inclined surface configured for sliding. Note that such drop can be a slide or a release, whether active or passive, whether with a force application or gravitationally induced, whether direct or indirect, whether in whole or in part.

The rotary dryer comprises a plurality of bases 406J and a plurality of wheels 406K operably coupled to the bases 406J. At least one of the bases 406J is solid, but can be perforated. At least one of the bases 406J can be transparent, translucent, or opaque. At least one of the bases 406J can be unitary or an assembly, such as via fastening, mating, interlocking, adhering, clamping, nesting, telescoping, or other assembly methods. For example, at least one of the bases 406J is H-shaped.

At least one of the wheels 406K is solid, but can be perforated. At least one of the wheels 406K can be transparent, translucent, or opaque. At least one of the wheels 406K can be unitary or an assembly, such as via fastening, mating, interlocking, adhering, clamping, nesting, telescoping, or other assembly methods. At least one of the wheels 406K can be rubberized or comprise a tire mounted thereon. At least one of the wheels 406K can be externally grooved, such as via comprising a groove defined via a pair of sidewalls. At least one of the wheels 406K can comprise a set of protrusions/depressions such that the at least one of the wheels 406K operates as a gear. For example, such protrusions can be teeth.

The rotary dryer comprises a motor assembly 406M operably coupled to at least one of the bases 406J, such as via fastening, mating, interlocking, adhering, clamping, nesting, telescoping, or other coupling methods. The dryer section 406 comprises an endless portion mechanism 406N operably coupled to the assembly 406M, such as via mounting. The assembly 406M can be of any type, such as an electric servomotor or some other type of a rotary actuator. The mechanism 406N comprises at least one of a timing belt and a timing chain, whether toothed, perforated, grooved, or un-toothed. For example, the mechanism 406N comprises an inner surface with a plurality of projections/depressions, such as teeth, sprockets, or grooves. Note that other types of endless timing band/chain are possible as well. The mechanism 406N can comprise a synthetic fiber.

The rotary dryer comprises a tubular drum 406L operably coupled to the dryer inlet ring 406E into which the conveyor 406B and the tunnel 406D extend. Note that the rotary dryer rotates with respect to the dryer input assembly via a first set of bearings, such as spherical/ball bearings positioned between the rotary dryer and the dryer input assembly. Similarly, the rotary dryer rotates with respect to the dryer output assembly via a second set of bearings, such as spherical/ball bearings positioned between the rotary dryer and the dryer output assembly. However, note that other modalities enabling such rotation are possible as well, whether additionally or alternatively. The opening 406F is in fluid communication with the segment 408B to receive the air from the segment 408B, which can be heated, as described herein. The drum 406L is in fluid communication with the opening 406F to receive the air or gas from the segment 408B. The drum 406L comprises a circular cross-section. However, in other embodiments, the drum 406L comprises a cross-section shaped as at least one of an oval, an ellipse, and a polygon, such as a square, a rectangle, a triangle, a hexagon, or others.

The drum 406L comprises a plurality of segments 406L1, 406L2, which are fastened with each other at a section 406L3. However, in other embodiments, the segments 406L1, 406L2 are coupled to each other in other coupling methods, such as via fastening, mating, interlocking, adhering, clamping, nesting, or telescoping. Further, in yet other embodiments, the drum 406L is unitary.

The drum 406L comprises a plurality of protrusions 406P externally positioned thereon, along a perimeter of the drum 406L. The protrusions 406P can comprise at least one of a spike, a sprocket, a groove, and a tooth, or any combinations thereof. The protrusions 406P mate with the mechanism 406N, such as under tension to synchronize a rotation of the drum 406L based at least in part on an operation of the assembly 406M. The protrusions 406P are unitary to the drum 406L. However, in other embodiments, the protrusions 406P are coupled to the drum 406L, such as via fastening, mating, interlocking, adhering, clamping, nesting, telescoping, or other coupling methods. In yet other embodiments, the drum 406L comprises a plurality of depressions externally positioned thereon along a perimeter of the drum 406L. The depressions can comprise at least one of a well and a pit, or any combinations thereof, in any shape.

The drum 406L comprises a plurality of external portions 406L4 extending along a perimeter of the drum 406L. The portions 406L4 are circular, but in other embodiments can be shaped differently, whether identical to or different from each other. The portions 406L4 engage the wheels 406K such that the wheels 406K rotate against the portions 406L4 and thereby facilitate a rotation of the drum 406L about a horizontal axis, such as based at least in part on the assembly 406M driving the mechanism 406N. Note that such mating occurs via the wheels 406K being grooved and the portions 406L4 fitting within such grooves. However, in other embodiments, the portions 406L are grooved and the wheels 406K fit within such grooves.

The drum 406L comprises a plurality of fins 406W internally positioned thereon, along a perimeter of the drum 406L and along a length of the drum 406L. The fins 406W are shaped in various shapes, such as a trapezoid, a triangle, or a rectangle. However, in other embodiments, other shapes are possible, such as arcuate, hemispherical, rhombus, or others. The fins 406W are unitary to the drum 406L. However, in other embodiments, the fins 406W are coupled to the drum 406L, such as via fastening, mating, interlocking, adhering, clamping, nesting, telescoping, or other coupling methods. At least one of the fins 406W can comprise a serrated edge or a sharp edge. The fins 406W are oriented such that the air or gas, as input into the drum 406L via the opening 406F, and the material, as input into the drum 406L via the opening 406I, move along the length of the drum 406L along a horizontal plane, such as horizontally or helically, away from the ring 406E, toward the dryer output assembly, as the drum 406L rotates based at least in part on the mechanism 406N engaging the protrusions 406P as the mechanism 406N is driven via the assembly 406M.

The drum 406L comprises a plurality foils 406X internally positioned distal to the opening 406I and in proximity of the dryer output assembly. For example, at least one of the foils 406X can be an out-feed lifter. The foils 406X are internally positioned on the drum 406L along a perimeter of the drum 406L. Based on their shape/structure, the foils 406X facilitate lifting of the material, as the material travels from the opening 406I toward the foils 406X and the drum 406L rotates based at least in part on the mechanism 406N engaging the protrusions 406P as the mechanism 406N is driven via the assembly 406M. The foils 406X can comprise a depression, such as a well or a pit, configured for containing the material during such lifting. The foils 406X are shaped in various shapes, such as a trapezoid, a triangle, or a rectangle. However, in other embodiments, other shapes are possible, such as arcuate, hemispherical, rhombus, or others. The foils 406X are unitary to the drum 406L. However, in other embodiments, the foils 406X are coupled to the drum 406L, such as via fastening, mating, interlocking, adhering, clamping, nesting, telescoping, or other coupling methods.

The dryer output assembly comprises a frame 406R and a body 406U operably coupled to the frame 406R, such as via fastening, mating, interlocking, adhering, clamping, nesting, telescoping, or other coupling methods. However, in other embodiments, the frame 406R and the body 406U are unitary. The frame 406 comprises a lattice. In other embodiments, the frame 406 can be without a lattice. The body 406U defines a first opening 406V and a second opening 406Y perpendicular to the opening 406V. The opening 406V is rectangular in shape, but can be shaped differently, such as a circle, an oval, an ellipse, a hexagon, or others. The opening 406Y is semicircle in shape, but can be shaped differently, such as an oval, an ellipse, a hexagon, or others. The opening 406V and the opening 406Y can be identical to or different from each other in perimeter or area.

The body 406U comprises a rim 406Q extending around the opening 406Y. The rim 406Q is configured such that the drum 406L can securely receive the body 406U and rotate with respect to the body 406U along a horizontal axis. The body 406U comprises a lower tapered section, such as be longitudinally arcuate or longitudinally polygonal. The lower tapered section is sufficiently solid or perforated to preclude the material falling therethrough. However, the lower tapered section can also be configured to allow the material to fall therethrough. The body 406U, such as via the rim 406Q, can function as a closure or a gasket to the rotary dryer, as described herein.

The body 406U comprises a door 406Q1 operably coupled thereto, such as pivotally, hingedly, slidably, or in other manners. The door 406Q1 comprises a closed window, which can be transparent or translucent, which can be of any shape, which can be reinforced within an internal lattice. The window provides visual access to the lower tapered section. Note that the door 406Q1 can also be windowless. The door 406Q1 remains closed or locked via a latch, a hook, a lock, a magnet, a hook-and-loop fastener, or some other mechanism, whether manual or automatic. The door 406Q1 comprises a handle, but can lack one as well. When opened, the door 406Q1 provides a hands on or tool access to the lower tapered section, such as for clean up or maintenance. When closed, the door 406Q1 can provide a seal to the drum 406L for drying efficiency, which can be hermetic.

The dryer output assembly comprises a conveyor 406Z, a motor 406Z1, and a tunnel 406S coupled to the conveyor 40Z. The conveyor 406Z can operate dependent on or independent the conveyor 406B. The tunnel 406S comprises a closed window 406S1 and a door 406S2.

The conveyor 406Z can be of any type. The motor 406Z1 can be of any type, such as an electric servomotor operating a belt of the conveyor 406Z. The conveyor 406Z is positioned to receive the material dropped via the foils 406X into the opening 406V and convey such material through the tunnel 406S. Note that such drop can be a slide or a release, whether active or passive, whether with a force application or gravitationally induced, whether direct or indirect, whether in whole or in part.

The tunnel 406S can be of any type. The tunnel 406S can be solid or perforated, whether opaque, transparent, or translucent. Although the tunnel 406S is U-shaped, other shapes are possible as well, such as a V-shape, a W shape, a C-shape, or others. The tunnel 406S can be unitary or an assembly, such as via fastening, mating, interlocking, adhering, clamping, nesting, telescoping, or other assembly methods.

The window 406S1 operably coupled to the tunnel 406S, such as via fastening, mating, interlocking, adhering, clamping, nesting, telescoping, or other coupling methods. The window 406S1 can be transparent or translucent. The window 406S1 can be reinforced within an internal lattice. The window 406S1 can be of any shape. The window 460S1 provides visual access to the conveyor 406Z. Alternatively, the window 406S1 can be a part of a door.

The door 406S2 is operably coupled to the tunnel 406S, such as pivotally, hingedly, slidably, or in other manners. The door 406S2 comprises a closed window, which can be transparent or translucent, which can be reinforced within an internal lattice. The window can be of any shape. The window provides visual access to the conveyor 406Z. Note that the door 406S2 can also be windowless. The door 406S2 remains closed or locked via a latch, a hook, a lock, a magnet, a hook-and-loop fastener, or some other mechanism, whether manual or automatic. The door 406S2 comprises a handle, but can lack one as well. When opened, the door 406S2 provides a hands on or tool access to the conveyor 406Z, such as for clean up or maintenance. When closed, the door 406S2 can provide a seal to the tunnel 406S for drying efficiency, which can be hermetic.

The dryer output assembly further comprises a transfer assembly comprising a duct 406T in fluid communication with the conveyor 406Z and the tunnel 406S. The duct 406T can be coupled to the tunnel 406S, such as via fastening, mating, interlocking, adhering, clamping, nesting, telescoping, or other coupling methods. The duct 406T defines an opening 406T2, which can be of any shape. The duct 406 comprises a closed window 406T1 and a door 406T3. The duct 406T further comprises an at least partially open bottom surface, which can be of any shape, or defines a bottom opening, which can be of any shape. At least one of the partially open bottom surface and the bottom opening disposed above one of the separation stations of the separation section 410. For example, the bottom opening can be defined via a set of sidewalls defining the duct 406T.

The window 406T1 operably coupled to the duct 406T, such as via fastening, mating, interlocking, adhering, clamping, nesting, telescoping, or other coupling methods. The window 406T1 can be transparent or translucent. The window 406T1 can be reinforced within an internal lattice. The window 406T1 can be of any shape. The window 460T1 provides visual access to an interior chamber of the duct 406T, such as the at least partially open bottom surface or the bottom opening. Alternatively, the window 406T1 can be a part of a door.

The door 406T3 is operably coupled to the duct 406T, such as pivotally, hingedly, slidably, or in other manners. The door 406T3 comprises a closed window, which can be transparent or translucent, which can be reinforced within an internal lattice. The window can be of any shape. The window provides visual access to the inner chamber of the duct 406T or the at least partially open bottom surface or the bottom opening. Note that the door 406T3 can also be windowless. The door 406T3 remains closed or locked via a latch, a hook, a lock, a magnet, a hook-and-loop fastener, or some other mechanism, whether manual or automatic. The door 406T3 comprises a handle, but can lack one as well. When opened, the door 406T3 provides a hands on or tool access to the inner chamber of the duct 406T or the at least partially open bottom surface or the bottom opening, such as for clean up or maintenance. When closed, the door 406T3 can provide a seal to the duct 406T for fluid flow efficiency, which can be hermetic. The duct 406T is in fluid communication with the segment 412A via the opening 406T2.

In the second position, via the opening 406F, the drum 406L receives the air or gas, which can be heated, as described herein, from the air source assembly 300, as conducted through the duct 408B. The air or gas enables at least surface drying of the material, such as sugarcane trash, such that some of the constituents of the material, such as leaves or other debris, are easily released or separated from other constituents of the material, such as sugarcane billets. Via rotation about a horizontal axis, the drum 406L tumble dries the material and conducts the material via the fins 406 toward the foils 406X, such as out-feed lifters, which elevate the material and drop the material into the opening 406V. Upon such drop, the material falls onto the conveyor 406Z, which conducts the dropped material along a horizontal plane to the duct 406T from which suction is applied via the opening 406T2 based at least in part on the segment 412A, as sourced via the suction source 712. However, during the material drop, the air or gas from the drum 406L passes thru the material, such as sugarcane trash comprising sugarcane billets and leaves. Resultantly, most lighter constituents of the material, such as leaves, remain airborne and are sucked out from the tunnel 406S via the suction from the opening 406T2. Such constituents are conducted via the ductwork assembly 500 to the material processing assembly 700. Most heavier constituents of the material, such as sugarcane billets, fall through at least one of the partially open bottom surface of the duct 406T and the bottom opening of the duct 406T into one of the separation stations of the separation section 410. Note that such drop can be a slide or a release, whether active or passive, whether with a force application or gravitationally induced, whether direct or indirect, whether in whole or in part.

Figure 26:
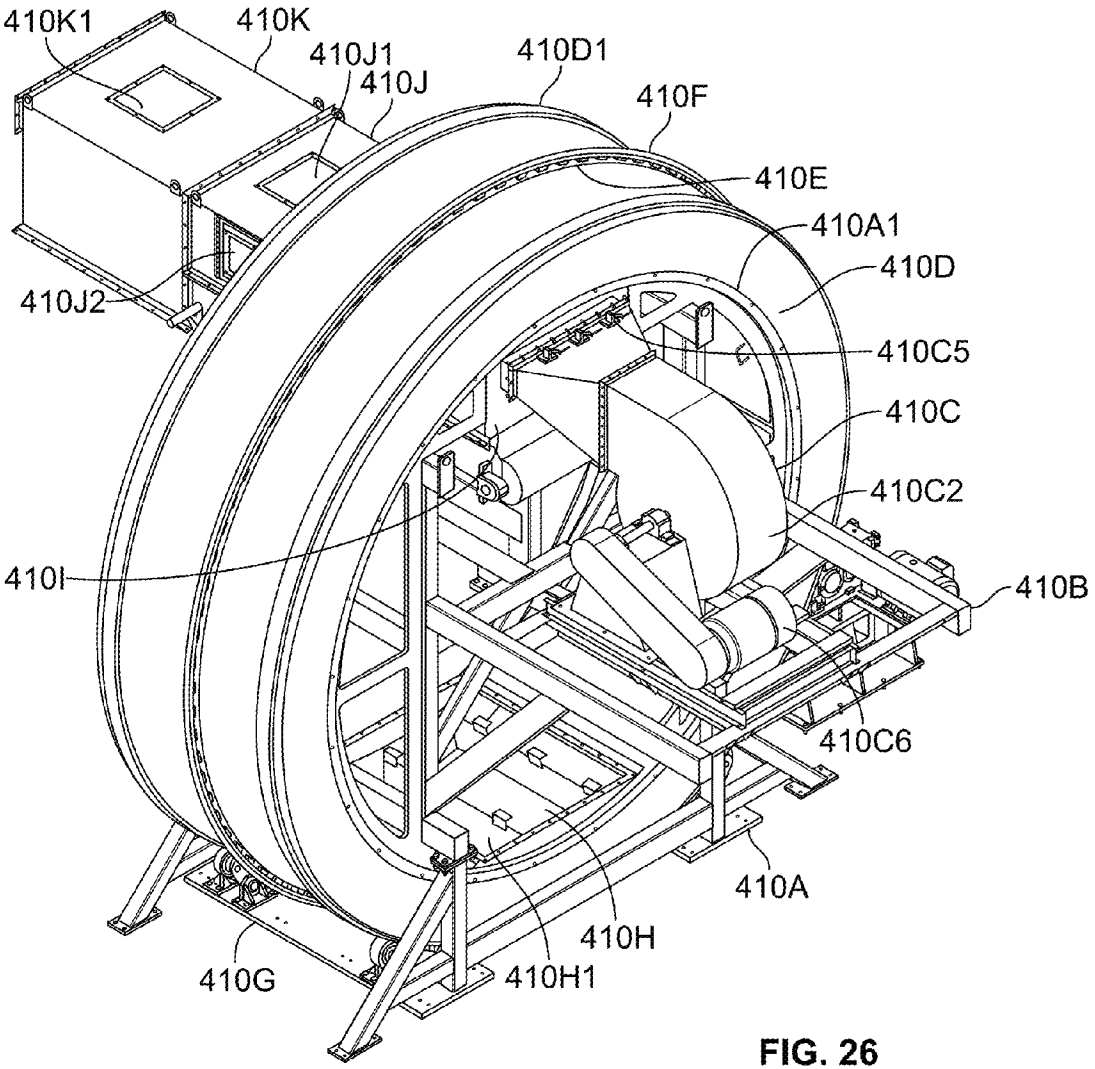
FIG. 26 shows a perspective view of an example embodiment of a rotary lifter according to the present disclosure.
Figure 27:
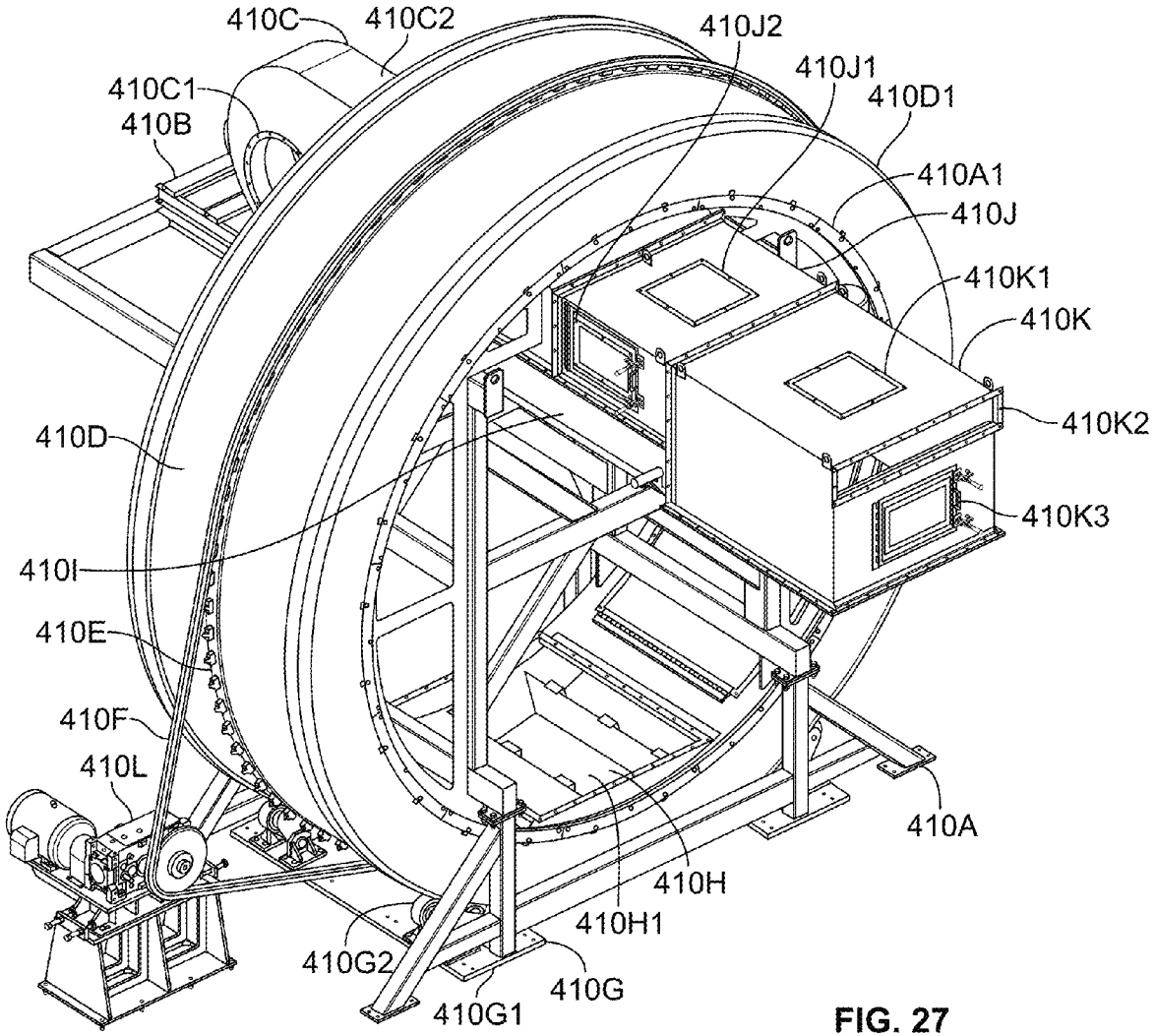
FIG. 27 shows a perspective view of an example embodiment of a rotary lifter according to the present disclosure.
Figure 28:
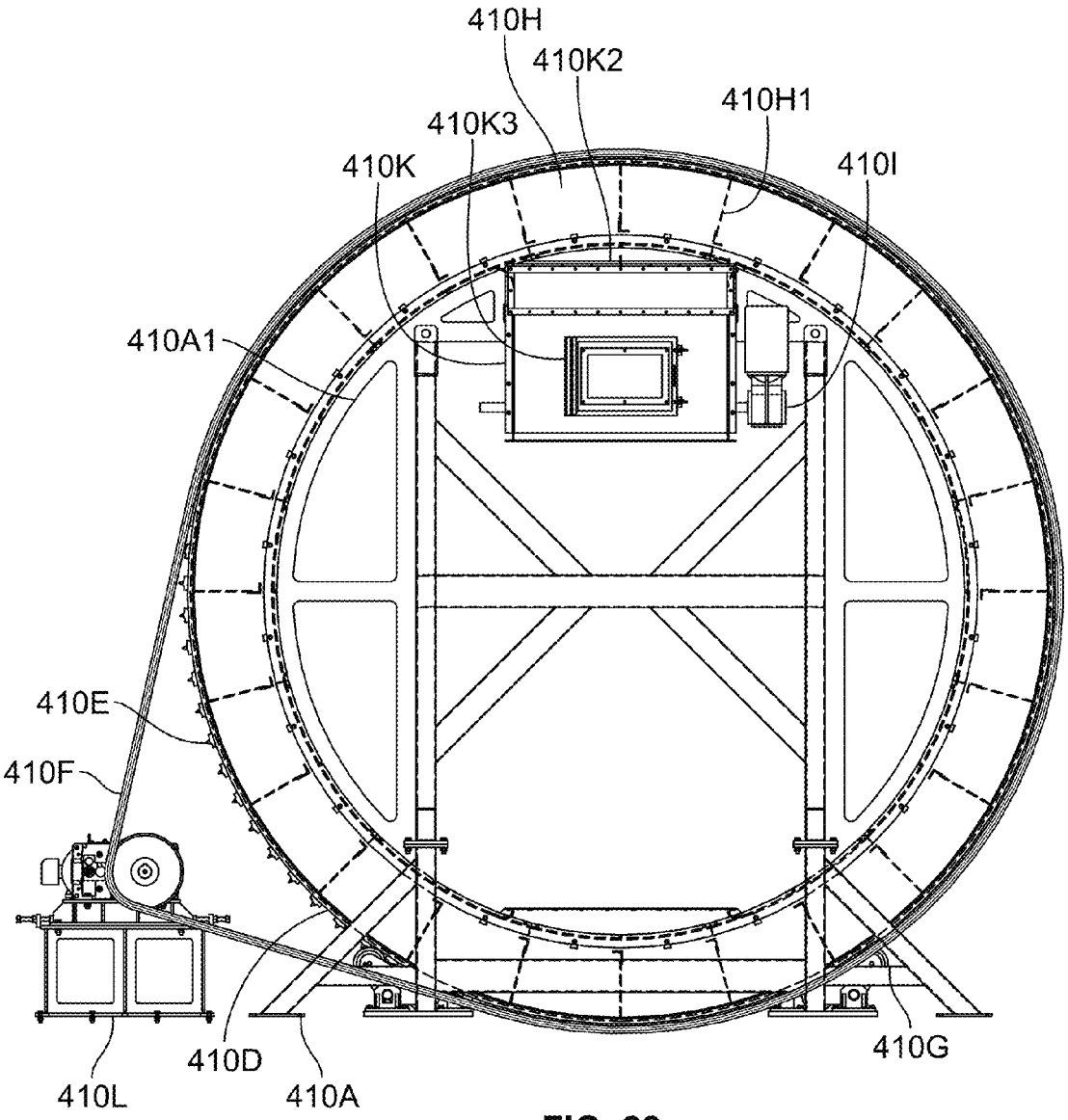
FIG. 28 shows a lateral cross-sectional view of an example embodiment of a rotary lifter according to the present disclosure.
Figure 29:
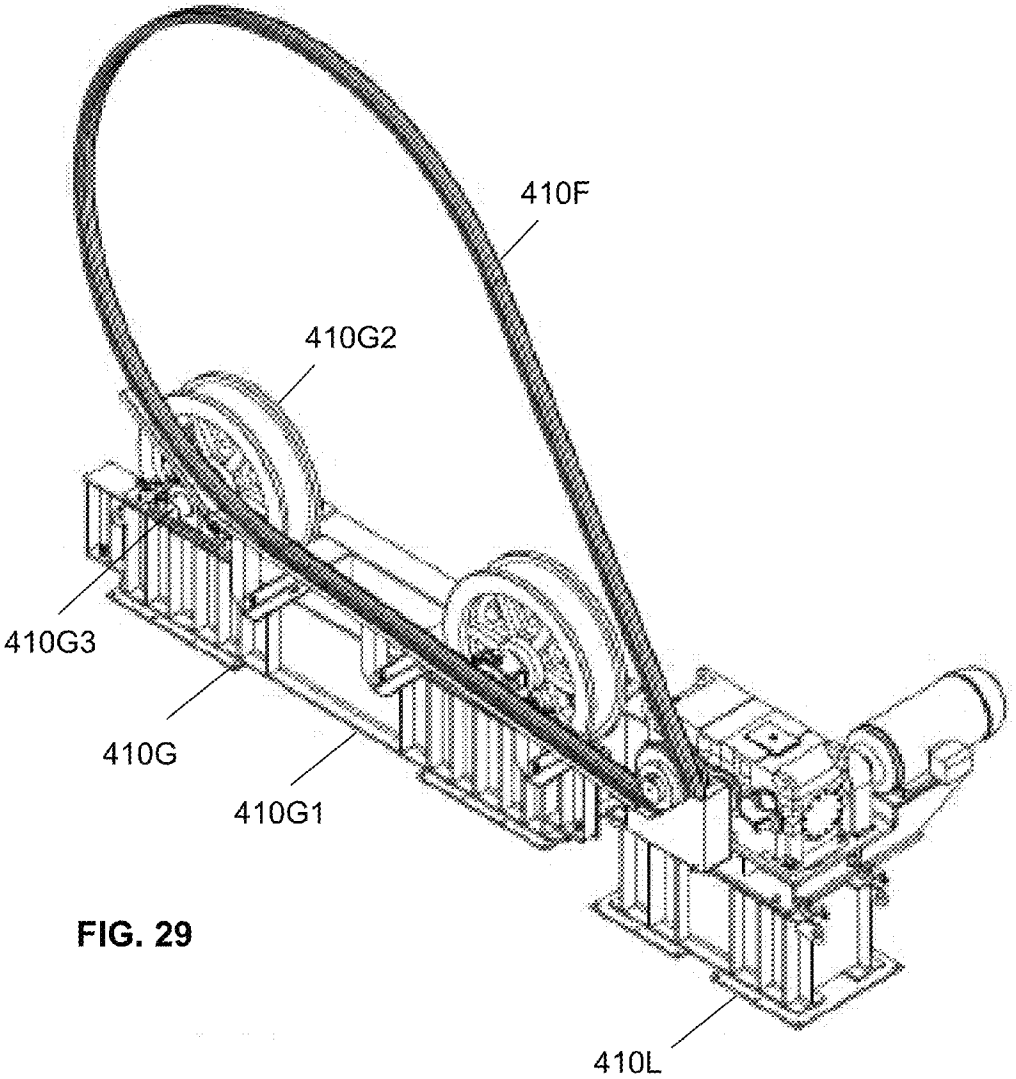
FIG. 29 shows a perspective view of an example embodiment of a rotary lifter drive assembly according to the present disclosure.
Figure 30:
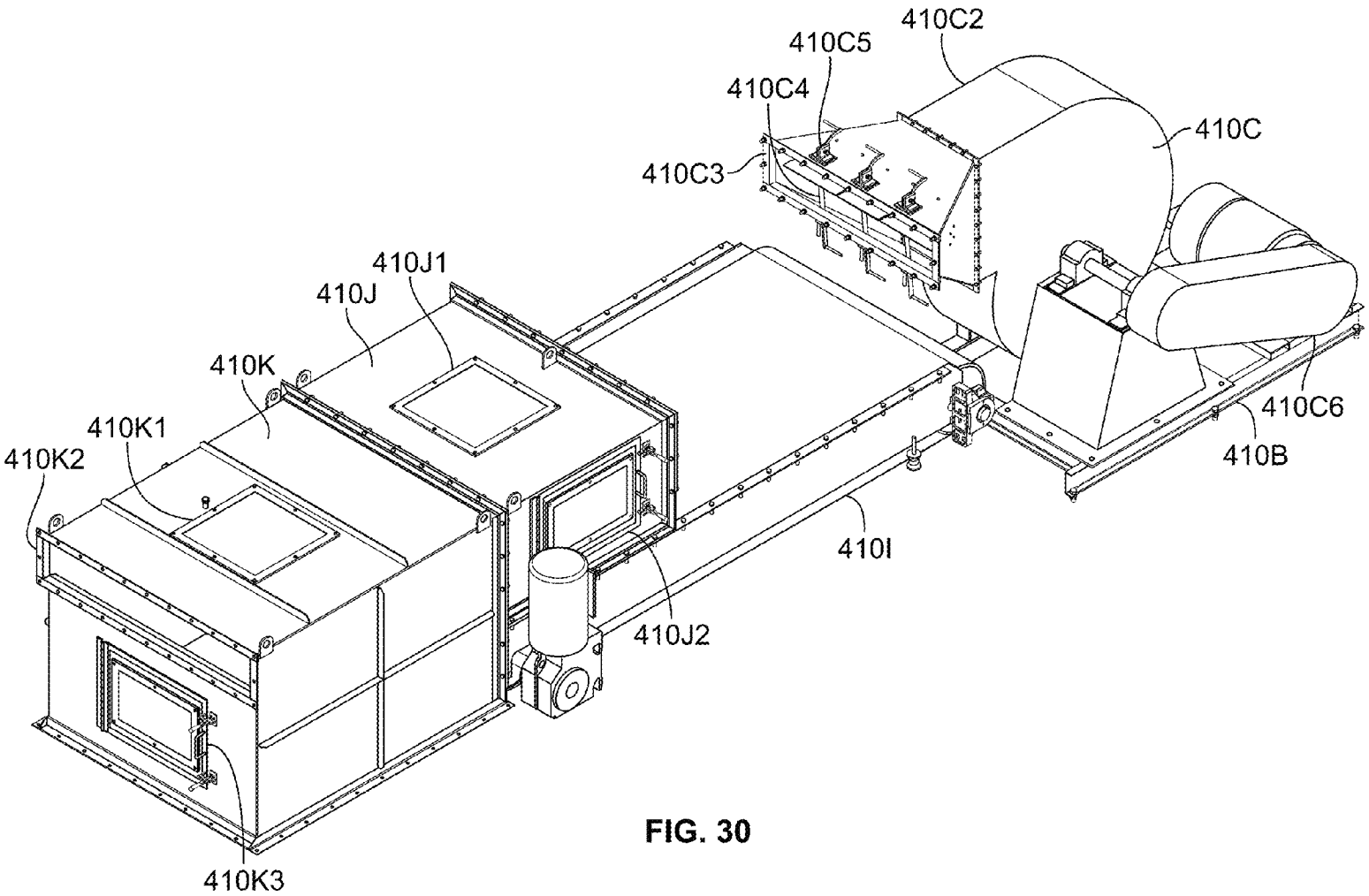
FIG. 30 shows a perspective view of an example embodiment of a rotary lifter separation assembly according to the present disclosure.
Figure 31:
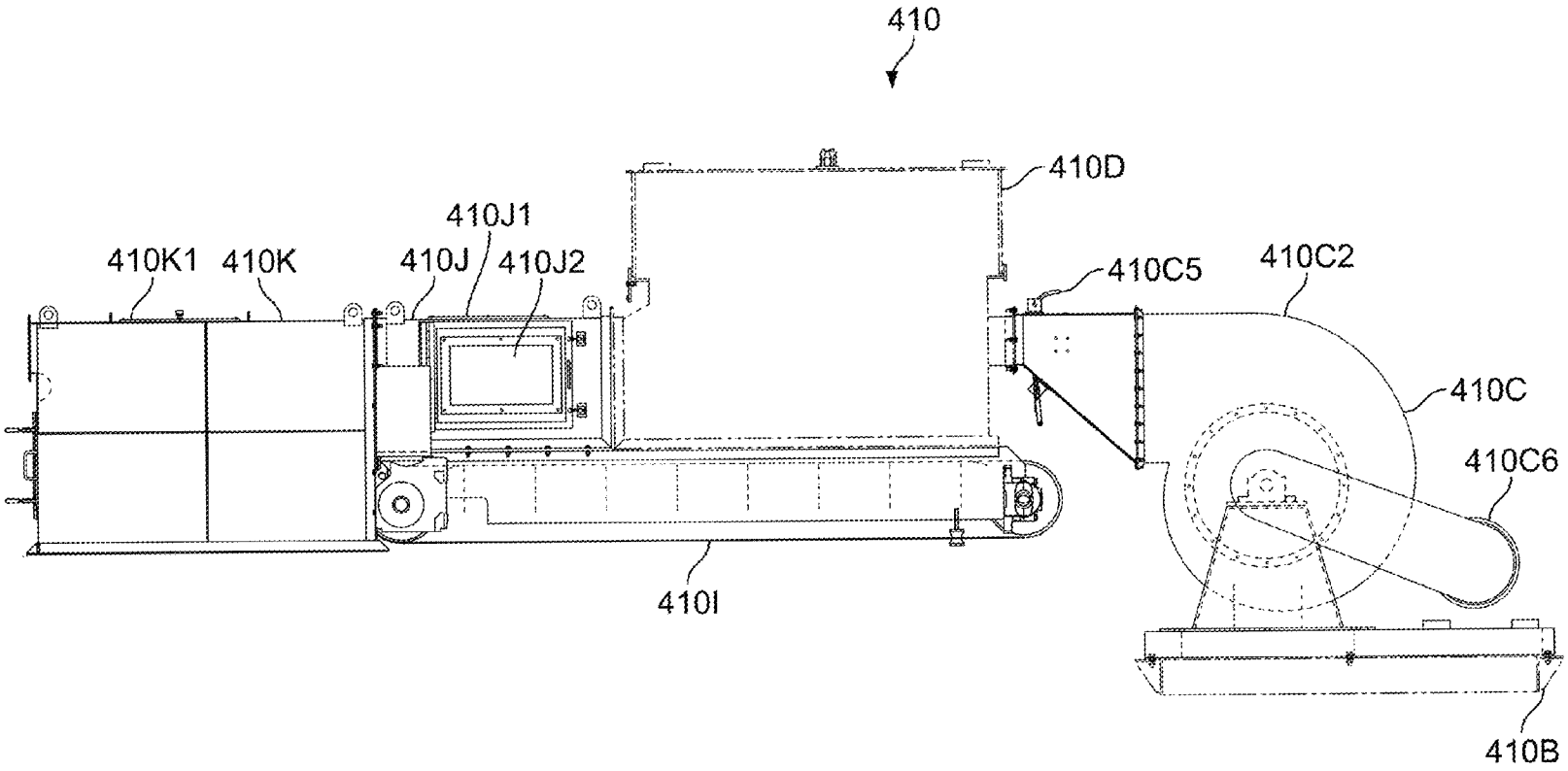
FIG. 31 shows a lateral cross-sectional view of an example embodiment of a rotary lifter separation assembly according to the present disclosure.

FIG. 26 shows a perspective view of an example embodiment of a rotary lifter according to the present disclosure. FIG. 27 shows a perspective view of an example embodiment of a rotary lifter according to the present disclosure. FIG. 28 shows a lateral cross-sectional view of an example embodiment of a rotary lifter according to the present disclosure. FIG. 29 shows a perspective view of an example embodiment of a rotary lifter drive assembly according to the present disclosure. FIG. 30 shows a perspective view of an example embodiment of a rotary lifter separation assembly according to the present disclosure. FIG. 31 shows a lateral cross-sectional view of an example embodiment of a rotary lifter separation assembly according to the present disclosure. Some elements of these figures are described above. Thus, same reference characters identify identical and/or like components described above and any repetitive detailed description thereof will hereinafter be omitted or simplified in order to avoid complication.

The separation section 410 comprises a set of separation stations, such as at least one, which can be positioned serially or in parallel with each other. Each of the separation stations comprises a base frame 410A, an air knife frame 410B, an air knife 410C, a rotary lifter 410D, a plurality of protrusions 410E, an endless portion mechanism 410F, a wheel assembly 410G, a plurality of flighted compartments 410H, a conveyor 410I, a tunnel 410J, a duct 410K, and a motor assembly 410L. Note that the stations can be identical to each other in structure or function in any way.

The base frame 410A can comprise a lattice. The frame 410A is an assembly, such as via fastening, mating, interlocking, adhering, clamping, nesting, telescoping, or other assembly methods. However, in other embodiments, the frame 410A is unitary. The frame 410A can be solid or perforated, whether opaque, transparent, or translucent.

The frame 410A comprises a rotational axis portion 410A1 about which the lifter 410D rotates. The portion 410A1, which can be ring-shaped, enables the lifter 410D to rotate about a horizontal axis. The portion 410A1 can mirror a shape of the lifter 410D, such as circular. The portion 410A1 is solid, but can be can be perforated along a perimeter of the portion 410A1 or contain an opening, such as at 6 o'clock and 12 o'clock positions.

The frame 410B can be of any type or shape. The frame 410B can comprise a lattice. The frame 410B is operably coupled to the frame 410A, such as via fastening, mating, interlocking, adhering, clamping, nesting, telescoping, or other assembly methods. However, in other embodiments, the frame 410A is unitary with the frame 410B. The frame 410B is cantilevered from the frame 410A. However, in other embodiments, the frame 410B is non-cantilevered to the frame 410. The frame 410B can be solid or perforated, whether opaque, transparent, or translucent.

The air knife 410C comprises an air plenum 410C2, an input opening 410C1, an output opening 410C3, a plurality of dividers 410C4, a plurality of locks 410C5, and a lever 410C6. The plenum 410C2 is operably coupled to the frame 410B, such as via fastening, mating, interlocking, adhering, clamping, nesting, telescoping, or other assembly methods. However, in other embodiments, the plenum 410C2 and the frame 410B are unitary. The plenum 410C2 is locked to the portion 410A1 via the locks 410C5. The plenum 410C2 defines the opening 410C1, which is in fluid communication with the segment 408A. The plenum 410C2 defines the output opening 410C3, which is divided into a plurality of slots via the dividers 410C4. The dividers 410C4 are stationary, but in other embodiments, are mobile, such as to redefine the slots, whether equally or non-equally. For example, at least one of such slots can be rectilinear, arcuate, cross-shaped, or ring-shaped. The plenum 410C2 receives the air or gas from the segment 408A via the opening 410C1 and conducts the air or gas to the opening 410C3 though which the air or gas is output in a pressurized manner in a uniform sheet of laminar fluid flow based at least in part on the dividers 410C4 interfacing with the air or gas. Note that the plenum 410C2 is appropriately pressurized during such conduction. The lever 410C6 is configured to switch the air knife between an operational state, such as when the air knife 410C blows as described herein, and a non-operational state, such as when the air knife 410C does not blow as described herein. Note that the air knife 410C can also be switched between such states automatically, such as via the computer/control panel, as described herein. Also, note that any type of fluid output device can be used. Such fluid can comprise at least one of a liquid and a gas.

The rotary lifter 410D is a drum mounted onto the portion 410A. Such mounting enables the lifter 410D to rotate about the portion 410, i.e., about a horizontal axis. Note that although the drum is circular, any endless shape is possible, such as a pentagon, triangle, a square, an oval, an ellipse, and so forth. Further, although the lifter 410D is rotary, other configurations are possible as well. For example, at least one of such configurations can comprise a chain to which a set of cylindrical containers are coupled, with each of the containers providing its content for processing, as described herein.

The lifter 410D comprises a plurality of tracks 410D1 which engage the wheel assembly 410G. The tracks 410D1 are unitary with the lifter 410D, but can be an assembly, such as via fastening, mating, interlocking, adhering, clamping, nesting, telescoping, or other assembly methods. The lifter 410D comprises the protrusions 410E positioned externally thereon, along a perimeter of the lifter 410D. The protrusions 410E can comprise at least one of a spike, a sprocket, a groove, and a tooth, or any combinations thereof. The protrusions 410E mate with the mechanism 410F, such as under tension to synchronize a rotation of the lifter 410D based at least in part on an operation of the assembly 410L. The protrusions 410E are unitary to the lifter 410D. However, in other embodiments, the protrusions 410E are coupled to the lifter 410D, such as via fastening, mating, interlocking, adhering, clamping, nesting, telescoping, or other coupling methods. In yet other embodiments, the lifter 410D comprises a plurality of depressions externally positioned thereon along a perimeter of the lifter 410D. The depressions can comprise at least one of a well and a pit, or any combinations thereof, in any shape. Accordingly, the mechanism 410F comprises the protrusions 410E.

The mechanism 410F comprises at least one of a timing belt and a timing chain, whether toothed, perforated, grooved, or un-toothed. For example, the mechanism 410F comprises an inner surface with a plurality of projections/depressions, such as teeth, sprockets, or grooves. Note that other types of endless timing band/chain are possible as well. The mechanism 410F can comprise a synthetic fiber.

The wheel assembly 410G comprises a base 410G1, a plurality of horizontal shafts 410G3, and a plurality of wheels 410G2 mounted onto the shafts 410G3. The base 410G1 is operably coupled to the frame 410A, such as via fastening, mating, interlocking, adhering, clamping, nesting, telescoping, or other coupling methods. However, in other embodiments, the base 410G1 is unitary with the frame 410A. The wheels 410G2 are externally grooved and engage the tracks 410D1. However, in other embodiments, the lifter 410D is externally grooved and the wheels 410G2 engage the lifter 410D based on such grooving. At least one of the wheels 410G2 is solid, but can be perforated. At least one of the wheels 410G2 can be transparent, translucent, or opaque. At least one of the wheels 410G2 can be unitary or an assembly, such as via fastening, mating, interlocking, adhering, clamping, nesting, telescoping, or other assembly methods. At least one of the wheels 410G2 can be rubberized or comprise a tire mounted thereon. At least one of the wheels 410G2 can be externally grooved, such as via comprising a groove defined via a pair of sidewalls. At least one of the wheels 410G2 can comprise a set of protrusions/depressions such that the at least one of the wheels 410G2 operates as a gear. For example, such protrusions can be teeth.

The lifter 410D comprises a plurality of flighted compartments 410H defined via a plurality of partitions disposed radially along an internal side of the lifter 410D. The partitions comprise a plurality of L-shaped fingers 410H1 coupled to the partitions, such as via fastening, mating, interlocking, adhering, clamping, nesting, telescoping, or other assembly methods. In other embodiments, the fingers 410H1 are unitary to the partitions. The fingers 410H1 are positionally fixed, but can be pivoting, such as about a diagonal axis, vertical axis or a horizontal axis. The compartments 410H are identical to each other in volume or shape, but can be different. For example, when the portion 410A1 is substantially closed except for the 12 o'clock and 6 o'clock positions, the material in the compartments 410H remains in the compartments 410H until or before the 12 o'clock position, such as about 10 o'clock, when the material gravitationally falls out or starts falling out from the compartments 410H. Alternatively or additionally, when the portion 410A1 is not substantially closed, at least some of the compartments 410 can comprises doors, whether spring-loaded, automatically activated, gravitationally pivoted or trap-door configured, which allow the material to be released from the compartments 410H. Note that baskets, articulating arms, claws, grippers, or other material receipt and release technologies are possible, whether additionally or alternatively to at least one of compartments 410H.

The conveyor 410I can be of any type. The conveyor is driven by a motor 410I1, which can be of any type, such as an electric servomotor operating a belt of the conveyor 410I. The conveyor 410I is positioned to receive the material dropped from the flighted compartments 410H of the rotary lifter 410D. For example, the conveyor 410I conveys in a direction in which the air knife 410C blows or in another direction, such as perpendicular or diagonal thereto. The conveyor 410I conveys the dropped material underneath the tunnel 410J toward the duct 410K. Note that such drop can be a slide or a release, whether active or passive, whether with a force application or gravitationally induced, whether direct or indirect, whether in whole or in part.

The tunnel 410J can be of any type. The tunnel 410J can be solid or perforated, whether opaque, transparent, or translucent. Although the tunnel 410J is U-shaped, other shapes are possible as well, such as a V-shape, a W shape, a C-shape, or others. The tunnel 410J can be unitary or an assembly, such as via fastening, mating, interlocking, adhering, clamping, nesting, telescoping, or other assembly methods. The tunnel 410J is operably coupled to the frame 410A1, such as via fastening, mating, interlocking, adhering, clamping, nesting, telescoping, or other coupling methods. In other embodiments, the tunnel 410J is unitary with the frame 410A1.

The tunnel 410J comprises a top closed window 410J1 and a side door 410J2. The window 410J1 is operably coupled to the tunnel 410J, such as via fastening, mating, interlocking, adhering, clamping, nesting, telescoping, or other coupling methods. The window 410J1 can be transparent or translucent. The window 410J1 can be reinforced within an internal lattice. The window 410J1 can be of any shape. The window 410J1 provides visual access to the conveyor 410I. Alternatively, the window 410J1 can be a part of a door.

The door 410J2 is operably coupled to the tunnel 410J, such as pivotally, hingedly, slidably, or in other manners. The door 410J2 comprises a closed window, which can be transparent or translucent, which can be reinforced within an internal lattice. The window can be of any shape. The window provides visual access to the conveyor 410I. Note that the door 410J2 can also be windowless. The door 410J2 remains closed or locked via a latch, a hook, a lock, a magnet, a hook-and-loop fastener, or some other mechanism, whether manual or automatic. The door 410J2 comprises a handle, but can lack one as well. When opened, the door 410J2 provides a hands on or tool access to the conveyor 410I, such as for clean up or maintenance. When closed, the door 410J2 can provide a seal to the tunnel 410J for blowing efficiency, which can be hermetic.

The duct 410K is in fluid communication with the conveyor 410I and the tunnel 410J. The duct 410K is coupled to the tunnel 406S, such as via fastening, mating, interlocking, adhering, clamping, nesting, telescoping, or other coupling methods. In other embodiments, the duct 410K is unitary with the tunnel 410J. The duct 410K defines an opening 410K2, which can be of any shape. The duct 410K comprises a closed window 410K1 and a door 410K3. The duct 410K further comprises an at least partially open bottom surface, which can be of any shape, or defines a bottom opening, which can be of any shape. At least one of the partially open bottom surface and the bottom opening disposed above one of the separation stations of the separation section 410, such as the lifter 410D. For example, the bottom opening can be defined via a set of sidewalls defining the duct 406T.

The window 410K1 is operably coupled to the duct 410K, such as via fastening, mating, interlocking, adhering, clamping, nesting, telescoping, or other coupling methods. The window 410K1 can be transparent or translucent. The window 410K1 can be reinforced within an internal lattice. The window 410K1 can be of any shape. The window 410K1 provides visual access to an interior chamber of the duct 410K, such as the at least partially open bottom surface or the bottom opening. Alternatively, the window 410K1 can be a part of a door.

The door 410K3 is operably coupled to the duct 406T, such as pivotally, hingedly, slidably, or in other manners. The door 410K3 comprises a closed window, which can be transparent or translucent, which can be reinforced within an internal lattice. The window can be of any shape. The window provides visual access to the inner chamber of the duct 410K or the at least partially open bottom surface or the bottom opening. Note that the door 410K3 can also be windowless. The door 410K3 remains closed or locked via a latch, a hook, a lock, a magnet, a hook-and-loop fastener, or some other mechanism, whether manual or automatic. The door 410K3 comprises a handle, but can lack one as well. When opened, the door 410K3 provides a hands on or tool access to the inner chamber of the duct 410K or the at least partially open bottom surface or the bottom opening, such as for clean up or maintenance. When closed, the door 410K3 can provide a seal to the duct 410K for fluid flow efficiency, which can be hermetic. The duct 410K is in fluid communication with the segment 412B via the opening 410K3.

The motor assembly 410L can be of any type, such as an electric servomotor or some other type of a rotary actuator. The assembly 410L drives the mechanism 410F.

In the second position, the lifter 410D elevates the material to an upper quadrant of the lifter 410D, as the product is stored in the compartments 410H. In the upper quadrant, the lifter 410D drops the material, such as the sugarcane billets and remaining trash, onto the conveyor 410I. During the drop, the air or gas, which can be heated as described herein, under pressure, from the air knife 410C separates the material, such as the trash from the sugarcane billets, and blows some of the constituents of the material, such as the trash, toward the opening 410K2, which is in fluid communication with the segment 412B. Resultantly, some of the heavier constituents of the material, such as the sugarcane billets, drop onto conveyor 410I that drops that material into a subsequent lifter 410D. Such process is repeated by the subsequent lifter 410D, with each instance separating the material to a higher degree than before. Note that such drop can be a slide or a release, whether active or passive, whether with a force application or gravitationally induced, whether direct or indirect, whether in whole or in part.

Note that although the segments 412A, 412B suction from different directions, such configuration can be different in other embodiments. For example, the segments 412A, 412B can both extend in one direction, such as toward the conveyor 800 or away from the conveyor 800. Note that although the lifters 410D are extending along a diagonal plane, in other embodiments the lifters 410D can be stationed along a horizontal plane. Similar configurations can be achieved with the air knives 410C in any manner as described herein. Note that since the air or gas pressure or temperature can decrease if the air knives 410C are fed from one conduit, in other embodiments, the air knives 410C can be fed from more than one conduit and/or comprise air pressure boosters between the air knives 410C to maintain a relative pressure among the air knives 410C. However, in some embodiments, the pressure can be increasing as the material travels upward to improve the separation process and/or decrease as the material travels upward because undesired material frequency decreases with each level of travel between the lifters 410D.

Figure 32:
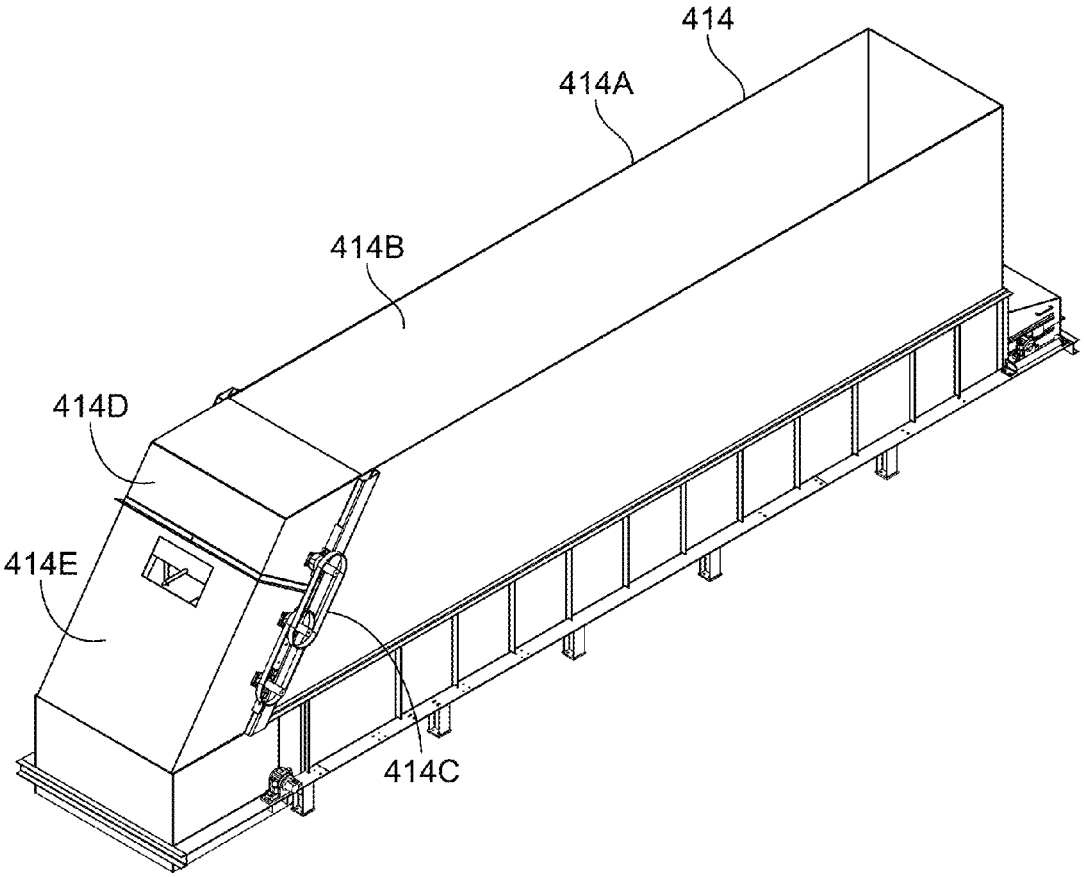
FIG. 32 shows a perspective view of an example embodiment of a return conveyor according to the present disclosure.
Figure 33:
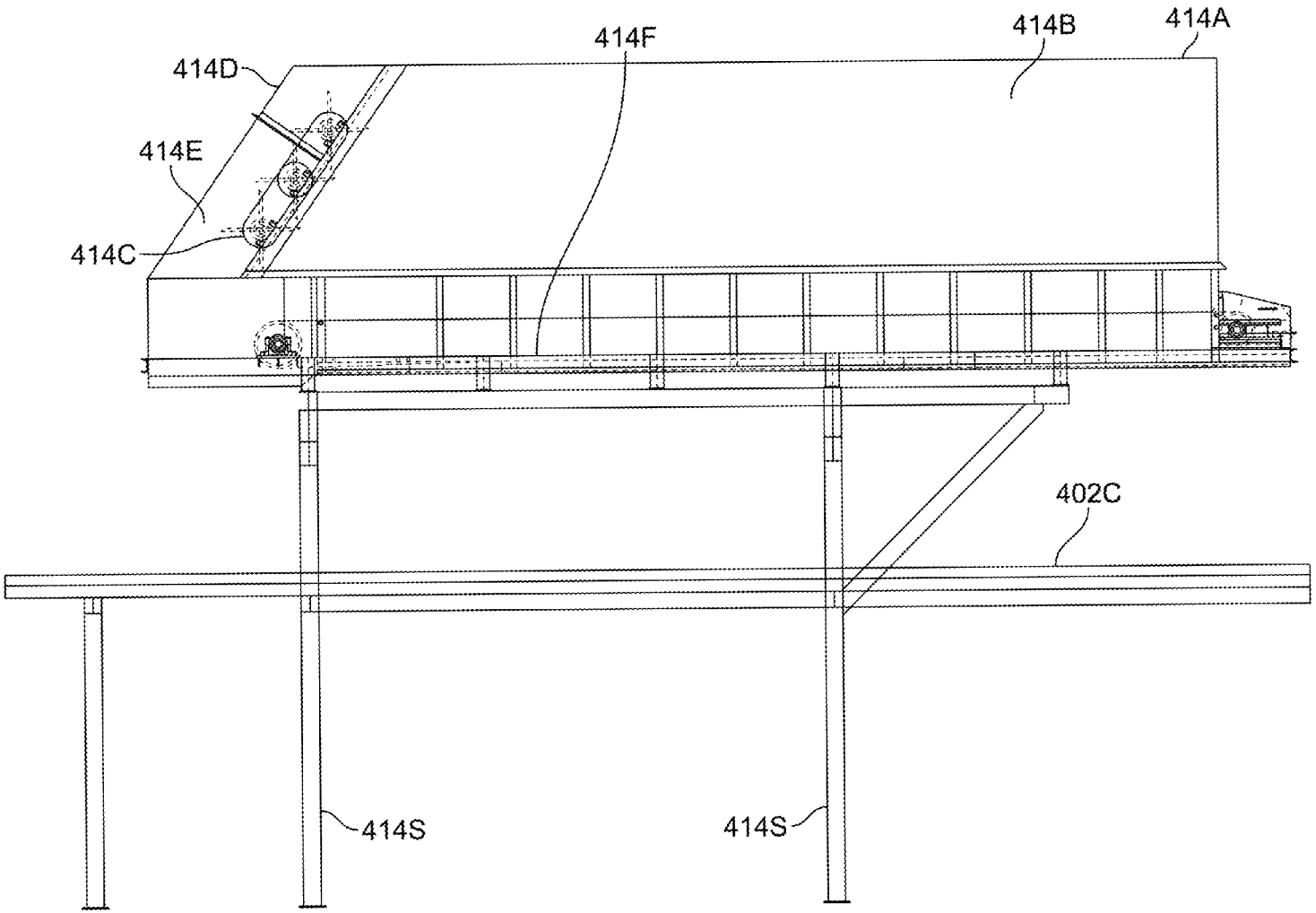
FIG. 33 shows a longitudinal cross-sectional view of an example embodiment of a return conveyor according to the present disclosure.

FIG. 32 shows a perspective view of an example embodiment of a return conveyor according to the present disclosure. FIG. 33 shows a longitudinal cross-sectional view of an example embodiment of a return conveyor according to the present disclosure. Some elements of these figures are described above. Thus, same reference characters identify identical and/or like components described above and any repetitive detailed description thereof will hereinafter be omitted or simplified in order to avoid complication.

The return conveyor section 414 comprises a chute into which the last duct 410K conducts the material, as serially separated. For example, such material comprises sugarcane billets as substantially separated from the sugarcane trash. The chute comprises a U-shape cross-section, while extending longitudinally along a diagonal plane. However, in other embodiments, the chute can also comprise an O-shape cross-section, such as a tubular duct, which can be polygonal. The chute is configured to receive material from the at least partially open bottom surface or the bottom opening of the duct 410K. The chute is positionally fixed. However, in other embodiments, the chute is positionally adjustable, whether along a horizontal plane or a vertical plane. In yet other embodiments, the chute is longitudinally extendible, whether manually or automatically, such as via telescoping.

The section 414 comprises a bin 414A and a motorized conveyor 414F hosted in the bin 414A. The bin 414A can be of any type, shape, or volume. The conveyor 414F can be of any type. The bin 414A defines an interior open space 414B with access to the conveyor 414F. The space 414B can be of any volume or shape. The section 414 comprises an upper portion 414D and a door 414E. The section 414 comprises a movement mechanism 414C, which slidably lifts the door 414E with respect to the portion 414D along a diagonal plane to provide access to the space 414B. Such lifting creates an exit opening for the material, which can be of any shape or size. Alternatively, the door 414E pivots, such as hingedly, to allow for the material to exit. Accordingly, the conveyor 414 receives the material from the chute and conveys the material horizontally toward the door 414E, which is slid open via the mechanism 414C. Some of the material on the conveyor 414F exits via the exit opening. However, when the material piles up on the conveyor 414F, such as being higher than the door 414E can accommodate, the portion 414D applies force to the piled up material to exit the bin 414A through the exit opening. Note that the material output section 900 can receive the material from the exit opening.

Figure 34:
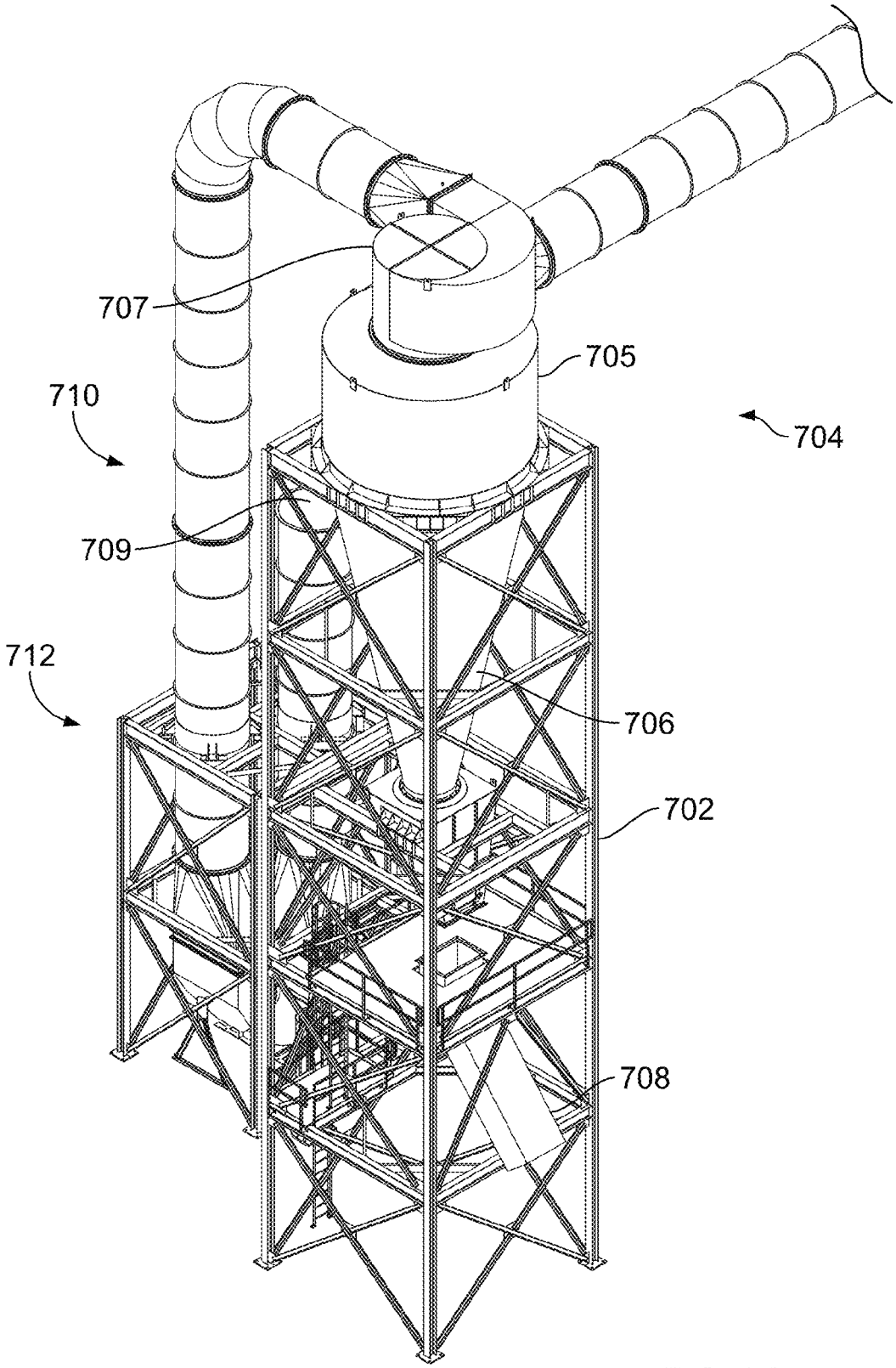
FIG. 34 shows a perspective view of an example embodiment of a material processing assembly according to the present disclosure.

FIG. 34 shows a perspective view of an example embodiment of a material processing assembly according to the present disclosure. Some elements of this figure are described above. Thus, same reference characters identify identical and/or like components described above and any repetitive detailed description thereof will hereinafter be omitted or simplified in order to avoid complication.

The material processing assembly 700 comprises the suction source 712 resting on the ground surface and the ductwork 710 in fluid communication with the suction source 712 and the cyclone separator 704. The suction source 712 provides negative air or gas pressure to suction the material from the ductwork assembly 500, as received from the separation assembly 400. For example, the suction source 712 is a motorized suction pump configured to create a pressure difference to provide continuous suctioning action. In other embodiments, the frame 702 hosts the suction source 712, such as via fastening, mating, interlocking, adhering, clamping, nesting, adhering, magnetizing, or other methods.

The frame 702 hosts the separator 704, which comprises a duct 707, a cyclone cylindrical body 705 in fluid communication with the duct 707, and the conical section 706 in fluid communication with the cyclone body 705 at a first end of the cyclone body 705. The separator 704 operates opposite from the air supply section 300, such as the separator 304. In contrast to the separator 304 supplying air, the separator 704 suctions air via cyclonic separation principles.

As the dirty air is input via the inlet duct into the cylindrical body 705, such as in a laterally originating path from the duct 506, the dirty air begins to flow within the cylindrical body 705 in a downward helical pattern from a top portion of the cylindrical body 705, i.e. from the duct 707, toward the open end of the conical section 706 before exiting the cylindrical body 705 in a straight upward stream path through a center of the helical pattern via the duct 707 along the vertical axis along which the first end and the second end are positioned. Such upstream airflow is directed to the ductwork 710 through which the suction 712 provides suctioning action, whether on a continuous or a periodic basis. However, when the dirty air enters the conical section 706, the dirt in the air has excessive inertia to follow a tight curve flow of the hot air upward toward the duct 707, such as due to size or density. Resultantly, the dirt strikes an inner surface of the conical section 706. Since a rotational path is reduced in the conical section 706, due to a tapering volume of the conical section 706, such striking action causes the dirt to separate into a set of small particles, which are output through the open end of the conical section 706 based at least in part on natural gravity. Accordingly, the dirt exits the conical section 706 and falls onto the chute 708. The air, which is effectively substantially free from the dirt, exits the separator 704, via the rectilinear outlet duct toward the ductwork 710 as suctioned via the suction source 712. The suction source exits such air via a duct 709.

Figure 35:
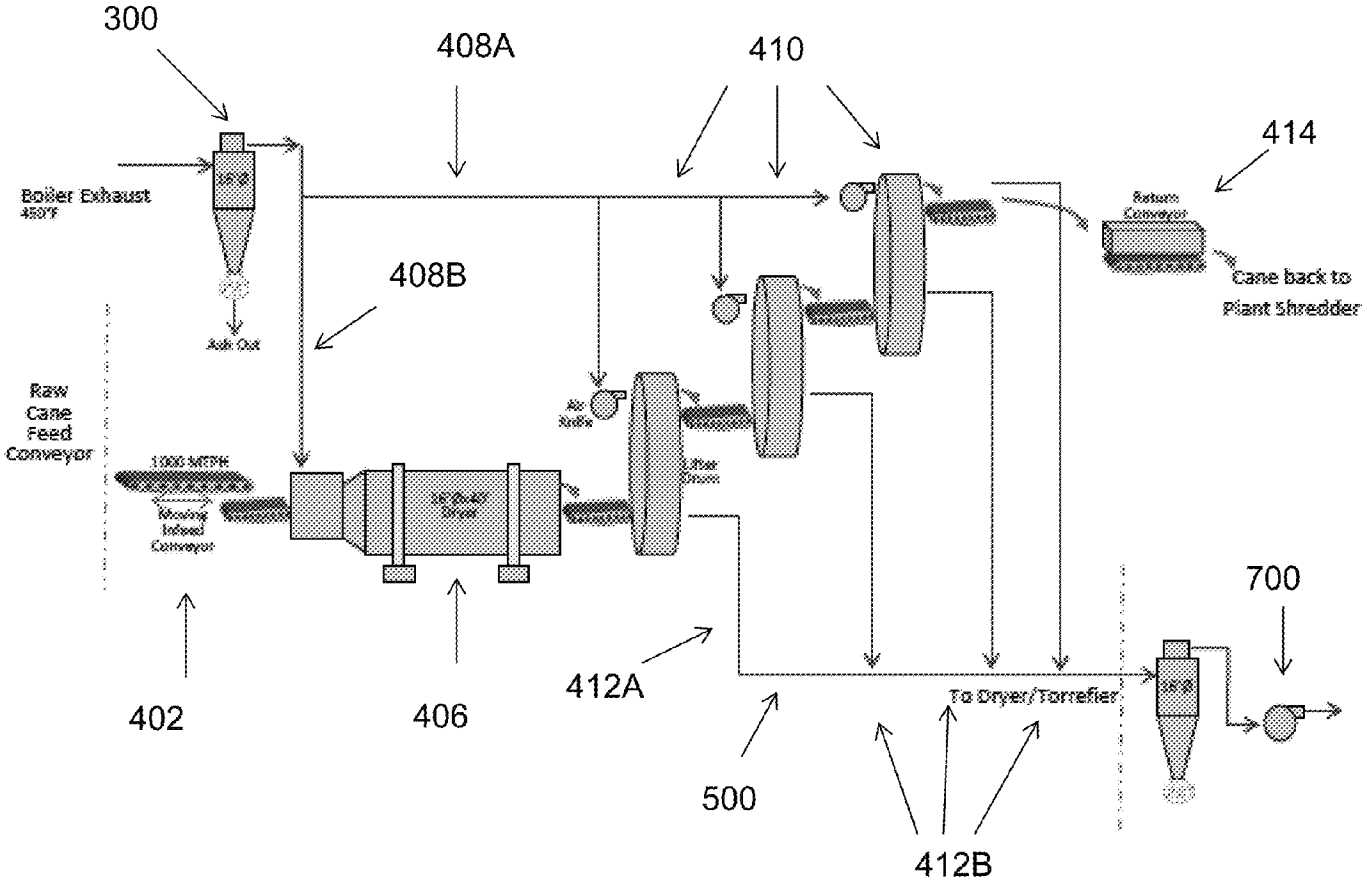
FIG. 35 shows a schematic flow diagram of an example embodiment of a method for detrashing according to the present disclosure.

FIG. 35 shows a schematic flow diagram of an example embodiment of a method for detrashing according to the present disclosure. Some elements of this figure are described above. Thus, same reference characters identify identical and/or like components described above and any repetitive detailed description thereof will hereinafter be omitted or simplified in order to avoid complication.

As described herein, the air or gas is provided by the air supply section 300 to the separation sections 410 via the segment 408A and to the dryer section 406 via the segment 408B. The dryer section 406 receives the material from the input conveyor section 402. Upon exit from the dryer section 406, based on the air or gas, the material is separated, with some of the constituents of the material exiting via the segment 412A through the ductwork assembly 500 to the material processing assembly 700, and with some of the constituents of the material being conducted to the separation sections 410 for further separation. Based on such separation via the air or gas, the material is separated, with some of the constituents of the material being conducted to the separation sections 410 for further separation and some of the constituents of the material exiting via the segment 412B through the ductwork assembly 500 to the material processing assembly 700. Such process iterates based on a number of the separation stations in the separation section. Accordingly, the return conveyor section 414 receives the material, which has been separated as desired.

In some embodiments, the system 100 can handle about 1250 metric tons of sugarcane biomass per hour and extract a minimum of about 85% of the trash and ash present in the biomass. The system 100 has enough biomass extraction capacity to include all field trash (material currently left in a field). The field trash can be transported to the sugar mill and all sugarcane billets currently left behind in the field can be processed for sugar extraction increasing sugar yields up to about 8% per acre. The system 100 is designed to extract most, if not all, metallic objects in the biomass before entry at least into the drum 406L. The system 100 includes four vacuum stations and three high-pressure blowing systems utilizing hot air to separate the trash and ash from the sugarcane billets. However, those numbers can be higher or lower. The system 100 elevates the material via lifter drums to drop the material three times for trash extraction. The system 100 transfers the clean sugarcane billets after the last drop into a chute and the cleaned sugarcane billets slide to an accumulation conveyor. The system 100 transfers the clean sugarcane billets back to the mill from the accumulation conveyor at a controlled rate desired for mill operations. The system 100 can extract dirt in extremely wet conditions, such as about 2 inches of rainwater per hour. The system 100 can utilize waste heat to separate leaves and dirt from the sugarcane billets. The system 100 can separate trash and dirt at the mill before the material enters the sugar making process reducing wear and tear on at least some mechanical mill systems. The system 100 can be designed for flexible speed to follow the sugar mills variable crushing speed. The system 100 can increase a crushing capacity of the mill by up to about 20%. The system 100 can be designed to return the biomass at the exact point where the system 100 receives the biomass. In some embodiments, the system 100 is housed indoors, such as in a warehouse and/or a tent, with some outputs exiting to outdoors. Note that such drop can be a slide or a release, whether active or passive, whether with a force application or gravitationally induced, whether direct or indirect, whether in whole or in part.

Figure 36:
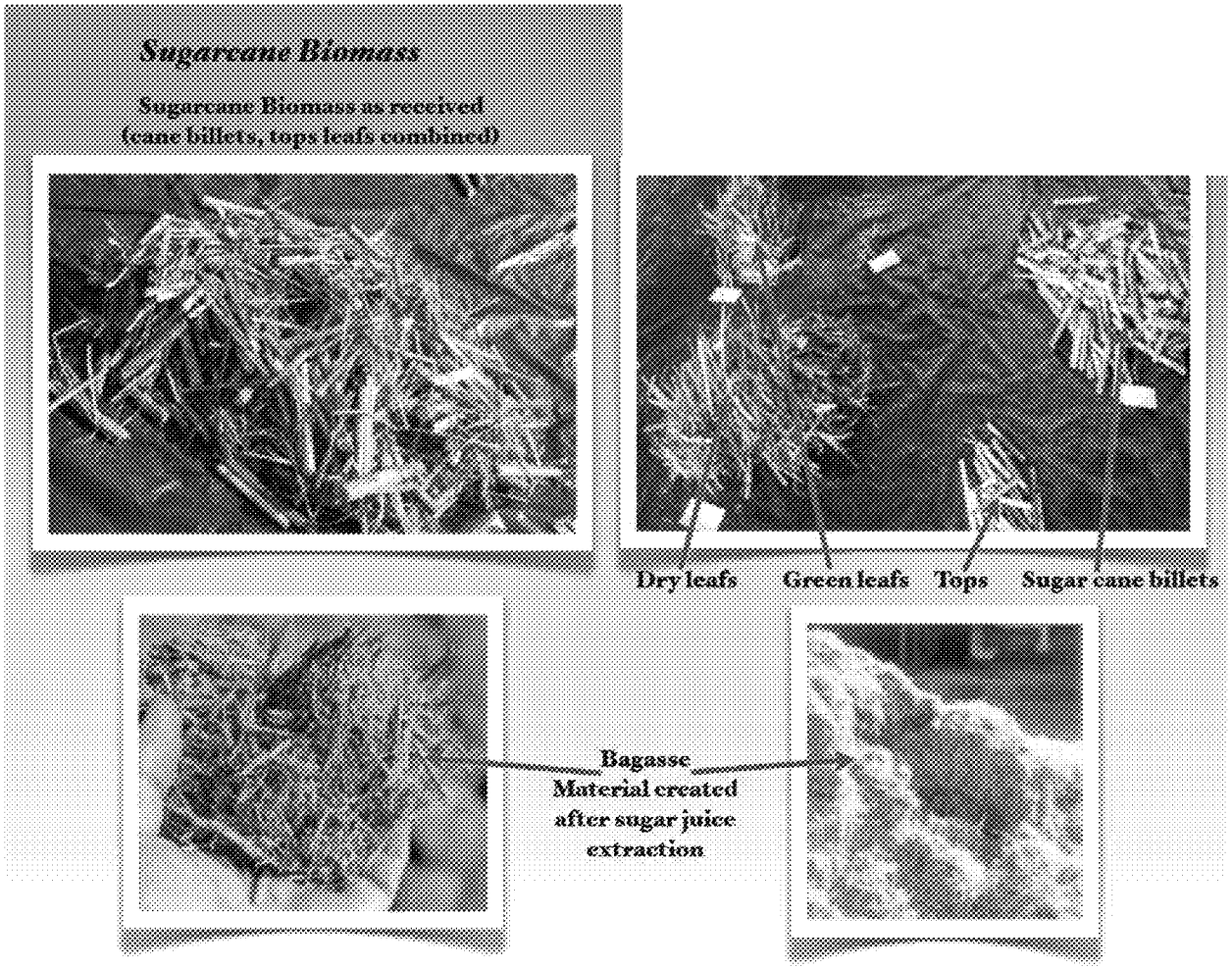
FIG. 36 shows an example embodiment of a biomass before detrashing and after detrashing according to the present disclosure.

FIG. 36 shows an example embodiment of a biomass before detrashing and after detrashing according to the present disclosure. Some elements of this figure are described above. Thus, same reference characters identify identical and/or like components described above and any repetitive detailed description thereof will hereinafter be omitted or simplified in order to avoid complication.

A left upper portion depicts the material before detrashing via the system 100. A right upper portion depicts the material after detrashing via the system 100.

In some embodiments, various functions or acts can take place at a given location and/or in connection with the operation of one or more apparatuses or systems. In some embodiments, a portion of a given function or act can be performed at a first device or location, and the remainder of the function or act can be performed at one or more additional devices or locations.

The corresponding structures, materials, acts, and equivalents of all means or step plus function elements in the claims below are intended to include any structure, material, or act for performing the function in combination with other claimed elements as specifically claimed. The embodiments were chosen and described in order to best explain the principles of the disclosure and the practical application, and to enable others of ordinary skill in the art to understand the disclosure for various embodiments with various modifications as are suited to the particular use contemplated.

The diagrams depicted herein are illustrative. There can be many variations to the diagram or the steps (or operations) described therein without departing from the spirit of the disclosure. For instance, the steps can be performed in a differing order or steps can be added, deleted or modified. All of these variations are considered a part of the disclosure. It will be understood that those skilled in the art, both now and in the future, can make various improvements and enhancements which fall within the scope of the claims which follow.

The description of the present disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of the present disclosure.

The invention claimed is:

1. A system for material separation, the system comprising:

a rotary lifter which includes a rotary lifter frame and a rotary lifter drum coupled to the rotary lifter frame, wherein the rotary lifter drum includes an inner compartment, wherein the rotary lifter drum is configured to rotate in relation to the rotary lifter frame such that the inner compartment moves from an input position to an output position, wherein the inner compartment is configured to receive a first material when the inner compartment is positioned in the input position, wherein the inner compartment is configured to output the first material when the inner compartment is positioned in the output position;

a fluid output device configured to output a fluid in a first direction such that the first material is separated into at least a second material and a third material when moving away from the output position;

a conveyor configured to receive the second material upon separation from the first material via the fluid, wherein the conveyor is configured to convey the second material in a second direction; and a suction duct configured to receive the third material upon separation from the first material via the fluid.

2. The system of claim 1, wherein the first direction is at least one of substantially identical to the second direction, substantially opposite to the second direction, and substantially orthogonal to the second direction.

3. The system of claim 1, wherein the conveyor is a first conveyor, and further comprising:

a second conveyor configured to convey the first material in a third direction to the inner compartment such that the inner compartment positioned in the input position receives the first material.

4. The system of claim 3, wherein the suction duct is a first suction duct, and further comprising:

a dryer section configured to dry a fourth material and to separate the fourth material into at least the first material and a fifth material, wherein the dryer section is configured to provide the first material to the second conveyor such that the second conveyor conveys the first material in the third direction toward the inner compartment positioned in the input position; and a second suction duct configured to receive the fifth material immediately after separation by the dryer section.

5. The system of claim 4, wherein each of the first suction duct and the second suction duct is in fluid communication with a third suction duct.

6. The system of claim 3, wherein the second direction and the third direction are at least one of substantially different directions and substantially identical direction, on different horizontal planes.

7. The system of claim 6, wherein the second direction and the third direction are at least one of opposite and orthogonal.

8. The system of claim 3, further comprising:

a dryer input assembly which includes a dryer input assembly frame, a closure, a third conveyor, and an airlock body, wherein the closure includes a first side and a second side, wherein the airlock body includes an outlet, wherein the closure is coupled to the dryer input assembly frame, wherein the airlock body extends away from the second side; a dryer drum which includes an input open end and an interior in fluid communication with the input open end, wherein the closure is positioned at the input open end such that the closure substantially aligns with and substantially blocks the input open end, and the second side faces the interior of the dryer drum such that the airlock body extends inside the dryer drum, wherein the dryer drum rotates with respect to the airlock body, wherein the third conveyor is configured to convey a fourth material from the first side toward the second side such that the fourth material is transferred past the closure to the airlock body, wherein the outlet outputs the fourth material into the dryer drum, wherein the fourth material includes the first material and a fifth material, wherein the second conveyor is configured to receive the first material from the dryer drum.

9. The system of claim 8, wherein the airlock body includes a U-shaped section which includes a base portion, wherein the airlock body includes a wall diagonally inclined between the second side and the base portion, wherein the wall defines the outlet.

10. The system of claim 9, wherein the wall is pivotally coupled to the second side, such that upon transfer of the fourth material into the dryer drum, the wall pivots upward away from the base portion and is offset from the base portion to allow a passage of the fourth material into the dryer drum.

11. The system of claim 1, wherein the input position and the output position are diametrically opposed.

12. The system of claim 1, wherein the conveyor is coupled to the rotary lifter frame.

13. The system of claim 1, wherein the fluid output device is coupled to the rotary lifter frame.

14. The system of claim 1, wherein the suction duct defines an opening into which the conveyor conveys the second material.

15. The system of claim 1, wherein the first material includes sugarcane plant trash, including sugarcane stem billets and sugarcane leaves, wherein the second material includes the sugarcane stem billets, and wherein the third material includes the sugarcane leaves.

16. The system of claim 1, further comprising:

a fluid source configured to source the fluid for the fluid output device via a cyclonic separation process, wherein the fluid output device is positioned downstream from the fluid flow source;

a suction source configured to provide suction to the suction duct via a reverse cyclonic separation process, wherein the suction source is positioned downstream from the fluid flow source.

17. The system of claim 1, wherein the suction duct includes an inlet, and further comprising:

a tunnel positioned over the conveyor and before the inlet, wherein the fluid output device is configured to direct the fluid in the first direction toward the tunnel, wherein the tunnel is configured to receive the third material upon an impingement of the fluid on the first material, wherein the inlet is configured to receive the third material from the tunnel.

18. The system of claim 1, wherein the input position and the output position are distinct from each other.

19. A system for material separation, the system comprising:

a rotary lifter which includes a frame and a drum coupled to the frame, wherein the drum includes an inner compartment, wherein the drum is configured to rotate with respect to the frame such that the inner compartment moves from an input position to an output position, wherein the inner compartment is configured to receive a first material when the inner compartment is positioned in the input position, wherein the inner compartment is configured to output the first material when the inner compartment is positioned in the output position;

a fluid output device configured to output a fluid such that the first material is separated into at least a second material and a third material when moving away from the output position;

a conveyor configured to receive the second material upon separation from the first material via the fluid.

20. The system of claim 19, wherein the input position and the output position are distinct from each other.

21. The system of claim 19, wherein the conveyor is a first conveyor, and further comprising:

a second conveyor configured to convey the first material to the inner compartment such that the inner compartment positioned in the input position receives the first material.

22. The system of claim 19, wherein the conveyor is a first conveyor, and further comprising:

a second conveyor; and a dryer section configured to dry a fourth material and to separate the fourth material into at least the first material and a fifth material, wherein the dryer section is configured to provide the first material to the second conveyor such that the second conveyor conveys the first material toward the inner compartment positioned in the input position.

23. The system of claim 19, wherein the frame is a first frame, wherein the conveyor is a first conveyor, wherein the drum is a first drum, and further comprising:

a dryer input assembly including a second frame, a closure, a second conveyor, and an airlock body, wherein the closure includes a first side and a second side, wherein the airlock body includes an outlet, wherein the closure is coupled to the second frame, wherein the airlock body extends away from the second side;

a third conveyor; and a second drum which includes an input open end and an interior in fluid communication with the input open end, wherein the closure is positioned at the input open end such that the closure substantially aligns with and substantially blocks the input open end, and the second side faces the interior of the second drum such that the airlock body extends inside the second drum, wherein the second drum rotates with respect to the airlock body, wherein the second conveyor is configured to convey a third material from the first side toward the second side such that the third material is transferred past the closure to the airlock body, wherein the outlet outputs the third material into the second drum, wherein the third material includes the first material and a fourth material.

24. The system of claim 23, wherein the airlock body includes a U-shaped section which includes a base portion, wherein the airlock body includes a wall diagonally inclined between the second side and the base portion, wherein the wall defines the outlet.

25. The system of claim 24, wherein the wall is pivotally coupled to the second side, such that upon transfer of the third material into the second drum, the wall pivots upward away from the base portion and is offset from the base portion to allow a passage of the third material into the second drum.

26. The system of claim 19, wherein the input position and the output position are diametrically opposed.

27. The system of claim 19, wherein the conveyor is coupled to the frame.

28. The system of claim 19, wherein the fluid output device is coupled to the frame.

29. The system of claim 19, wherein the drum is positioned between the fluid output device and the conveyor.

30. The system of claim 19, further comprising:

at least one of a belt or a chain engaging the drum such that the drum is able to be driven thereby.

* * * * *